US007341814B2

(12) United States Patent
Kami et al.

(10) Patent No.: US 7,341,814 B2
(45) Date of Patent: Mar. 11, 2008

(54) ELECTROPHOTOGRAPHIC PHOTOCONDUCTOR, PREPARATION METHOD THEREOF, ELECTROPHOTOGRAPHIC APPARATUS AND PROCESS CARTRIDGE

(75) Inventors: Hidetoshi Kami, Numazu (JP); Naohiro Toda, Yokohama (JP); Yoshiaki Kawasaki, Susono (JP); Maiko Kondo, Ebina (JP); Ryoichi Kitajima, Numazu (JP); Narihito Kojima, Numazu (JP); Hiroshi Nagame, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 421 days.

(21) Appl. No.: 11/030,307

(22) Filed: Jan. 7, 2005

(65) Prior Publication Data

US 2005/0181291 A1 Aug. 18, 2005

(30) Foreign Application Priority Data

Jan. 8, 2004 (JP) ..... 2004-003143

(51) Int. Cl.
*G03G 15/04* (2006.01)

(52) U.S. Cl. ..... 430/66; 430/58.05; 430/58.7; 430/132; 399/159

(58) Field of Classification Search ..... 430/66, 430/58.05, 58.7, 132; 399/159
See application file for complete search history.

(56) References Cited

U.S. PATENT DOCUMENTS 4,740,441 A 4/1988 Otomura
4,942,104 A 7/1990 Kitajima et al.
5,008,172 A 4/1991 Rokutanzono et al.
5,059,502 A 10/1991 Kojima et al.
5,147,751 A 9/1992 Kojima et al.
5,264,903 A 11/1993 Nagame et al.
5,339,138 A 8/1994 Mishima et al.
5,390,015 A 2/1995 Nagame et al.
5,452,061 A 9/1995 Kojima et al.
5,525,447 A 6/1996 Ikuno et al.
5,656,406 A 8/1997 Ikuno et al.
5,840,455 A 11/1998 Ikuno et al.
5,870,657 A 2/1999 Nagame et al.
5,871,876 A 2/1999 Ikuno et al.
6,014,532 A 1/2000 Takeichi et al.
6,030,733 A 2/2000 Kami et al.
6,060,205 A 5/2000 Takeichi et al.
6,118,964 A 9/2000 Kojima et al.
6,151,468 A 11/2000 Kami et al.
6,160,977 A 12/2000 Takeichi et al.
6,326,112 B1 12/2001 Tamura et al.

(Continued)

OTHER PUBLICATIONS

U.S. Appl. No. 11/157,998, filed Jun. 22, 2005, Tamura et al.

(Continued)

*Primary Examiner*—Mark A. Chapman
(74) *Attorney, Agent, or Firm*—Oblon, Spivak, McClelland, Maier & Neustadt, P.C.

(57) ABSTRACT

An electrophotographic photoconductor includes an electroconductive substrate, a photoconductive layer arranged over the electroconductive layer with or without the interposition of an undercoat layer, and a surface top layer containing a crosslinkable resin arranged over the photoconductive layer, the photoconductive layer includes a charge generation layer containing a charge generating material, and a charge transport layer containing a charge transporting material, in which the surface top layer is substantially free from hydroxyl groups and residual uncured portions.

26 Claims, 21 Drawing Sheets

U.S. PATENT DOCUMENTS 6,363,237 B1 3/2002 Nagame et al.
6,432,596 B2 8/2002 Ikuno et al.
6,521,386 B1 2/2003 Sakon et al.
6,521,387 B2 2/2003 Kawasaki
6,558,862 B2 5/2003 Kojima et al.
6,558,863 B2 5/2003 Rokutanzono et al.
6,562,529 B1 5/2003 Kojima et al.
6,573,016 B2 6/2003 Kami et al.
6,576,388 B2 6/2003 Sakon et al.
6,593,048 B2 7/2003 Sasaki et al.
6,641,964 B2 11/2003 Ikuno et al.
6,653,033 B1 11/2003 Kami et al.
6,667,141 B2 12/2003 Iwamoto et al.
6,686,114 B2 2/2004 Sakon et al.
6,699,632 B2 3/2004 Higuchi et al.
6,706,459 B2 3/2004 Kojima et al.
6,790,572 B2 9/2004 Tamura et al.
6,790,575 B2 9/2004 Sasaki et al.
6,811,944 B2 11/2004 Higuchi et al.
6,813,461 B2 11/2004 Higuchi et al.
6,824,939 B2 11/2004 Kurimoto et al.
6,835,517 B2 12/2004 Kondo et al.
2002/0081513 A1 6/2002 Higuchi et al.
2002/0159797 A1 10/2002 Matsuda et al.
2003/0077531 A1 4/2003 Suzuki et al.
2003/0099481 A1 5/2003 Sampe et al.
2003/0108362 A1 6/2003 Ohjimi et al.
2003/0113642 A1 6/2003 Kami et al.
2003/0152854 A1 8/2003 Kojima et al.
2003/0165760 A1 9/2003 Higuchi et al.
2003/0194627 A1 10/2003 Ikegami et al.
2003/0215726 A1 11/2003 Sugino et al.
2003/0219279 A1 11/2003 Nohsho et al.
2004/0028435 A1 2/2004 Kurimoto et al.
2004/0048178 A1 3/2004 Ikuno et al.
2004/0053149 A1 3/2004 Toda et al.
2004/0053154 A1 3/2004 Tomita et al.
2004/0076443 A1 4/2004 Suzuki et al.
2004/0120730 A1 6/2004 Niimi et al.
2004/0126147 A1 7/2004 Kondo et al.
2004/0126686 A1 7/2004 Toda et al.
2004/0126687 A1 7/2004 Ikegami et al.
2004/0126689 A1 7/2004 Tamoto et al.
2004/0142265 A1 7/2004 Tomita et al.
2004/0146795 A1 7/2004 Emoto et al.
2004/0185358 A1 9/2004 Kami
2004/0209181 A1 10/2004 Higuchi et al.
2004/0234294 A1 11/2004 Nagame et al.
2004/0234875 A1 11/2004 Toda et al.
2005/0026058 A1* 2/2005 Kami et al. ..... 430/66

OTHER PUBLICATIONS

U.S. Appl. No. 11/332,545, filed Jan. 17, 2006, Tamoto et al.
U.S. Appl. No. 11/367,786, filed Mar. 6, 2006, Ohta et al.
U.S. Appl. No. 11/403,012, filed Apr. 13, 2006, Toda.
U.S. Appl. No. 11/480,517, filed Jul. 5, 2006, Yanagawa et al.
U.S. Appl. No. 11/500,352, filed Aug. 8, 2006, Toshine et al.
U.S. Appl. No. 11/563,710, filed Nov. 28, 2006, Inaba et al.
U.S. Appl. No. 11/616,523, filed Dec. 27, 2006, Fujiwara et al.
U.S. Appl. No. 08/939,123, filed Sep. 26, 1997, Kazuya Ishida et al.
U.S. Appl. No. 10/625,570, filed Jul. 24, 2003, Nozomu Tamoto et al.
U.S. Appl. No. 10/724,260, filed Dec. 1, 2003, Shigeru Emoto et al.
U.S. Appl. No. 10/900,204, filed Jul. 28, 2004, Hidetoshi Kami et al.
U.S. Appl. No. 10/893,302, filed Jul. 19, 2004, Akihiro Sugino et al.
U.S. Appl. No. 10/856,962, filed Jun. 1, 2004, Takaaki Ikegami et al.
U.S. Appl. No. 10/793,320, filed Mar. 5, 2004, Hiroto Higuchi et al.
U.S. Appl. No. 11/763,258, filed Apr. 17, 2007, Kawasaki et al.
U.S. Appl. No. 11/684,520, filed Mar. 9, 2007, Toshine et al.
U.S. Appl. No. 11/685,441, filed Mar. 13, 2007, Yanagawa et al.

* cited by examiner

Sm=30μm

Sm=142μm

Sm=410μm

ELECTROPHOTOGRAPHIC PHOTOCONDUCTOR, PREPARATION METHOD THEREOF, ELECTROPHOTOGRAPHIC APPARATUS AND PROCESS CARTRIDGE

BACKGROUND OF THE INVENTION

1. Field of the Invention

The present invention relates to an electrophotographic photoconductor for use in electrophotographic image forming apparatuses such as copying machines, facsimile machines, laser-beam printers and direct digital (computer-to-plate) plate making machines. The present invention also relates to a method for preparing the photoconductor, and an image forming apparatus and a process cartridge using the electrophotographic photoconductor.

2. Description of the Related Art

Photoconductive materials for use in electrophotographic apparatuses such as copying machines and laser-beam printers have changed from inorganic photoconductive materials such as selenium, zinc oxide and cadmium sulfide to organic photoconductive materials (OPCs). This is because organic photoconductive materials are friendly to environment and have low manufacturing costs and good designing flexibility.

Organic photoconductors are broadly classified, for example, as the following three types: (1) homogeneous single-layered photoconductors in which a layer of a photoconductive resin such as polyvinylcarbazole (PVK) or a charge transfer complex such as PVK-TNF (2,4,7-trinitrofluorenone) is arranged over an electroconductive substrate; (2) dispersion type single-layered photoconductors in which a resin layer including a pigment such as phthalocyanine or perylene dispersed in the resin is arranged over an electroconductive substrate; and (3) functionally-separated multi-layered photoconductors in which a charge generation layer (hereinafter referred to as a CGL) including a charge generating material such as an azo pigment, and a charge transport layer (hereinafter referred to as a CTL) including a charge transporting material such as triphenylamine are arranged over an electroconductive substrate.

The functionally-separated multi-layered photoconductors typically have a structure in which a charge transport layer is arranged over a charge generation layer. Functionally-separated multi-layered photoconductors having a reverse structure are sometimes referred to as reverse-layered photoconductors. In particular, the functionally-separated multi-layered photoconductors have high photosensitivity and good flexibility for designing photoconductors having high photosensitivity and good durability. The multi-layered photoconductors are therefore widely used as organic photoconductors.

In recent years, products must be manufactured while considering influence thereof on the global environment. Therefore, photoconductors for use in electrophotographic image forming apparatuses must be one of mechanical parts instead of a supply (i.e., a disposable product). In other words, photoconductors must have a long life through all the processes from manufacture of raw materials, transportation of products and treatment of wasted products. Therefore, recent photoconductors must be avoided from abrasion and scratching from the viewpoints of designing and usability of the photoconductors. In addition, photoconductor contact-carrying members around photoconductors must be avoided from damaging. Thus, image-forming engines can be avoided from degradation with time, and the exchange frequency of parts and replacement purchases of the apparatuses are reduced, which contributes to source saving, air pollution control and reduction of environmental burdens.

Some toners for use in electrophotographic apparatuses often invite a filming phenomenon on the surface of the photoconductor. Images outputted while constitutional materials of toners form such a film on the surface of the photoconductor often become deformed images with unclear outlines. The filming phenomenon must be avoided in order to use photoconductors over a long time. In some electrophotographic processes using spherical toners, the function of cleaning residual toners is derived from the lubricating property of a surface of the photoconductor. In these cases, photoconductors must have coefficients of surface friction at specific levels.

To improve abrasion resistance of organic photoconductors, for example, Japanese Patent Application Laid-Open (JP-A) No. 11-288113 discloses a technique of copolymerizing a charge transporting material in a thermoplastic resin such as a polycarbonate.

This technique can reduce the content of a low-molecular compound to be incorporated in a surface top layer. Most of such low-molecular compounds to be used in surface top layers of photoconductors serve as antiplasticizers. Reducing the content of the low-molecular compounds enables the resin to exhibit inherent flexibility thereof The resulting resin has an increased resistance against mechanical stress and can exhibit high charge transport ability. The photoconductor can thereby stably exhibit satisfactory electrostatic performance.

The photoconductor prepared according to this technique, however, has a high production cost due to copolymerization of materials and is not practical.

Alternatively, JP-A No. 2002-229227, for example, discloses a technique of separating the functions of a charge transport layer as multiple layers and incorporating a highly hard filler into an upper (surface) charge transport layer.

This technique can impart mechanical durability and resistance against electrical stress to organic photoconductors at relatively low costs.

Some of the resulting photoconductors prepared according to this technique, however, work insufficiently in a cleaning process in electrophotographic processes. In addition, when the highly hard filler is contained in a high content or the charge transport layer to which the highly hard filler is incorporated is thickened, the photoconductors have deteriorated sensitivities. Thus, electrophotographic apparatuses may not be designed flexibly.

In contrast to such organic photoconductors, amorphous silicon photoconductors classified as inorganic photoconductors show very satisfactory mechanical strength.

The amorphous silicon photoconductors, however, have a low dielectric constant and thereby have low charge ability. In addition, they often require the use of drum heaters for suppressing image blur, thus increase power consumption of electrophotographic apparatuses and require relatively high production cost. Thus, electrophotographic apparatuses using the amorphous silicon photoconductors are generally of high cost and are commercially available in only limited applications. Most of accumulated techniques for prolonging lives of photoconductors under consideration for reduction of environmental burdens are individually useful. These conventional techniques, however, have considerable defects and are insufficient as measures for environmental issues which increasingly receive attention.

SUMMARY OF THE INVENTION

Accordingly, an object of the present invention is to provide a photoconductor exhibiting high abrasion resistance so as to reduce the exchange frequency of the photoconductor in an electrophotographic apparatus. Such a photoconductor contributes to energy saving in the electrophotographic apparatus, as well as to source saving, energy saving and reduction of environmental pollution in the life cycle of the photoconductor. Another object of the present invention is to provide a photoconductor having satisfactory releasability to thereby provide a long-life image-forming engine with less damages on photoconductor contact-carrying members around the photoconductor. Yet another object of the present invention is to provide a photoconductor that can be prepared at low cost, has low initial cost, can be distributed widely into the market and has a low print cost per one print.

If photoconductors have increased production cost, and/or electrophotographic apparatuses further require a drum heater and other means which have been inherently unnecessary and thereby have increased print cost or have increased power consumption in order to achieve the above objects, such photoconductors and electrophotographic apparatuses cannot gain market acceptance. These techniques bearing inherent defects cannot contribute to reduction of environmental burdens. This is because the total environmental burdens cannot be reduced unless products exhibiting high environmental performance are widely used.

According to the present invention, an electrophotographic apparatus must be simplified and the production cost of a photoconductor and the print cost must be reduced.

To achieve the above objects, initially, the stress resistance of a photoconductor in an electrophotographic apparatus should be improved. The photoconductor, however, used in the electrophotographic apparatus cannot have a prolonged life by merely improving the stress resistance. Such a photoconductor exhibiting low abrasion may often invite image lag and local image blur due to cleaning failure or invite image blur over an entire face of image-formable region due to filming of toner component onto the surface of the photoconductor. In conventional techniques, such image defects (abnormal images) are prevented by shaving off the surface of the photoconductor. The image defects, however, must be reduced concurrently with the improvement in stress resistance.

The present inventors have found that the requirements are met and the objects are achieved by an organic photoconductor including an electroconductive substrate, a photoconductive layer being arranged over the electroconductive substrate directly or with the interposition of an undercoat layer and containing a charge generation layer and a charge transport layer, and a surface top layer being arranged over the photoconductive layer, in which the surface top layer has a light transmittance of 95% or more at wavenumbers of 3200 to 3800 $cm^{-1}$, and the surface top layer shows substantially no endothermic peak in a differential scanning calorimetry curve determined by using a differential scanning calorimeter. In other words, this surface top layer is substantially free from hydroxyl groups and residual uncured portions.

Specifically, the present invention provides the preferred aspects as follows.

In a 1st aspect of the present invention, an electrophotographic photoconductor including an electroconductive substrate, a photoconductive layer being arranged over the electroconductive substrate directly or with the interposition of an undercoat layer, the photoconductive layer including a charge generation layer containing at least one charge generating materials, and a charge transport layer containing at least one first charge transporting material, and a surface top layer being arranged over the photoconductive layer and including at least one crosslinkable binder resin, in which the surface top layer has a light transmittance of 95% or more at wavenumbers of 3200 to 3800 $cm^{-1}$, and the surface top layer shows substantially no endothermic peak in a differential scanning calorimetry curve determined by using a differential scanning calorimeter.

According to a 2nd aspect, in the electrophotographic photoconductor of the 1st aspect, the surface top layer may be substantially free from hydroxyl groups and residual uncured portions.

In a 3rd aspect, the electrophotographic photoconductor of the 1st or 2nd aspect may show a variation in potential of an exposed portion with time interval between exposure and development of 0.7 V/msec or less.

In a 4th aspect, the electrophotographic photoconductor of any of the 1st to 3rd aspects preferably has a surface free energy of 30 mN/m or less.

In a 5th aspect, the electrophotographic photoconductor of any of the 1st to 4th aspects may show a variation in surface free energy of less than 2 mN/m from the initial photoconductor to the photoconductor after printing $20\times10^4$ copies.

According to a 6th aspect, in the electrophotographic photoconductor of any of the 1st to 5th aspects, the crosslinkable binder resin is preferably a crosslinked product of at least one second charge transporting material, a thermosetting resin monomer and a thermosetting surfactant.

According to a 7th aspect, in the electrophotographic photoconductor of the 6th aspect, the difference in ionization potential between the at least one first charge transporting material in the charge transport layer and the at least one second charge transporting material in the surface top layer is preferably 0.1 eV or less.

According to an 8th aspect, in the electrophotographic photoconductor of the 6th aspect, the second charge transporting material comprises:

a charge transporting material used in the charge transport layer as the at least one first charge transporting material; and a charge transporting material different from the at least one first charge transporting material, wherein the content "a" of the charge transporting material used in the charge transport layer as the at least one first charge transporting material in the surface top layer, and the content "b" of the charge transporting material different from the at least one first charge transporting material in the surface top layer satisfy either of the following conditions:

$$a/(a+b)<0.01 \text{ or}$$

$$a/(a+b)>0.99.$$

According to a 9th aspect, in the electrophotographic photoconductor of any of the 6th to 8th aspects, the at least one second charge transporting material in the surface top layer may include a charge transporting material represented by following Formula (1):

Formula (1)

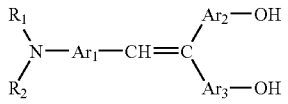

wherein $R_1$ and $R_2$ may be the same as or different from each other and are each a substituted or unsubstituted aryl group; and $Ar_1$, $Ar_2$ and $Ar_3$ are each an arylene group and may be the same as or different from one another.

According to a 10th aspect, in the electrophotographic photoconductor of any of the 6th to 8th aspects, the at least one second charge transporting material in the surface top layer may include a charge transporting material represented by following Formula (2):

Formula (2)

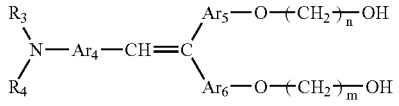

wherein $R_3$ and $R_4$ may be the same as or different from each other and are each a substituted or unsubstituted aryl group; $Ar_4$, $Ar_5$ and $Ar_6$ are each an arylene group and may be the same as or different from one another; and m and n are each a number of repetitions from 1 to 10.

According to an 11th aspect, in the electrophotographic photoconductor of any of the 6th to 10th aspects, the content of the at least one second charge transporting material in the surface top layer is preferably 7.5 percent by weight or more.

According to a 12th aspect, in the electrophotographic photoconductor of any of the 6th to 11th aspects, the at least one first charge transporting material contained in the charge transport layer includes a polymeric charge transporting material having a weight-average molecular weight of 10000 or more and 200000 or less.

According to a 13th aspect, in the electrophotographic photoconductor of any of the 6th to 12th aspects, the charge transport layer may have a charge mobility of $1.0\times10^{-4}$ $cm^2/Vsec$ or more at a field strength of 160 kV/cm.

According to a 14th aspect, in the electrophotographic photoconductor of the 13th aspect, the charge transport layer may include a solid solution between a charge transporting material having an α-phenylstilbene skeleton and a polymeric charge transporting material or a polystyrene resin.

According to a 15th aspect, in the electrophotographic photoconductor of any of the 6th to 14th aspects, taber abrasion losses of the surface top layer as a resin film may satisfy the following conditions:

$$H-G<2 \text{ mg and } F<0.5 \text{ mg and } H<3.0 \text{ mg}$$

wherein F represents an abrasion loss (mg per 1000 revolutions) with a CS-5 wear ring; G represents an abrasion loss (mg per 1000 revolutions) with a CS-10 wear ring; and H represents an abrasion loss (mg per 1000 revolutions) with a CS-17 wear ring in the Taber abrasion test.

According to a 16th aspect, in the electrophotographic photoconductor of any of the 1st to 15th aspects, surface roughnesses of the surface top layer as a resin film in a Taber abrasion test may satisfy the following conditions:

$$K-J<0.10 \text{ μm and } K<0.25 \text{ μm}$$

wherein J represents an average surface roughness (μm) with a CS-10 wear ring; and K represents an average surface roughness (μm) with a CS-17 wear ring in the Taber abrasion test.

According to a 17th aspect, in the electrophotographic photoconductor of any of the 1st to 16th aspects, the crosslinkable binder resin in the surface top layer may contain at least one amino resin.

According to an 18th aspect, in the electrophotographic photoconductor of the 17th aspect, the at least one amino resin can be at least one thermosetting amino resin having a flexible unit.

According to a 19th aspect, in the electrophotographic photoconductor of any of the 6th to 18th aspects, the thermosetting surfactant contained in the crosslinkable binder resin of the surface top layer can be a copolymer including at least a fluorocarbon resin component and a reactive hydroxyl group.

According to a 20th aspect, in the electrophotographic photoconductor of the 19th aspect, the thermosetting surfactant may include a block copolymer.

According to a 21st aspect, in the electrophotographic photoconductor of the 19th aspect, the thermosetting surfactant may contain a fluorocarbon resin/siloxane graft polymer.

A 22nd aspect of the present invention resides in a method for preparing an electrophotographic photoconductor, including the steps of forming a photoconductor layer over an electroconductive substrate directly or with the interposition of an undercoat layer, the photoconductive layer including a charge generation layer containing at least one charge generating materials, and a charge transport layer containing at least one first charge transporting material, and forming a surface top layer from a material over the photoconductive layer with the use of an acidic substance, the material for the surface top layer including a crosslinkable binder resin, in which the surface top layer has a light transmittance of 95% or more at wavenumbers of 3200 to 3800 $cm^{-1}$, and the surface top layer shows substantially no endothermic peak in a differential scanning calorimetry curve determined by using a differential scanning calorimeter.

A 23rd aspect of the present invention resides in a method for preparing an electrophotographic photoconductor, including the steps of forming a photoconductor layer over an electroconductive substrate directly or with the interposition of an undercoat layer, the photoconductive layer including a charge generation layer containing at least one charge generating materials, and a charge transport layer containing at least one first charge transporting material, and forming a surface top layer from a material over the photoconductive layer with the use of a leveling agent, the material for the surface top layer including a crosslinkable binder resin, in which the surface top layer has a light transmittance of 95% or more at wavenumbers of 3200 to 3800 $cm^{-1}$, and the surface top layer shows substantially no endothermic peak in a differential scanning calorimetry curve determined by using a differential scanning calorimeter.

A 24th aspect of the present invention resides in a method for preparing an electrophotographic photoconductor, including the steps of forming a photoconductor layer over an electroconductive substrate directly or with the interposition of an undercoat layer, the photoconductive layer including a charge generation layer containing at least one charge generating materials, and a charge transport layer containing at least one first charge transporting material, and forming a surface top layer from a material over the photoconductive layer by ring coating, the material for the surface top layer including a crosslinkable binder resin, the surface top layer has a light transmittance of 95% or more at wavenumbers of 3200 to 3800 $cm^{-1}$, and the surface top layer shows substantially no endothermic peak in a differential scanning calorimetry curve determined by using a differential scanning calorimeter.

A 25th aspect of the present invention resides in an electrophotographic apparatus including a electrophotographic photoconductor, a charge unit configured to charge the electrophotographic photoconductor, a light irradiation unit configured to irradiateirradiating image radiation to the electrophotographic photoconductor charged by the charger to thereby form a latent electrostatic image, a developing unit configured to supply a developing agent to the latent electrostatic image to thereby form a visible toner image, and a transfer unit configured to transfer the toner image formed by the developer to an image-transfer member, wherein the electrophotographic photoconductor is the one of any of the 1st to 21st aspects.

A 26th aspect of the present invention resides in a process cartridge being attachable to and detachable from a main body of an electrophotographic apparatus and integrally supporting a electrophotographic photoconductor, and at least one member selected from the group consisting of a charge unit configured to charge the electrophotographic photoconductor, a developing unit configured to supply a developing agent to a latent electrostatic image formed on the electrophotographic photoconductor to thereby form a visible toner image, and a cleaning unit configured to remove a toner remained on the electrophotographic photoconductor after image transfer, wherein the electrophotographic photoconductor is the one of any of the 1st to 21st aspects.

The electrophotographic photoconductor according to the aspects of the present invention exhibits satisfactory photosensitivity properties to form latent electrostatic images, is substantially free from abrasion loss even in printing in a large quantity and has high mechanical strength being substantially free from scratching on the surface of the photoconductor in actual use. This reduces the number of replacements of the photoconductor in the electrophotographic apparatus which is affected by the life of the photoconductor.

The electrophotographic photoconductor according to the aspects of the present invention can avoid image blur, which tends to occur in photoconductors having high abrasion resistance, and does not need to use a drum heater. The resulting photoconductor shows low printing cost.

In addition, unnecessary substances (foreign matters) is prevented from remaining on the surface of the photoconductor by allowing the photoconductor to have a reduced surface free energy. As a result, the damage on the photoconductor contact-carrying members such as cleaning blades can be reduced, to thereby prolong the life of the image-forming engine.

Accordingly, the electrophotographic photoconductor of the aspects of the present invention keeps its good photosensitivity properties, has high mechanical strength, is substantially free from image defects and exhibits good releasability from unnecessary foreign matters. Thus, the photoconductor contributes to the reduction of burdens on the global environment and is practically very useful.

Further objects, features and advantages of the present invention will become apparent from the following description of the preferred embodiments with reference to the attached drawings.

DESCRIPTION OF THE PREFERRED EMBODIMENTS

Figure 1:
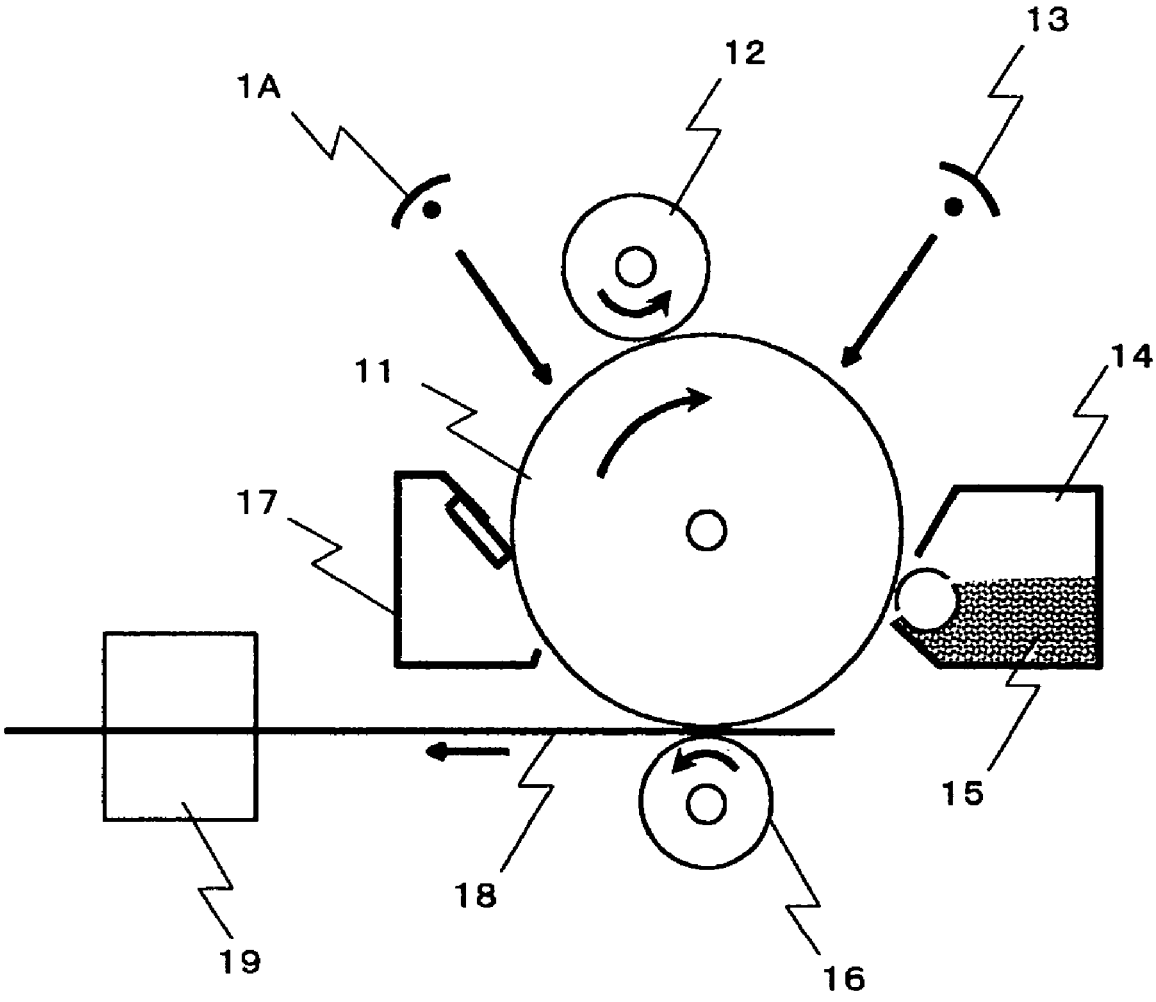
FIG. 1 is a schematic cross-sectional view illustrating an example of an electrophotographic apparatus according to the present invention.

Initially, the outline of the present invention will be illustrated below.

1. Means for Improving Stress Resistance of Photoconductor 1.1. Means for Improving the Abrasion Resistance The abrasion of a photoconductor in electrophotographic processes is supposed to be caused or accelerated mainly in the following processes.

(1) Abrasion in Cleaning Process

In electrophotographic processes, a toner remained on a surface of a photoconductor is generally removed by using a cleaning blush or a cleaning blade. When a cleaning blade, for example, is used, the residual toner is removed from the surface of the photoconductor by physically pressing the tip of the cleaning blade to the rotated surface of the photoconductor at a set pressure. The surface of the photoconductor is abraded or scratched by the action of sliding abrasion with the blade. This abrasion is supposed to be mainly caused by mechanical abrasion.

(2) Action of Charging Process

As is described in JP-A No. 10-10767, discharge/dielectric breakdown may occur in subtle defects in a photoconductor in a charging process. The dielectric breakdown significantly occurs when the photoconductor is an organic photoconductor having a low withstand voltage. The discharge also causes the surface of the photoconductor to be deteriorated to thereby cause deterioration in abrasion resistance. This increases the abrasion of the surface top layer upon repetitive use and thereby shortens the life of the photoconductor. The magnitude of discharge increases with a decreasing thickness of a surface top layer, and scratched portions formed during repetitive use become susceptible to deterioration in chargeability (degeneration), and the resulting surface top layer has increased (large-sized) concave portions and convex portions. These may result in accelerated adhesive wear (fatigue wear).

(3) Abrasion in Development Process

In two-component development, an electrophotographic photoconductor undergoes surface polishing by a carrier and undergoes abrasive wear. Most of additives such as superplasticizing agents contained in toners comprise hard materials such as silica. These hard additives are supposed to serve as abrading agents with respect to photoconductors. Fine particles of such additives may probably continuously abrade photoconductors during a development process. This can be compared to continuous abrasion or polishing of photoconductors by a file or scouring powder. This phenomenon becomes significant in electrophotographic apparatuses using a toner containing large amounts of hard additives such as silica or a toner that often stays in a cleaning means. Toners for use in two-component development and one-component development once adhere to a surface of a photoconductor and dissociate itself from the surface of the photoconductor, and this process is repeated. The load of work of adhesion between the toner and the photoconductor is not trivial and the surface of the photoconductor undergoes adhesive wear when the toner dissociates itself from the surface of the photoconductor.

To improve the abrasion resistance of an electrophotographic photoconductor, countermeasures to at least all the abrasion factors (1), (2) and (3) must be taken. The present inventors have specifically found that arrangement of a crosslinkable resin onto a surface of a photoconductor is effective to improve the durability of a photoconductor against these abrasion factors. The mechanism of this has not yet been clarified, but the present inventors consider as follows.

It is considered that the surface of the photoconductor is abraded by the action of abrasive wear and adhesive wear. In an electrophotographic apparatus, the photoconductor is further subjected to a charging process, and electrical stress occurs in the charging process and further accelerates the abrasion caused by these mechanical stresses.

The present inventors have observed weight-average molecular weights of abrasion powders of thermoplastic resins (linear polymeric materials) such as polycarbonates generally used as materials for surface top layers of organic photoconductors. They have found that the abrasion powders caused by abrasive wear have weight-average molecular weights reduced to one half of those immediately after film formation, and that the abrasion powders caused by adhesive wear have weight-average molecular weights reduced to about one-third of those immediately after film formation. This leads to an assumption that abrasion occurs when a polymer constituting the surface top layer is broken even at one position. The present inventors have contrived that the abrasion can be prevented by using a crosslinkable resin that forms network chemical bonds. Specifically, such a network structure serves to avoid formation of abrasion powders even when part of bonds of the polymer chain cleaves. The present inventors have actually verified that the use of a crosslinkable resin achieves a higher abrasion resistance.

The durability against stress, however, is not improved by merely arranging a crosslinkable resin on the surface of the photoconductor. To improve the durability, it is important to avoid curing failure.

The present inventors have found that a material for the crosslinked resin should have no endothermic peak up to the decomposition temperature thereof in a DSC curve determined with a differential scanning calorimeter (DSC) in order to avoid curing failure.

Figure 11:
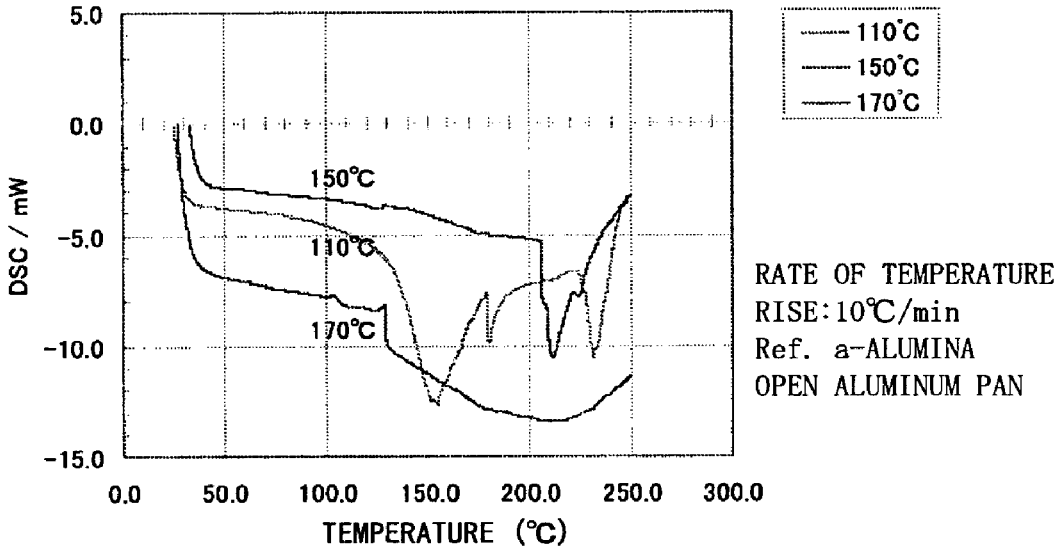
FIG. 11 illustrates DSC curves of melamine resin cured films having different curing temperatures.

When a melamine resin coating material is heated and cured at different curing temperatures to yield coatings, the resulting coatings show different DSC curves. An example thereof is shown in FIG. 11. FIG. 11 shows that the coatings prepared under different curing conditions have different DSC curves, in which some show an endothermic peak and others show no endothermic peak, despite that they are made from the same material. A coating cured at a low temperature shows a broad endothermic peak in differential scanning calorimetry. This is because of evaporation of a residual solvent. Most of such cured films containing a residual solvent exhibit poor abrasion resistance. A coating containing uncrosslinked portions (uncured portions) exhibits insufficient mechanical strength even if it has been heated at a temperature sufficiently higher than the boiling point of a solvent. The presence or absence of uncured or uncrosslinked portions can be supposed from an endothermic peak in a DSC curve. The curing reaction of a thermosetting resin is generally a condensation reaction and is primarily an exothermic reaction. In actual, however, the state of curing is more easily determined by the presence or absence of an endothermic peak than that of an exothermic peak, since heat of vaporization typically of reaction water formed in the condensation reaction adds to the endothermic peak.

Figure 12:
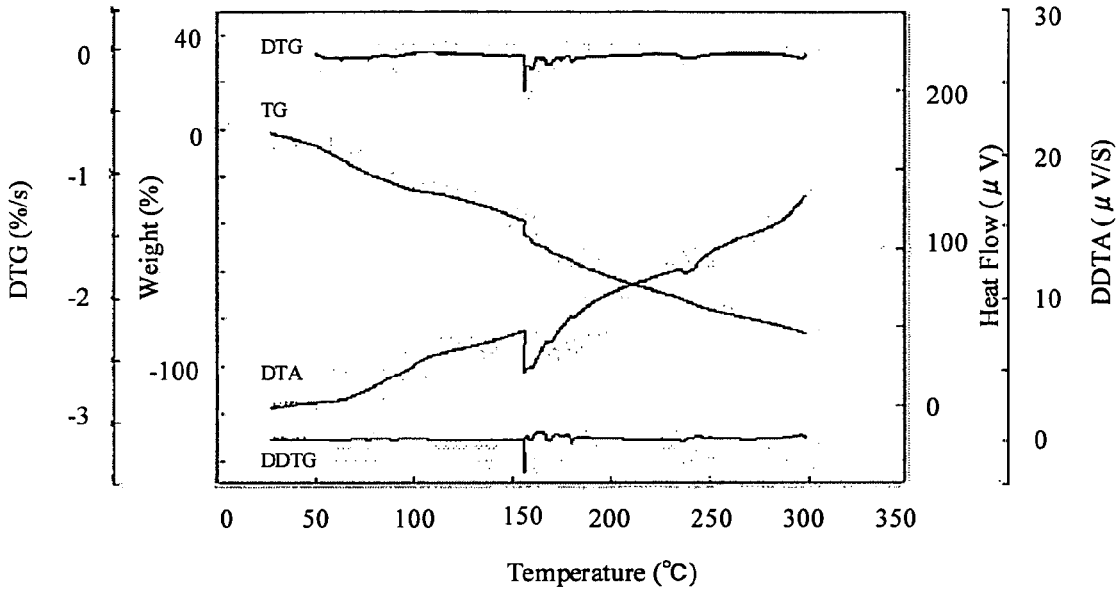
FIG. 12 illustrates DTA curves of a melamine resin coating material.

An appropriate curing temperature can be roughly determined based on a differential thermal analysis (DTA) curve obtained with the use of a thermobalance. In DTA curves of cured resin coating materials, weight loss caused by vaporization of a solvent, weight loss caused by a condensation reaction and weight gain caused by an oxidation reaction are synthetically observed. FIG. 12 illustrates an example of DTA curves of a melamine resin coating material. In this case, a large weight loss is observed at around 170° C. Accordingly, a resin film was cured under this temperature condition, and the DSC curve thereof was determined by the above-mentioned method. As a result, the cured resin film showed no endothermic peak and exhibited good mechanical strength.

In the present invention, the differential scanning calorimetry is carried out in the following manner. Thermo Plus DSC 8230 available from Rigaku Corporation is used as the differential scanning calorimeter. A curve at the first scanning is monitored at a scanning rate of 10° C./min using an open aluminum pan as a sample vessel, and alpha-alumina as a referential material in the same amount as a test sample. A sample material is heated and cured under the same conditions as in the film formation of a material for a surface top layer.

The crosslinkable resin for use in the surface top layer in the present invention preferably comprises a material having a high chemical bond energy, and the resulting crosslinked resin film preferably has such a total chemical bond energy as to utilize the abrasion resistance of the material effectively.

As one of practical indicators for such chemical bond energy, the present inventors have investigated on the relationship among weight losses per 1000 revolutions in a Taber abrasion test under a load of 250 gf using CS-5, CS-10 and CS-17 wear rings. As a result, they have found that the relationship among the Taber abrasions with respect to the resin film as the surface top layer should preferably satisfy the following condition:

$$(H-G)<2 \text{ mg}, F<0.5 \text{ mg}, \text{ and } H<3.0 \text{ mg}$$

wherein F represents a CS-5 abrasion loss, G represents a CS-10 abrasion loss, and H represents a CS-17 abrasion loss in the Taber abrasion test.

The value (H−G) is interpreted as a contribution ratio of the abrasive strength of wear rings to the abrasion loss in the Taber abrasion test. When the amount of a developing agent fed to a surface of a photoconductor distributes as in the case of printing, for example, a logo mark or a little embroidered mark in a large quantity, the photoconductor often undergoes partial wear. The value (H−G) serves as an indicator for suppressing the partial wear. The CS-5 wear ring is made from a felt, in contrast to the other wear rings. The abrasion in the Taber abrasion test using the CS-5 wear ring differs from abrasive wear. Namely, F is interpreted as an abrasion loss caused by non-abrasive wear such as adhesive wear. In contrast, H and G represents abrasion losses caused by abrasive wear. The abrasion rate (speed) of a photoconductor in an electrophotographic apparatus significantly varies depending typically on process conditions of the apparatus and the type of the toner. However, a sample showing a large abrasion loss caused by mechanical stress typified in a Taber abrasion test seldom undergoes less abrasion in an electrophotographic apparatus. The present inventors have verified that H and F are indicators showing the mechanical strength of the material for the surface top layer and that a sample satisfying the above-listed conditions has a less abrasion loss in an electrophotographic apparatus.

1.2. Means for Preventing Scratching

When a photoconductor comprises a thermosetting resin on its surface and thereby has abrasion resistance equivalent to, for example, that of a metal, the photoconductor should essentially have satisfactory scratch resistance.

When the surface of the photoconductor has scratches, a discharge hazard is concentrated at the scratches to thereby deteriorate the scratched regions. In addition, toner components and/or paper dust is embedded into grooves formed by scratching, which may often cause image defects such as local toner deposition on the background of images and image blur.

Once the abrasion resistance is improved, the formed scratches cannot be significantly erased as if they are impressed. Thus, scratching becomes a factor for inhibiting the prolonged life of the photoconductor.

The present inventors have found that problems caused by scratching can be solved when the surface roughness in the Taber abrasion test satisfy the following conditions.

Specifically, the surface roughness of a resin film as the surface top layer preferably satisfies the following conditions:

$$(K-J)<0.10 \text{ μm}, \text{ and } K<0.25 \text{ μm}$$

wherein J represents a CS-10 average surface roughness, and K represents a CS-17 average surface roughness in the Taber abrasion test.

The value (K−J) is interpreted as a contribution ratio of the abrasive strength of the wear rings with respect to the scratching in the Taber abrasion test. K and J are interpreted as degrees of scratching caused by abrasive wear.

To satisfy the above-specified conditions, it is effective to use a crosslinkable resin having a network structure and exhibiting a high crosslinking density as the material for the surface top layer to thereby significantly reduce the abrasion loss in the Taber abrasion test. Alternatively or in addition, to introduce a flexible unit into the cured resin film having a network structure is also effective.

More specifically, the present inventors have found that the degree of scratching is reduced by using a bifunctional or higher curative agent having an alkylene skeleton containing two or more carbon atoms as a material for the curable resin. In addition, they have found that the scratch resistance can be markedly improved by using a compound having an alkylene skeleton containing two or more, preferably five or more carbon atoms as the curative agent. Accordingly, the scratch resistance is improved by incorporating a flexible unit having an alkylene skeleton containing preferably two or more, more preferably five or more carbon atoms. The amount of the flexible unit is preferably about 30 percent by weight or more of the curable resin.

2. Means for Suppressing Image Defects 2.1. Means for Suppressing Image Blur

Organic photoconductors each having a surface top layer using a crosslinkable resin often invite image blur caused by environmental variation due to change in temperature and humidity. This tendency is known in some photoconductors each having a protective layer containing a silicon compound. This problem, however, can be avoided by using a crosslinkable resin having a transmittance at 3200 to 3800 $cm^{-1}$ of 95% or more.

An absorption at around 3500 $cm^{-1}$ is often derived from a stretching vibration of a hydroxyl group, such as a stretching vibration (3300 $cm^{-1}$) of a hydroxyl group constituting an intermolecular hydrogen bond, a stretching vibration (3600 $cm^{-1}$) which is not involved in hydrogen bond, a stretching vibration (3500 $cm^{-1}$) of a hydroxyl group bonded to the silicon compound.

The image blur caused by the action of temperature and humidity is often derived from a decreased surface electrical resistance, which is, in turn, caused by adsorption of water by the surface of the photoconductor. Accordingly, the image blur is prevented from occurring by eliminating causes of the adsorption of water by the surface of the photoconductor.

Figure 13:
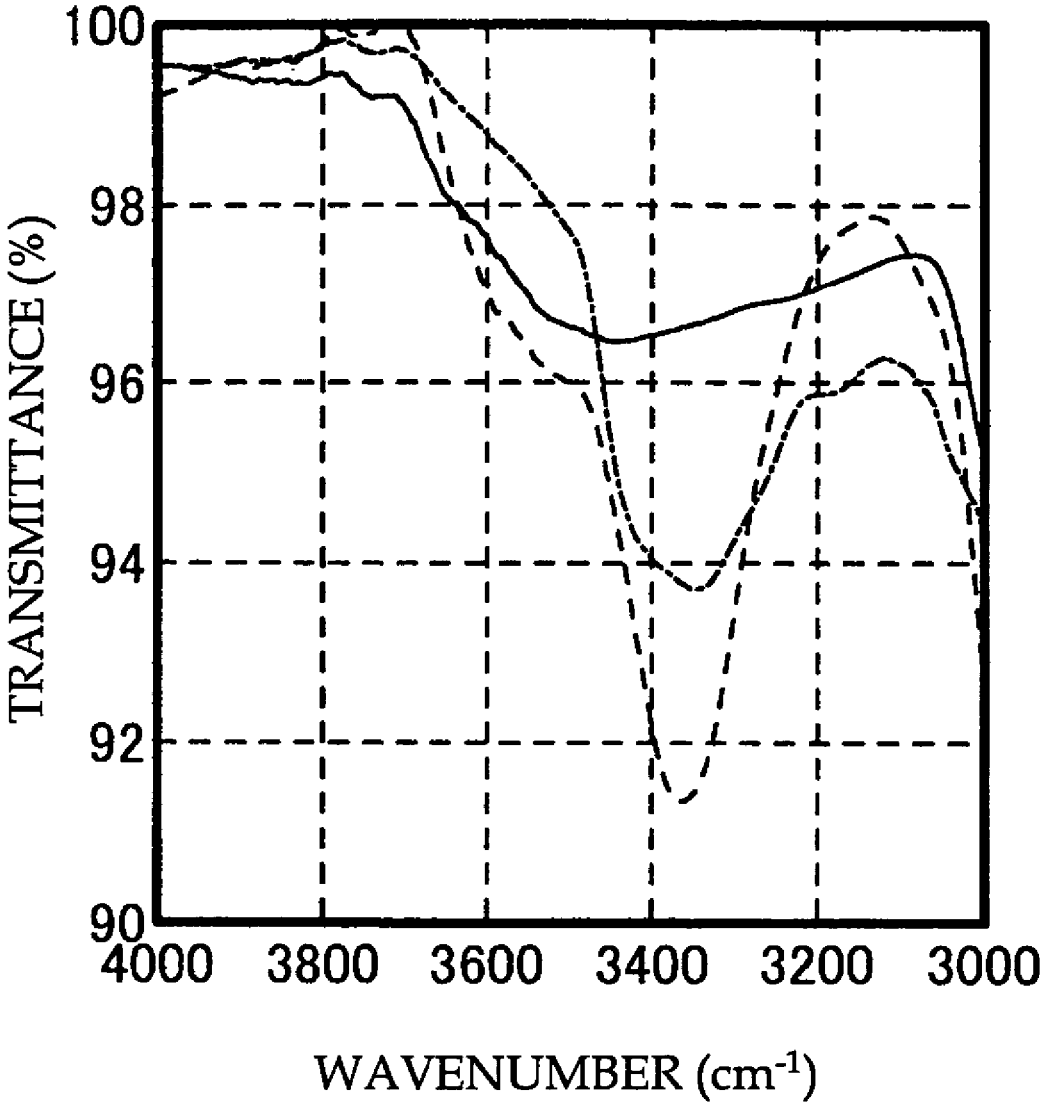
FIG. 13 illustrates infrared ray transmitting spectra of different surface top layers determined by attenuated total reflection (ATR)

Examples of measured transmittance of surface top layers are shown in FIG. 13. With reference to FIG. 13, a photoconductor having a transmittance of less than 95% shows image blur in output of copied images at high humidity. In contrast, a photoconductor having a transmittance of about 95% shows less image blur, and a photoconductor having the highest transmittance shows trivial image blur.

The present inventors have verified that the surface top layer can have a transmittance at a set level or higher effectively by using an amino resin such as a melamine resin or a mixture of resins comprising such amino resin, whereas this object can also be achieved by adjusting film-forming conditions.

The transmittance of a surface top layer in the present invention is determined by an attenuated total reflection (ATR) method using a FT-IR NEXUS 470 available from Thermo Electron Corporation equipped with a genuine accessory (OMNI-Sampler).

2.2. Means for Suppressing Image Lag

An electrophotographic photoconductor having the above-mentioned configuration may often invite image lag. The image lag is probably caused by the time response properties of photo-induced discharge of the photoconductor, since the image lag is often reduced by decreasing the printing speed.

Regular organic photoconductors exhibit an increased potential of an exposed portion to some extent when a time interval between light exposure and development (exposure-development time interval) is shortened in electrophotographic apparatuses. The relationship between the potential of an exposed portion and the exposure-development time interval (hereinafter may be briefly referred to as "time dependency") shows a slope varied at an "inflection point". The potential of an exposed portion more abruptly increases with a decreased exposure-development time interval. The present inventors have found that there is a good correspondence between the relationship (time dependency) and the image lag. More specifically, they have found that the image lag can be avoided by controlling the variation of the potential of an exposed portion of an electrophotographic photoconductor with time interval between exposure and development (time dependency in transit time in actual use) at 0.7 V/msec or less.

The above-specified condition is effectively satisfied, for example, by increasing the charge transport ability of the surface top layer and/or by reducing an electrical barrier between the charge transport layer and the surface top layer. The charge transport ability of the surface top layer, for example, can be increased by incorporating an appropriate amount of a charge transporting material or electroconductive fine particles typically of tin oxide into the surface top layer. The electrical barrier between the charge transport layer and the surface top layer can be reduced, for example, by forming a film of the surface top layer while fusing the underlying charge transport layer to some extent.

The determination of the time responsibility in photo-induced discharge of an electrophotographic photoconductor will be illustrated below.

The time responsibility in photo-induced discharge of an electrophotographic photoconductor is often estimated according to a time-of-flight (TOF) process using a resin film comprising a charge transporting material with or without a binder resin, as described in JP-A No. 10-115944 and JP-A No. 2001-312077. The TOF process is useful for designing the composition of a photoconductor, but has the following problems. In the charge transport of a photoconductor actually used in an apparatus, the field strength in the resin film varies with time. In contrast to this, in the charge transport in the TOF process, the field strength stands constant. In a multi-layered photoconductor actually used, the charge transport is affected by charge generation from a charge generation layer induced by light exposure, and by charge injection from the charge generation layer to a charge transport layer. These effects are not reflected in the measured value in the TOF process.

As a technique for directly determining the responsibility of a photoconductor, JP-A No. 2000-305289, for example, discloses a technique in which the change in surface potential of a photoconductor after pulsed light irradiation is recorded at high speed using a high-speed surface potentiometer, the response time until the surface potential reaches a set level is determined. This technique is generally referred to as a "xerographic time-of-flight (XTOF)" process. This technique is useful as a determination method for solving the problems in the TOF process. The light source used in the XTOF process is, however, often different from an exposure device used in an electrophotographic apparatus and is not always practical.

Alternatively, the relationship between the potential of an exposed portion and the light exposure of a photoconductor exposed to a LD light (photo-induced discharge curve) can be determined by using a property determination apparatus for a photoconductor described in JP-A No. 2000-275872. More specifically, the time period for an exposed portion of a photoconductor to reach a development means (developer) (hereinafter briefly referred to as "process time") is set, and the relationship between the potential of the exposed portion and the light exposure of the photoconductor exposed to a LD light (photo-induced discharge curve) is determined using the apparatus.

Figure 20:
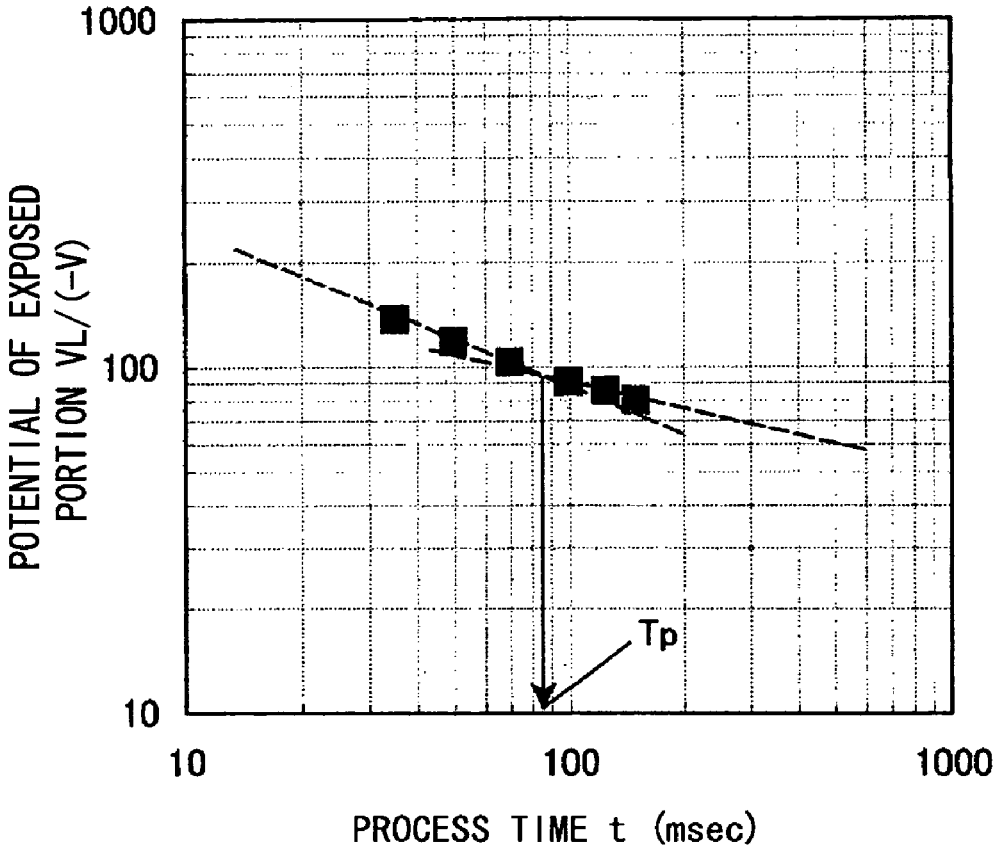
FIG. 20 illustrates a relationship between the potential of an exposed portion and the exposure-development time interval (process time)

When the change in potential of an exposed portion is measured at a varying process time using the apparatus, the resulting curve of the potential of an exposed portion plotted against the process time has an inflection point. The process time at the inflection point is hereinafter referred to as "transit time in actual use" for the sake of convenience. A specific example of the curve is shown in FIG. 20. According to this technique, the relationship between the potential of an exposed portion and the process time, namely the time responsibility in photo-induced discharge of an electrophotographic photoconductor can be grasped accurately.

After investigations on relationships between the unstableness of image density in high-speed printing and the image lag, the present inventors have gained the following findings.

(1) In majority of the cases where image lag occurs, the process time is shorter than the transit time in actual use. This tendency is significant in electrophotographic apparatuses using no charge-eliminating means.

(2) The image lag can be avoided by reducing the variation of the potential of an exposed portion with a varying process time in a range of process times shorter than the transit time in actual use.

(3) More specifically, the image lag can be avoided by reducing the variation of the potential of an exposed portion with respect to the process time in a range of process time shorter than the transit time in actual use to 0.7 V/sec or less.

A variation of the potential of an exposed portion at process times of 35 msec or less is not measured herein because of limitations of the apparatus.

(4) The variation of the potential of an exposed portion with a varying process time in a range of process times shorter than the transit time in actual use is effectively reduced by incorporating a charge transporting material into the surface top layer.

Based on the above findings, the present invention provides an electrophotographic photoconductor which is free from an uneven image density of outputted images and image lag even at shorter exposure-development time intervals (process times). In addition, the present invention provides an electrophotographic apparatus using the photoconductor.

3. Means for Reducing Damage on Photoconductor Contact-carrying Members

For prolonging the life of a photoconductor having high abrasion resistance, the surface of the photoconductor must be prevented from deposition of unnecessary substances. When a residual toner after image transfer, for example, is deposited on the surface of the photoconductor and is subjected to another process, the cleaning blade is hit by the residual toner (residual unnecessary substances) with the rotation of the photoconductor. This often deteriorates the hit portion of the cleaning blade and chips an edge thereof. The chipped portion loses its cleaning function, which causes image defects. This deterioration holds true for not only the cleaning blade but also all the members which come in contact with the photoconductor. The residual unnecessary substances herein include the residual toner after image transfer as well as paper dust, other dust and carriers.

The electrophotographic process is interpreted as a process in which a process of bringing charges, a developing agent, a discharge product and an image transfer material into adhesion to the surface of the photoconductor and then removing them therefrom is repeated at high speed. From this viewpoint, the surface of the photoconductor preferably has high releasability with respect to these deposited substances in order to reduce the damage on photoconductor contact-carrying members.

The work of adhesion between contact-carrying members surrounding a photoconductor and a toner that mainly constitutes the residual unnecessary substances is determined, for example, by calculation in the following manner. The calculated work of adhesion of a toner is 95 mN/m with respect to a conventional photoconductor, 91 mN/m with respect to copying paper, 72 to 90 mN/m with respect to a cleaning blade, and 101 mN/m with respect to the toner itself. The residual toner after image transfer is not preferably deposited on the photoconductor but is preferably easily removed from the surface of the photoconductor. By setting the work of adhesion between the toner and the surface of the photoconductor to 70 mN/m or less, the toner is prevented from remaining or depositing on the photoconductor.

Figure 9:
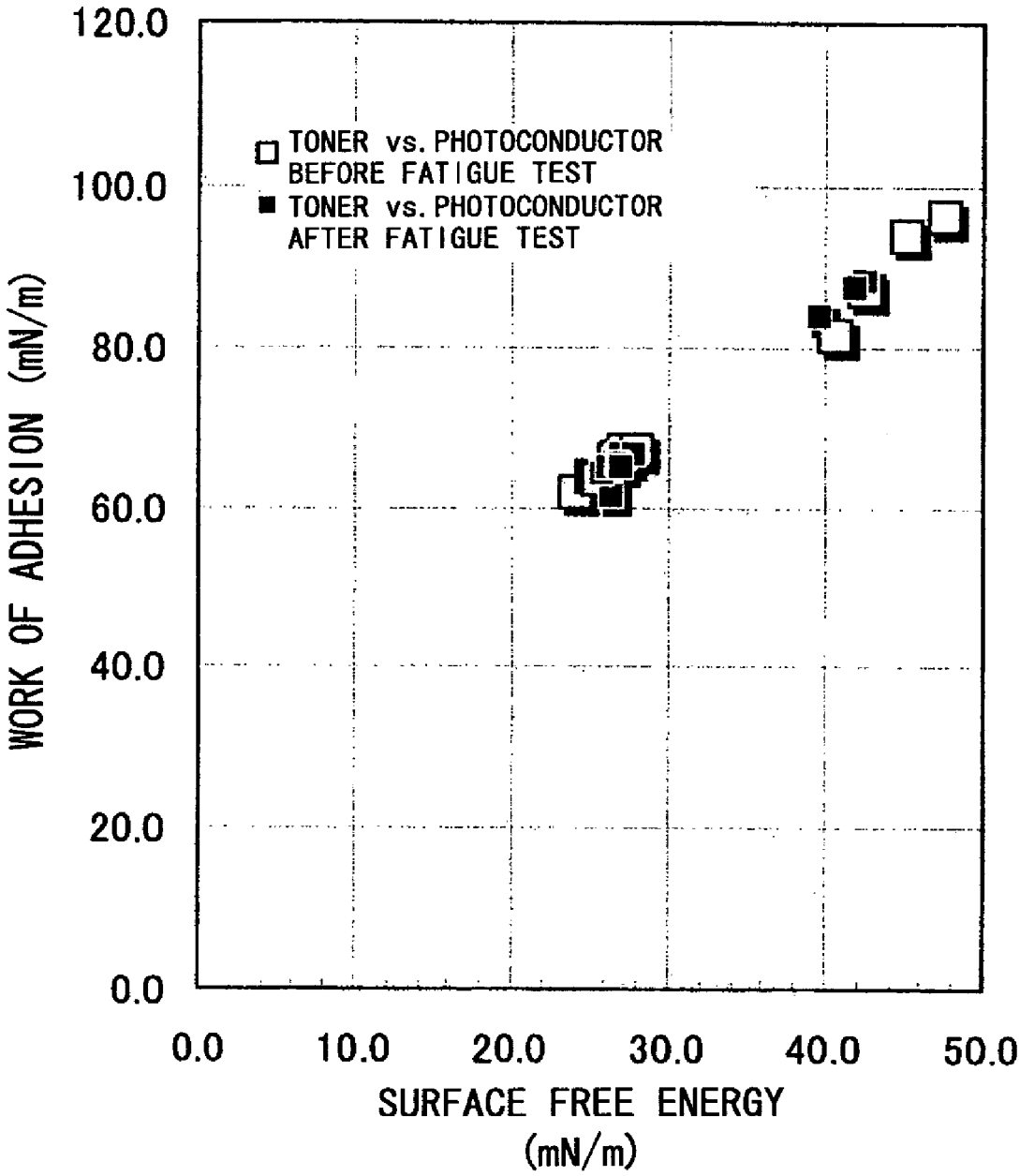
FIG. 9 is an illustrative diagram showing the relationship between the surface free energy of a photoconductor and the work of adhesion between the photoconductor and a toner.

For this purpose, the photoconductor should preferably have a low surface free energy. This is because there is a correlation between the surface free energy of a photoconductor and the work of adhesion between the toner and the photoconductor. FIG. 9 shows an example of the correlation. FIG. 9 shows a plot of the work of adhesion between an unused photoconductor (initial photoconductor) and the toner plotted against the surface free energy, and a plot of the work of adhesion between a photoconductor after fatigue (running test) and the toner plotted against the surface free energy. The photoconductor after fatigue has undergone a charging process and thereby has a deteriorated surface. The photoconductor having a deteriorated surface also has a correlation similar to the above-mentioned correlation.

Based on this, the present inventors have found that the work of adhesion between the photoconductor and the toner can be set at 70 mN/m or less by setting the surface free energy of the photoconductor at 30 mN/m or less.

The resulting photoconductor having this configuration shows a work of adhesion lower than that of the cleaning blade. The present inventors have been verified that the residual toner after image transfer can be significantly prevented from remaining on the surface of the photoconductor by this configuration.

Figure 10:
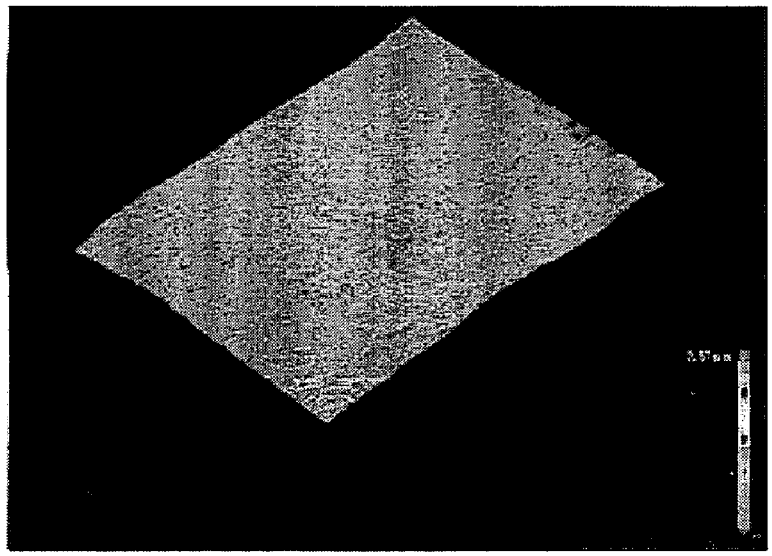
FIG. 10 is a three-dimensional image of an example of a surface of a photoconductor after printing $20\times10^4$ sheets.

To verify this, a three-dimensional image of the surface of the photoconductor after printing $20\times10^4$ copies is shown in FIG. 10. The surface of the photoconductor shows no deposition thereon and keeps its smooth shape as good as new. The cleaning blade used for the printing of $20\times10^4$ copies shows no damage. Based on these findings and tests results, the photoconductor for use in the present invention essentially preferably has a surface free energy of 30 mN/m or less. The variation in surface free energy from the initial photoconductor to the photoconductor after printing $20\times10^4$ copies is preferably 2 mN/m or less for satisfactory releasability of the photoconductor.

To allow the surface of the photoconductor to have a lower surface free energy, it is effective to incorporate a surfactant containing a reactive hydroxyl group and a fluorocarbon resin component into the crosslinkable binder resin. Examples of the surfactant are (1) copolymers containing (meth)acrylate having a fluoroalkyl group, such as block copolymers derived from a vinyl monomer containing no fluorine and a vinyl monomer containing fluorine described in JP-A No. 60-221410 and JP-A No. 60-228588; (2) fluorine-containing graft polymers, such as a comb graft polymer prepared by copolymerizing a methacrylate macromonomer having a poly(methyl methacrylate) in a side chain with a (meth)acrylate having a fluoroalkyl group, described in JP-A No. 60-187921; and (3) a compound comprising a fluorocarbon resin chemically bonded with a silicone component described in JP-A No. 2000-119354.

The surface free energy and the work of adhesion in the present invention are determined by calculation according to the Extended Fowkes Equation described by Yasuaki Kitazaki and Toshio Hata in Journal of The Adhesive Society of Japan, 8(3), 131-141 (1972).

4. Sensitivity of Photoconductor 4.1. Selection of Charge Transporting Material of Surface Top Layer The mechanism of forming a latent electrostatic image in an electrophotographic apparatus will be illustrated below by taking the multi-layered organic photoconductor as an example. After electrifying the photoconductor, imaging light is irradiated thereto. The charge generating material which has absorbed the light generates a charge carrier, and the charge carrier is injected into the charge transport layer. The charge carrier moves in the charge transport layer along with an electric field formed as a result of charging and reaches the surface of the photoconductor. The charge carrier is then neutralized by the charge to form a latent electrostatic image.

If a surface top layer arranged on the photoconductive layer comprising a charge generation layer and a charge transport layer serves as an electrically inactive blocking layer, the latent electrostatic image cannot be formed.

To effectively avoid this and to form a latent electrostatic image, the surface top layer should preferably have charge transport ability. It is specifically effective to incorporate a unit having charge transport ability into a crosslinkable resin to be arranged on the surface of the photoconductor. The unit having charge transport ability to be contained in the surface top layer must match the charge transporting material contained in the underlying charge transport layer. This is because these two components often comprise different materials. If they do not match each other satisfactorily, a desired charge transport ability is not obtained, and at worst, the latent electrostatic image cannot be formed even when the unit having charge transport ability is incorporated into the crosslinkable resin in the surface top layer.

To avoid this problem, when the surface top layer contains a charge transporting material different from the charge transporting material in the charge transport layer, (1) the difference in ionization potential (Ip) between these different charge transporting materials is preferably 0.1 eV or less. (2) In addition, if the former charge transporting material is a mixture of two or more charge transporting materials and one of them serves as a trapping site that is not involved in charge transport, the content of the one charge transporting material in question should be preferably set at less than 1 percent by weight.

This phenomenon has not yet been clarified sufficiently, but the present inventors consider as follows.

Figure 14:
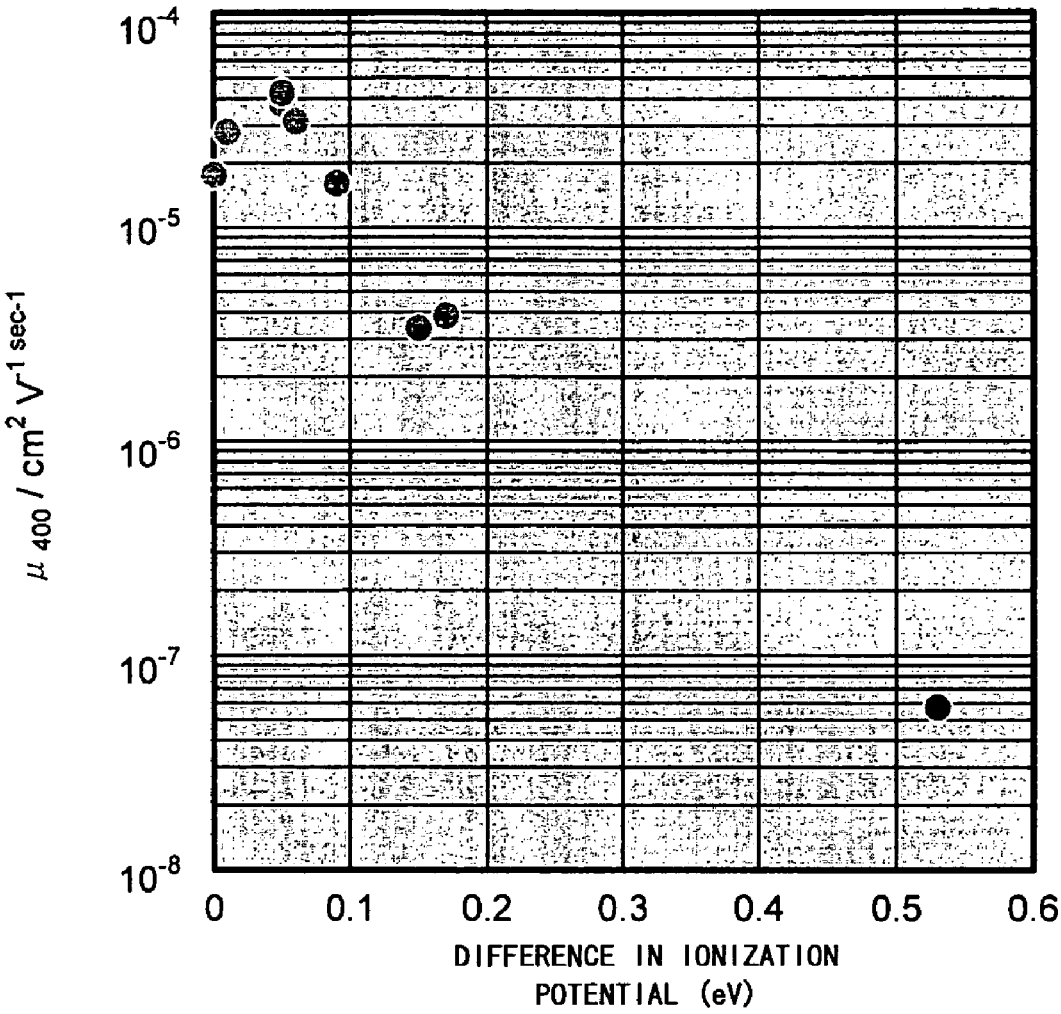
FIG. 14 illustrates a relationship between the difference in ionization potential and the charge mobility of charge transporting materials.

FIG. 14 exemplifies a charge mobility plotted against a difference in ionization potential between two charge transporting materials contained in an organic charge-transportable resin film. In the figure, the charge mobility is defined as the value at which the square root of the field strength stands at 400 $V^{1/2}$ $cm^{-1/2}$ (indicated by $\mu_{400}$).

The charge-transportable resin film herein comprises 50 percent by weight of a first charge transporting material (hereinafter briefly referred to as "CTM1") and 20 percent by weight of any of charge transporting materials having different ionization potentials (hereinafter briefly referred to as "CTM2"). If CTM2 is identical to CTM1, the content of the charge transporting materials in the resin film increases by the addition of CTM2, and thus the charge mobility increases.

FIG. 14 indicates that the charge mobility does not increase in a simple manner as a result of addition of CTM2, that the charge mobility significantly decreases in the case where the difference in ionization potential between CTM1 and CTM2 is large, and that the charge mobility does not decrease as a result of addition of CTM2 when the difference in ionization potential is less than 0.1 eV.

When the charge mobility increases by the addition of CTM2, the added charge transporting material CTM2 probably serves as a hopping site for the charge carrier.

Figure 15:
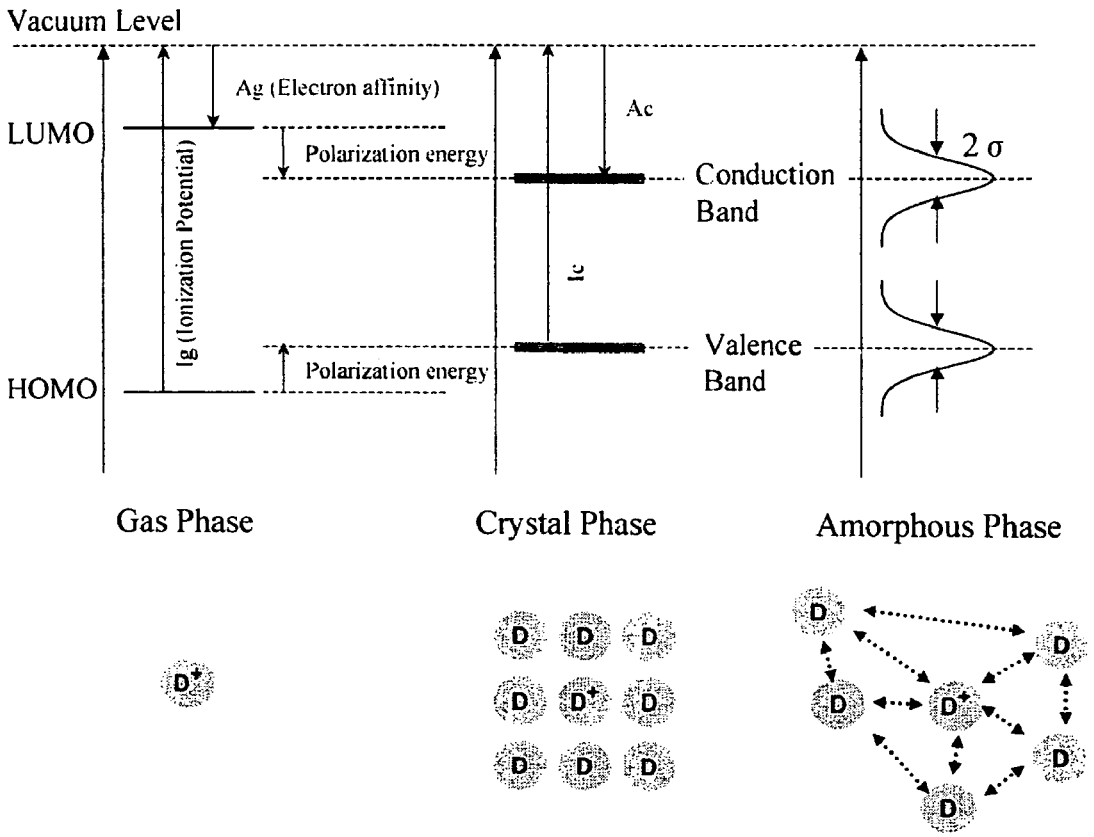
FIG. 15 is a supposed diagram of energy levels of charge transporting materials.
Figure 16:
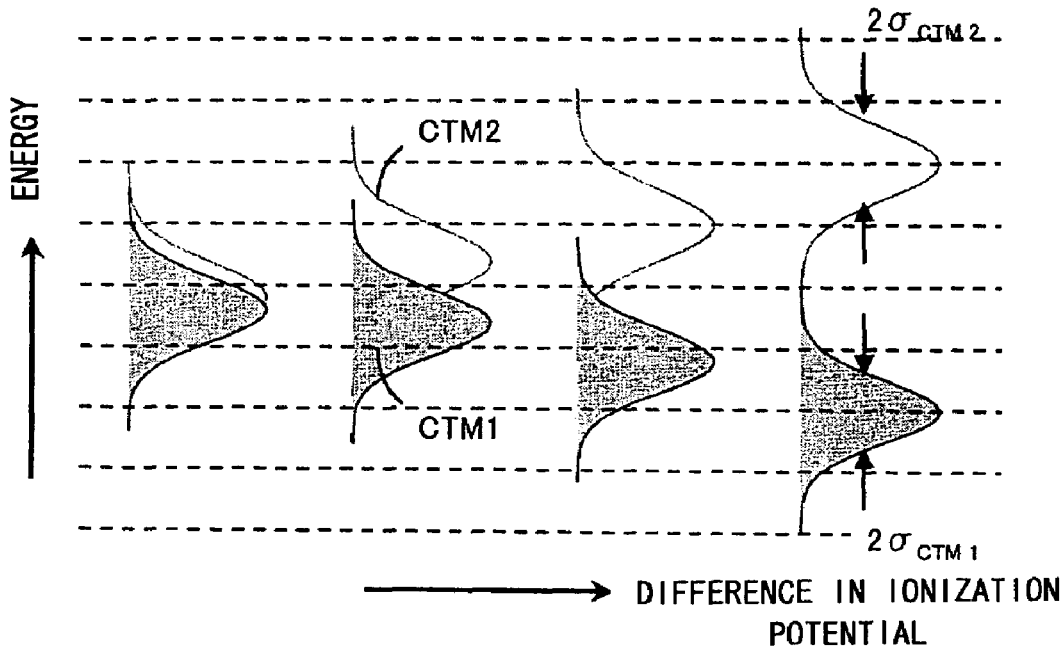
FIG. 16 illustrates a relationship between the hopping site energy distribution and the difference in ionization potential of individual charge transporting materials each having an energy distribution.

It is generally considered that a charge-transportable resin film comprising one or more organic materials is in amorphous state and the energy levels of the conduction band and the valence band do not have a band structure but each have a density of state distribution as shown in "Amorphous Phase" in FIG. 15. The energy disorder ($\sigma$) determined according to disorder formalism based on the temperature-related properties of the charge mobility of a charge-transportable resin film is generally about 0.1 eV when the charge-transportable resin film contains about 50 percent by weight of a charge transporting material (Paul M. Borsenberger, David S. Weiss, Organic Photoreceptors for Xerography, pp. 290-324 & pp. 491-503, MARCELDEKKER, 1998). If the difference in ionization potential is small, individual hopping site energy levels overlap one another. Thus, the density of states of an energy level that serves as an effective hopping site may increase to thereby increase the charge mobility (FIG. 16).

In contrast, when the difference in ionization potential is more than 0.1 eV, the charge mobility of the charge-transportable resin film decreases as a result of addition of CTM2. In particular, the charge mobility of the charge-transportable resin film containing charge transporting materials with a difference in ionization potential exceeding 0.5 eV is significantly lower than that of a charge-transportable resin film containing no CTM2.

Assumed patterns of charge transport in organic charge-transportable resin films each comprising a mixture of different charge transporting materials are shown in FIGS. 17A, 17B, 17C, 17D, 17E, 17F, 17G, 17H and 17I. In these figures, the cases where two different charge transporting materials are contained in the resin film are taken as an example.

Figure 17A:
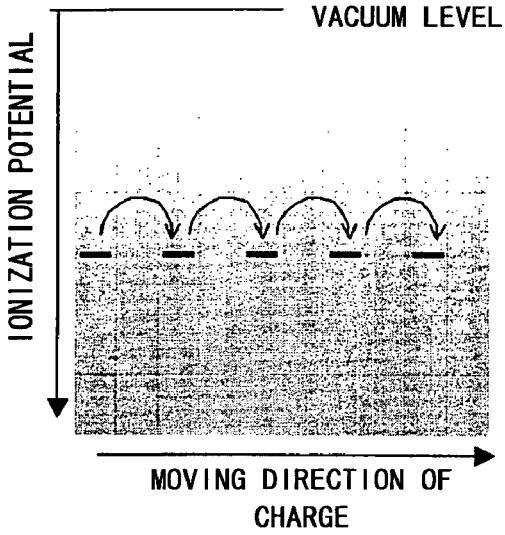
FIG. 17A illustrates a pattern of the charge transport in organic charge-transportable resin films to which charge transporting materials are incorporated.
Figure 17B:
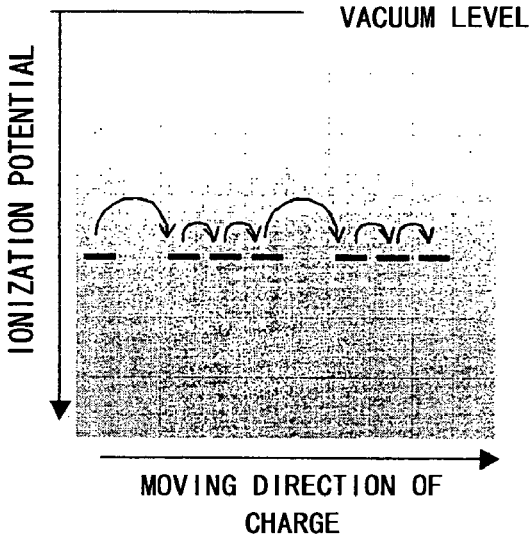
FIG. 17B illustrates a pattern of the charge transport in organic charge-transportable resin films to which charge transporting materials are incorporated.

In FIG. 17A, only one charge transporting material is used in the organic charge-transportable resin film. FIG. 17H illustrates the case where a donor segment as shown in poly(vinylcarbazole) (PVK) constitutes a dimer cation radical (exciplex) which in turn constitutes a trap site. FIG. 17B illustrates the case where CTM1 as well as CTM2 serve as a hopping site.

Figure 17C:
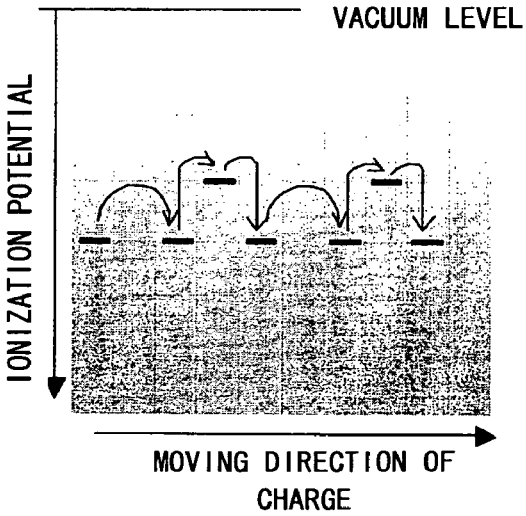
FIG. 17C illustrates a pattern of the charge transport in organic charge-transportable resin films to which charge transporting materials are incorporated.
Figure 17D:
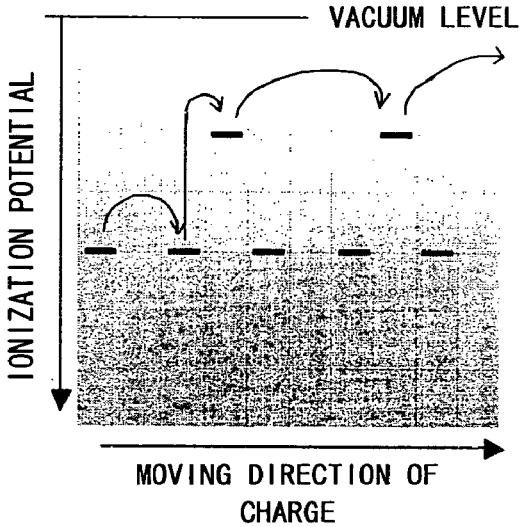
FIG. 17D illustrates a pattern of the charge transport in organic charge-transportable resin films to which charge transporting materials are incorporated.
Figure 17E:
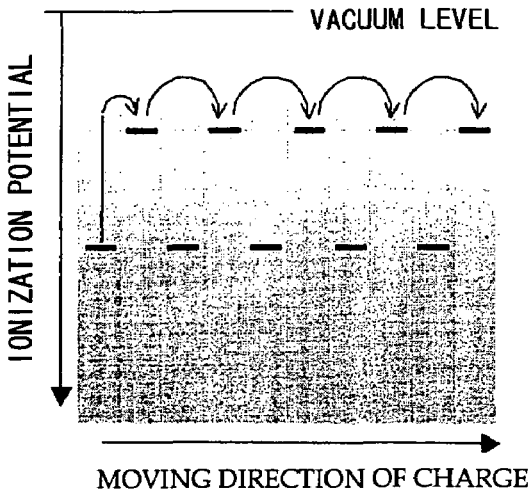
FIG. 17E illustrates a pattern of the charge transport in organic charge-transportable resin films to which charge transporting materials are incorporated.
Figure 17F:
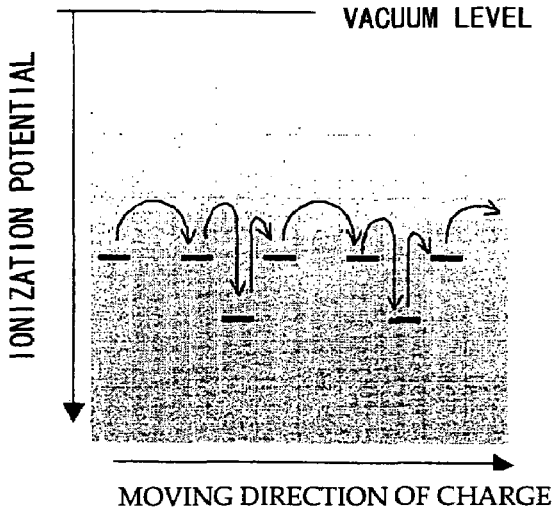
FIG. 17F illustrates a pattern of the charge transport in organic charge-transportable resin films to which charge transporting materials are incorporated.
Figure 17G:
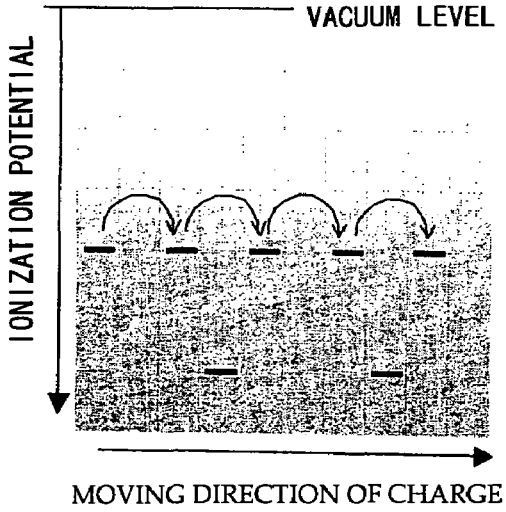
FIG. 17G illustrates a pattern of the charge transport in organic charge-transportable resin films to which charge transporting materials are incorporated.
Figure 17H:
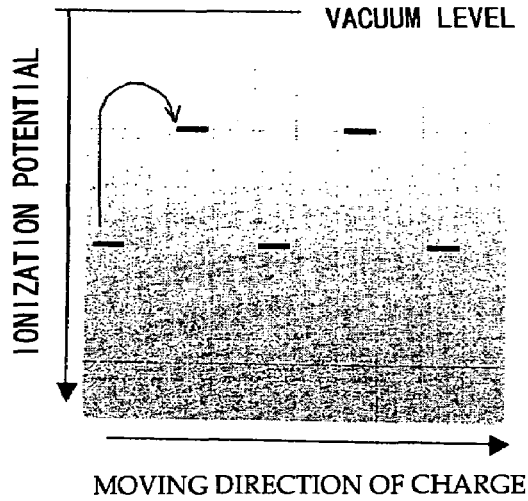
FIG. 17H illustrates a pattern of the charge transport in organic charge-transportable resin films to which charge transporting materials are incorporated.

FIG. 17C illustrates the case where the difference in ionization potential between CTM1 and CTM2 is significant, and the charge carrier hops between CTM1 and CTM2. FIG. 17D is a modification of FIG. 17C, in which the charge dropped from CTM1 to CTM2 cannot return to the hopping sites of CTM1 and hops between the hopping sites of CTM2. In this case, only the charge transporting material having a lower ionization potential contributes to the charge mobility of the charge-transportable resin film. FIG. 17E illustrates the case where CTM2 is added in a large amount and only CTM2 contributes to the charge mobility. FIG. 17F illustrates the case where the difference in ionization potential between CTM1 and CTM2 is significant, and the charge carrier hops between CTM1 and CTM2 as in FIG. 17C. FIG.

Figure 17I:
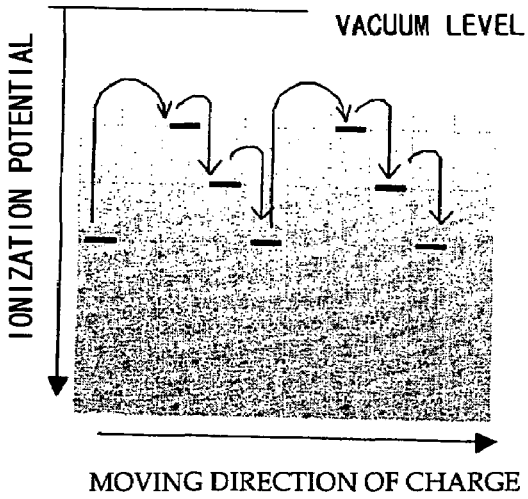
FIG. 17I illustrates a pattern of the charge transport in organic charge-transportable resin films to which charge transporting materials are incorporated.

17G illustrates the case where CTM2 does not contribute to charge transport and serves as a spacer in the charge-transportable resin film. FIG. 17I illustrates the case where CTM1 includes a trap site as in a dimer cation radical, and CTM2 assists detrap of the charge trapped by the trap site.

The charge mobility at a difference in ionization potential of 0.5 eV or more is near to the measured value of a resin film containing a binder resin and 20 percent by weight of CTM2. This finding indicates that the charge is transported in the pattern shown in FIG. 17D when the difference in ionization potential is 0.5 eV or more. When the charge transporting materials are used in combination in this manner, the substantial charge transport ability disappears when the amount of the at least one second charge transporting material (CTM2) is less than 20 percent by weight. Namely, the charge mobility cannot be determined by the TOF method.

Based on these findings, the present inventors have found that the charge transporting material(s) to be incorporated into the surface top layer should preferably satisfy the following conditions in order to form a latent electrostatic image satisfactorily in a photoconductor having a crosslinkable resin film arranged on a surface top layer.

(1) In the case where the difference in ionization potential is 0.1 eV or less:

The charge transport ability is substantially identical between the different charge transporting materials. Such charge transporting material satisfying this condition can be effectively chosen, for example, by selecting a compound similar to the charge transporting material for use in the charge transport layer, by introducing an appropriate electron-withdrawing or electron-donative substituent into the charge transporting material or by choosing the components based on the comparison between ionization potential obtained according to a molecular orbital study.

(2) In the case where the difference in ionization potential exceeds 0.1 eV:

When the charge transporting material of the surface top layer migrates into the charge transport layer or when the charge transporting material of the charge transport layer migrates into the surface top layer, one of the charge transporting materials serves as a trap site and thus affects the charge transport ability. In particular, when a trace amount of one of the two charge transporting materials involuntarily migrates into another layer in a production process of the photoconductor, the migrated charge transporting material may play a role of charge transport, and the other charge transporting material originally contained may lose its charge transporting function. The proportions of the charge transporting materials must be set so that this problem can be neglected. The proportions of the charge transporting materials preferably satisfy the following conditions:

$$a/(a+b)<0.01 \text{ or}$$

$$a/(a+b)>0.99$$

wherein "a" and "b" are contents in the surface top layer of a first charge transporting material for use in the charge transport layer and of a second charge transporting material for use in the surface top layer, respectively.

The former condition can be effectively satisfied by forming the surface top layer under such conditions as not to dissolve or fuse the charge transport layer. More specifically, it is effective to allow the components of charge transport layer to be resistant to migration into the surface top layer, for example, by using a poor solvent with respect to the charge transport layer as the solvent of a coating composition for the surface top layer or by using a polymeric charge transporting material in the charge transport layer.

The latter condition is employed when a crosslinkable binder resin containing no charge transporting material is used to form the surface top layer, and the charge transporting material in the charge transport layer is allowed to positively migrate into the surface top layer in the production process.

4.2. Selection of the Charge Transporting Material to be Contained in the Surface Top Layer:

When a charge transporting material is incorporated into the surface top layer, any of compounds having an α-phenylstilbene skeleton are preferably used as the charge transporting material, since these compounds exhibit satisfactory charge transport ability.

Among them, compounds represented by following Formulae (1) and (2) are useful, since they have high reactivity with thermosetting resin monomers and exhibit satisfactory sensitivities.

Formula (1)

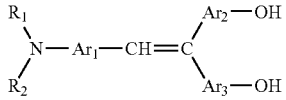

In Formula (1), $R_1$ and $R_2$ may be the same as or different from each other and are each a substituted or unsubstituted aryl group.

$Ar_1$, $Ar_2$ and $Ar_3$ may be the same as or different from one another and are each an arylene group. Examples of the arylene group are divalent groups derived from the same aryl groups as in $R_1$ and $R_2$.

$R_1$ and $R_2$ may be the same as or different from each other and are each a substituted or unsubstituted aryl group, and specific examples thereof are aromatic hydrocarbon groups, fused polycyclic groups, non-fused polycyclic groups, and heterocyclic groups.

The aromatic hydrocarbon groups include, for example, phenyl group. Examples of the fused polycyclic groups are naphthyl group, pyrenyl group, 2-fluorenyl group, 9,9-dimethyl-2-fluorenyl group, azulenyl group, anthryl group, triphenylenyl group, chrysenyl group, fluorenylidenephenyl group and 5H-dibenzo[a,d]cycloheptenylidenephenyl group. Examples of the non-fused polycyclic groups are biphenylyl group, terphenylyl group and groups represented by following formula:

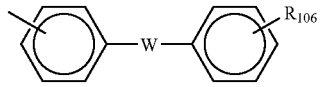

wherein W represents —O—, —S—, —SO—, —$SO_2$—, —CO— or any of following divalent groups:

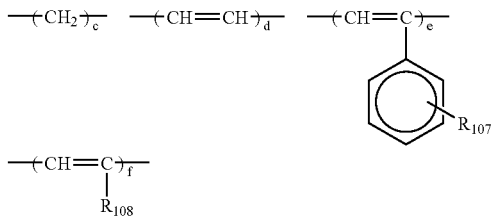

wherein c is an integer of 1 to 12; d is an integer of 1 to 3; e is an integer of 1 to 3; and f is an integer of 1 to 3.

Examples of the heterocyclic group are thienyl group, benzothienyl group, furyl group, benzofuranyl group and carbazolyl group.

The arylene groups as $Ar_1$, $Ar_2$ and $Ar_3$ may be the same as or different from one another and are each a divalent group derived from the aryl group exemplified as $R_1$ and $R_2$.

The aryl groups and the arylene groups may have one or more substituents as mentioned below. These substituents are specific examples of $R_{106}$, $R_{107}$ and $R_{108}$ in the above formulae. Examples of the substituents are (1) halogen atoms, trifluoromethyl group, cyano group, nitro group; (2) alkyl groups; (3) alkoxy groups; (4) aryloxy groups; (5) substituted mercapto groups or arylmercapto groups; (6)groups represented by following formula:

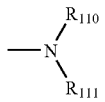

wherein $R_{110}$ and $R_{111}$ may be the same as or different from each other and are each an alkyl group or an aryl group; and (7) alkylenedioxy groups and alkylenedithio groups.

Examples of the alkyl groups (2) are linear or branched alkyl groups having preferably one to eighteen carbon atoms, more preferably one to twelve carbon atoms and further preferably one to four carbon atoms. These alkyl groups may further have at least one selected from fluorine atom, hydroxyl group, cyano group, an alkoxy group having one to four carbon atoms and phenyl group. The phenyl group herein may be further substituted with a halogen atom, an alkyl group having one to four carbon atoms and/or an alkoxy group having one to four carbon atoms. More specific examples of the alkyl groups are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group and 4-phenylbenzyl group.

Examples of the alkoxy groups (3) (—$OR_{109}$) are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group and trifluoromethoxy group.

Examples of the aryl moiety in the aryloxy groups (4) are phenyl group and naphthyl group. The aryl moiety herein may have one or more substituents selected from an alkoxy group having one to four carbon atoms, an alkyl group having one to four carbon atoms and a halogen atom. Specific examples of the aryloxy groups are phenoxy group, 1-naphthyloxy group, 2-naphthyloxy group, 4-methylphenoxy group, 4-methoxyphenoxy group, 4-chlorophenoxy group and 6-methyl-2-naphthyloxy group.

Specific examples of the substituted mercapto groups or arylmercapto groups (5) are methylthio group, ethylthio group, phenylthio group and p-methylphenylthio group.

(6) In the formula:

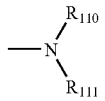

examples of the aryl group as $R_{110}$ and $R_{111}$ are phenyl group, biphenyl group and naphthyl group. These groups may further have one or more substituents selected from an alkoxy group having one to four carbon atoms, an alkyl group having one to four carbon atoms and a halogen atom. $R_{110}$ and $R_{111}$ may form a ring together with the adjacent nitrogen atom. Specific examples of the group represented by the above formula are diethylamino group, N-methyl-N-phenylamino group, N,N-diphenylamino group, N,N-di(p-tolyl) amino group, dibenzylamino group, piperidino group, morpholino group and julolidyl group.

Examples of the alkylenedioxy groups and the alkylenedithio groups (7) are methylenedioxy group and methylenedithio group.

The compounds of Formula (1) are easily dissolved in a solvent such as an alcohol or a Cellosolve to thereby form a clear and uniform film.

Formula (2)

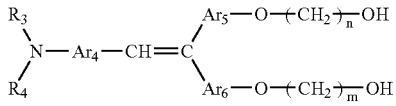

In Formula (2), $R_3$ and $R_4$ may be the same as or different from each other and are each a substituted or unsubstituted aryl group.

$Ar_4$, $Ar_5$ and $Ar_6$ may be the same as or different from one another and are each an arylene group. Examples of the arylene group are a divalent groups derived from the aryl groups as in $R_3$ and $R_4$. Each of m and n is a number of repetitions ranging from 1 to 10.

$R_3$ and $R_4$ represent the same substituents as $R_1$ and $R_2$ in Formula (1). $Ar_4$, $Ar_5$ and $Ar_6$ represent the same substituents as $Ar_1$, $Ar_2$ and $Ar_3$, respectively, in Formula (1).

The compounds of Formula (2) are easily dissolved in a solvent such as a ketone or an ether to thereby form a clear and uniform film.

4.3. Content of Charge Transporting Material in Surface Top Layer

The surface top layer must have the function of neutralizing the charge in order to form a latent electrostatic image. A photoconductor having such a surface top layer arranged on or above a photoconductive layer may generally have a reduced neutralization function as compared with a photoconductor having no surface top layer. To avoid this disadvantage effectively, the surface top layer preferably has a thickness of less than 1 μm. This configuration is effective in the case where the scratching of the surface top layer is substantially trivial in actual use.

Alternatively, the surface top layer should preferably have an appropriate charge transport ability, when it has a thickness of 1 μm or more. To achieve this configuration, it is effective to chose appropriate charge transporting material(s) and to increase the content of the charge transporting material(s) in addition to satisfy the above-mentioned matching requirements.

In this connection, the content of the charge transporting material in the charge transport layer is generally about 30 percent by weight to about 70 percent by weight based on the total weight of the charge transport layer so as to ensure the charge mobility. However, the charge transporting material in the surface top layer does not need to have such a large content as that in the charge transport layer to ensure the charge mobility. This is because the surface top layer does not need to have a large thickness as in the charge transport layer constituting part of the photoconductive layer and having a relatively large thickness of generally about 15 to about 40 μm. The present inventors have verified that no problem occurs in the image density of output images in an actual test using an electrophotographic apparatus by setting the content of the at least one second charge transporting material in the surface top layer at about 7.5 percent by weight or more. Thus, the content of the at least one second charge transporting material in the surface top layer is preferably set at about 7.5 percent by weight or more.

Accordingly, the present invention provides an electrophotographic photoconductor that exhibits satisfactory photosensitivity properties for the formation of latent electrostatic images, is substantially free from abrasion loss even in printing in a large quantity and has high mechanical strength being substantially free from scratching on the surface of the photoconductor in actual use. This reduces the exchange frequency of the photoconductor in an electrophotographic apparatus, which exchange frequency is generally affected by the life of the photoconductor.

If higher abrasion resistance is imparted to conventional photoconductors, the resulting photoconductors generally invite image defects such as image blur and/or image lag upon output of images. The present inventors have found means for avoiding these problems. Thus, the present invention can prevent occurrence of image defects. According to conventional techniques, a drum heater is arranged in an electrophotographic apparatus in order to avoid the image blue, which invites increased printing cost. In contrast, the present invention does not need to such a drum heater and can avoid such increased printing cost. The image lag deteriorates the quality of resulting images. The present invention, however, can solve this problem by controlling the time dependency of the transit time in actual use at a specific level or below.

In addition, the present inventors have found that unnecessary substances can be avoided from remaining on the surface of the photoconductor to thereby reduce the damage on photoconductor contact-carrying members such as cleaning blades by allowing the photoconductor to have a reduced surface free energy. Such reduced damage on the photoconductor contact-carrying members can prolong the life of the image-forming engine.

In addition, the printing cost can be reduced, since the exchange frequency of the photoconductor and parts surrounding the photoconductor is reduced. The above configurations are applied to an organic photoconductor, and the photoconductor can be produced at low cost.

The present inventors have found that a photoconductor having excellent mechanical strength, being substantially free from image defects, exhibiting good releasability from unnecessary foreign matters and keeping its good photosensitivity can thus be provided. The present invention has been accomplished based on these findings.

DETAILED DESCRIPTION OF THE PREFERRED EMBODIMENTS

The electrophotographic photoconductor of the present invention will be illustrated in detail with reference to the drawings.

Figure 7:
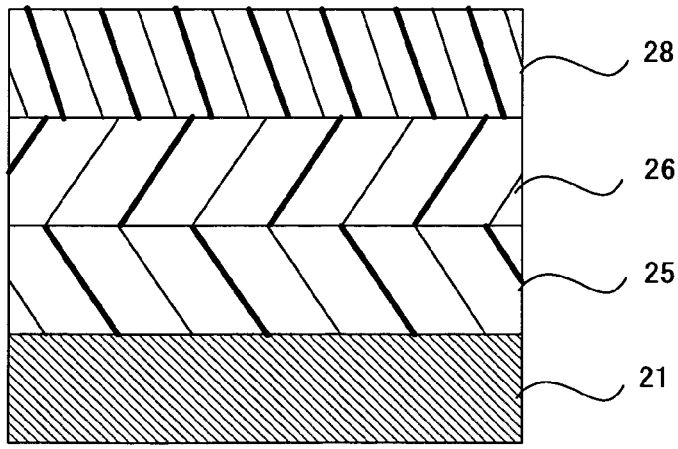
FIG. 7 is a cross-sectional view of a layer configuration of an electrophotographic photoconductor according to the present invention.

FIG. 7 is a schematic cross-sectional view of an embodiment of the electrophotographic photoconductor of the present invention. The electrophotographic photoconductor comprises an electroconductive substrate 21, a charge generation layer 25, a charge transport layer 26 and a surface top layer 28 arranged in this order.

Figure 8:
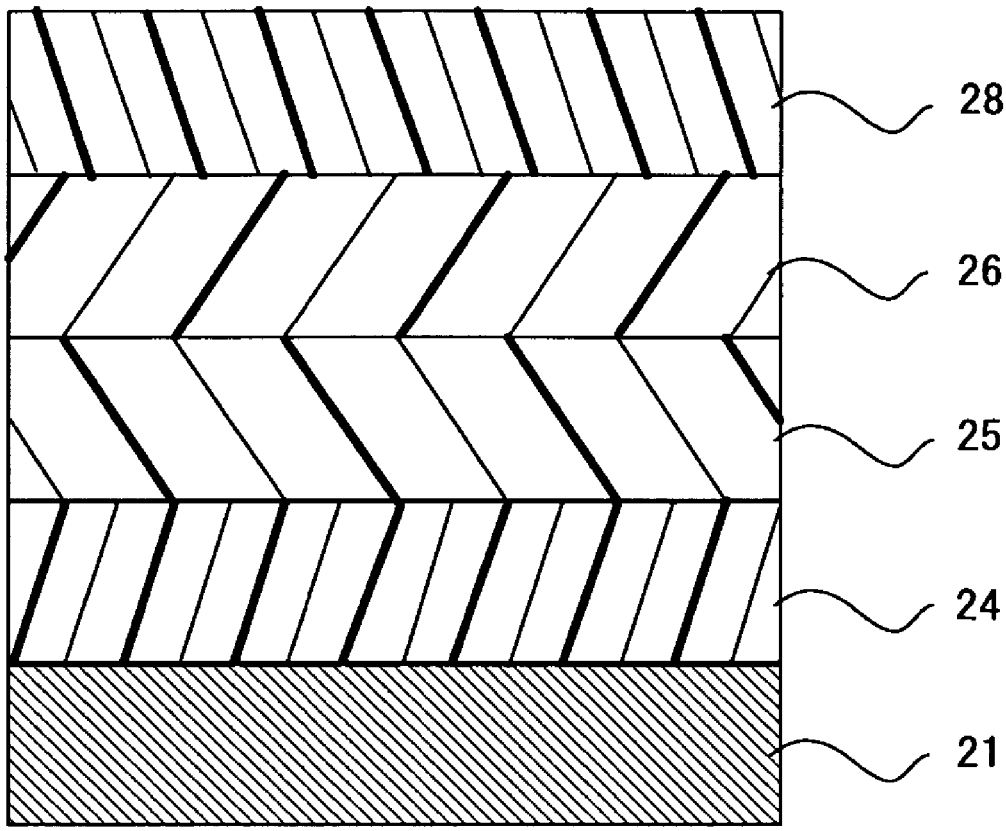
FIG. 8 is a cross-sectional view of another layer configuration of the electrophotographic photoconductor according to the present invention.

FIG. 8 is a schematic cross-sectional view of another embodiment of the layer configuration of the electrophotographic photoconductor of the present invention. The electrophotographic photoconductor herein further comprises an undercoat layer 24 between an electroconductive substrate 21 and a charge generation layer 25 and comprises a charge transport layer 26 and a surface top layer 28 over the charge generation layer 25.

Suitable materials for use in the electroconductive substrate 21 are materials each having a volume resistivity $10^{10}$ Ω·cm or less. Specific examples of such materials include plastics or paper in the form typically of a sheet or drum, which is coated with a metal such as aluminum, nickel, chromium, nichrome, copper, silver, gold, platinum or iron, or an oxide such as tin oxide and indium oxide, for example by vapor deposition or sputtering; a plate of a metal such as aluminum, aluminum alloys, nickel and stainless steel; and a drum of such a metal in which a primary drum is prepared, for example, by drawing ironing, impact ironing, extruded ironing, extruded drawing or cutting, and then the primary drum is subjected to surface treatment typically by cutting, super finishing or polishing.

The photoconductive layer for use in the present invention is preferably a multi-layered photoconductive layer comprising a charge generation layer and a charge transport layer.

The multi-layered photoconductive layer will be illustrated below.

Of the individual layers in the multi-layered photoconductor, initially, the charge generation layer 25 will be explained. The charge generation layer refers to part of the multi-layered photoconductive layer, which serves to generate charges upon being exposed to light and contains one or more charge generating materials as an essential component and, if necessary, a binder resin. The charge generating materials may be any of known charge generating materials. Specific examples thereof are phthalocyanines including metal phthalocyanines such as titanyl phthalocyanine and chlorogallium phthalocyanine, and metal-free phthalocyanine; azulenium salt pigments, squaric acid methine pigments, symmetric or asymmetric azo pigments including a carbazole skeleton, symmetric or asymmetric azo pigments including a triphenylamine skeleton, symmetric or asymmetric azo pigments including a diphenylamine skeleton, symmetric or asymmetric azo pigments including a dibenzothiophene skeleton, symmetric or asymmetric azo pigments including a fluorenone skeleton, symmetric or asymmetric azo pigments including an oxadiazole skeleton, symmetric or asymmetric azo pigments including a bisstilbene skeleton, symmetric or asymmetric azo pigments including a distyryloxadiazole skeleton, symmetric or asymmetric azo pigments including a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments and bisbenzimidazole. Among them, preferred materials for use in the present invention are metal phthalocyanines, symmetric or asymmetric azo pigments including a fluorenone skeleton, symmetric or asymmetric azo pigments including a triphenylamine skeleton and perylene pigments, since they have high quantum efficiency upon charge generation. Each of these charge generating materials can be used alone or in combination.

Suitable binder resins include polyamide resins, polyurethane resins, epoxy resins, polyketone resins, polycarbonate resins, polyarylate resins, silicone resins, acrylic resins, polyvinyl butyral resins, polyvinyl formal resins, polyvinyl ketone resins, polystyrene resins, poly-N-vinylcarbazole resins and polyacrylamide resins. Among them, polyvinyl butyral resins are often used and are useful. Each of these binder resins can be used alone or in combination.

Polymeric charge transporting materials can also be used as the binder resin in the charge generation layer. If desired, a low-molecular charge transporting material may be added.

The charge transporting materials for use in the charge generation layer include electron transporting materials and positive-hole transporting materials. These materials are further classified as low-molecular charge transporting materials and macromolecular charge transporting materials.

The macromolecular charge transporting materials are hereinafter referred to as "polymeric charge transporting materials.

Examples of the electron transporting materials are electron accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one and 1,3,7-trinitrobenzothiophene-5,5-dioxide.

Each of these electron transporting materials can be used alone or in combination.

Suitable examples of the positive-hole transporting materials are electron-donative materials.

Specific examples thereof are oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives and thiophene derivatives.

Each of these positive-hole transporting materials can be used alone or in combination.

Examples of the polymeric charge transporting materials for use in the charge generation layer are polymers having a carbazole ring, such as poly-N-vinylcarbazole; polymers having a hydrazone structure as disclosed in JP-A No. 57-78402; polysilylene polymers as disclosed in JP-A No. 63-285552; aromatic polycarbonates as disclosed in JP-A No. 08-269183, No. 09-151248, No. 09-71642, No. 09-104746, No. 09-328539, No. 09-272735, No. 09-241369, No. 11-29634, No. 11-5836, No. 11-71453, No. 09-221544, No. 09-227669, No. 09-157378, No. 09-302084, No. 09-302085, No. 09-268226, No. 09-235367, No. 09-87376, No. 09-110976 and No. 2000-38442. Each of these polymeric charge transporting materials can be used alone or in combination.

Suitable methods for preparing the charge generation layer include thin film forming methods in vacuo, and casting methods from a solution-dispersion system.

Specific examples of the thin film forming methods in vacuo are vacuum deposition, glow discharge decomposition, ion plating, sputtering, reactive sputtering and chemical vapor deposition (CVD).

The casting methods for preparing the charge generation layer can be carried out, for example, in the following manner. Initially, a coating composition is prepared by mixing one or more charge generating materials mentioned above with a solvent such as tetrahydrofuran, cyclohexanone, dioxane, dichloroethane or butanone, optionally together with a binder resin, and then dispersing the materials typically in a ball mill, an attritor or a sand mill. The coating composition is then diluted to an appropriate concentration and applied to form a charge generation layer. Among such solvents, methyl ethyl ketone, tetrahydrofuran and cyclohexanone load less burdens on the environment and are preferred as compared with chlorobenzene, dichloromethane, toluene and xylene. The coating composition is applied, for example, by dip coating, spray coating or bead coating.

The thickness of the charge generation layer is preferably from about 0.01 to about 5 μm and more preferably from about 0.1 to about 1 μm.

Next, the charge transport layer 26 will be described.

The charge transport layer refers to part of the multilayered photoconductive layer, which serves to inject charges generated in the charge generation layer and transport the injected charges to the surface of the photoconductor. The charge transport layer generally mainly comprises at least one charge transporting material, and a binder component for binding the charge transporting material.

The charge transport layer can be prepared, for example, by dissolving or dispersing a mixture or a copolymer mainly comprising a charge transporting material and a binder component in a suitable solvent or medium to form a coating composition, applying and then drying the coating composition. The coating composition can be applied typically by dipping, spray coating, ring coating, roll coating, gravure coating, nozzle coating or screen printing.

The thickness of the charge transport layer is preferably from about 15 to about 40 μm and more preferably from about 15 to about 30 μm for ensuring practically satisfactory photosensitivity and charge ability. If a higher resolution is required, the thickness is preferably about 25 μm or less. In contrast, the thickness is preferably about 15 μm or more, since an excessively thin charge transport layer may increase the electrostatic capacity of the photoconductive layer and may invite deteriorated charge ability and reduced photosensitivity.

The charge transport layer in the present invention is covered by the surface top layer, and the thickness thereof can be reduced to some extent, since reduction in film thickness in actual use is trivial.

Examples of the solvent or dispersant for use in the preparation of the coating composition for a charge transport layer are ketones such as methyl ethyl ketone, acetone, methyl isobutyl ketone and cyclohexanone; ethers such as dioxane, tetrahydrofuran and ethyl Cellosolve; aromatic hydrocarbons such as toluene and xylenes; halogenated hydrocarbons such as chlorobenzene and dichloromethane; and esters such as ethyl acetate and butyl acetate. Among them, methyl ethyl ketone, tetrahydrofuran and cyclohexanone load less burdens on the environment and are preferred as compared with chlorobenzene, dichloromethane, toluene and xylene. Each of these solvents can be used alone or in combination.

Examples of polymeric compounds for use as the binder component in the charge transport layer are thermoplastic resins and thermosetting resins. Specific examples thereof are polystyrenes, styrene/acrylonitrile copolymers, styrene/butadiene copolymers, styrene/maleic anhydride copolymers, polyesters, poly(vinyl chloride)s, vinyl chloride/vinyl acetate copolymers, poly(vinyl acetate)s, poly(vinylidene chloride)s, polyarylates, polycarbonates, cellulose acetate resins, ethyl cellulose resins, poly(vinyl butyral)s, poly (vinyl formal)s, polyvinyltoluenes, acrylic resins, silicone resins, fluorocarbon resins, epoxy resins, melamine resins, urethane resins, phenol resins and alkyd resins. Among them, most of polystyrenes, polyesters, polyarylates and polycarbonates exhibit good charge mobility when used as the binder component in the charge transporting material and are useful. The charge transport layer does not need to have such high mechanical strength as in conventional charge transport layers, since it is covered by the surface top layer. Accordingly, polystyrenes and other materials having high transparency but somewhat low mechanical strength can be used as the binder resin in the charge transport layer in the present invention. In contrast, such materials are hardly applied to conventional charge transport layers.

Each of these polymeric compounds can be used alone or in combination, as a mixture or a copolymer. In addition, these can be used as copolymers with charge transporting materials.

Electrically inactive polymeric compounds may be used for the modification of the charge transport layer. Suitable examples of such electrically inactive polymeric compounds are polyesters having a cardo structure and containing a bulky skeleton such as fluorene; polyesters such as poly (ethylene terephthalate)s and poly(ethylene naphthalate)s; polycarbonate derivatives derived from bisphenol polycarbonates such as C type polycarbonates, except with 3,3'-positions of the phenol moiety substituted with alkyls; polycarbonate derivatives derived from bisphenol A, except with a geminal methyl group of bisphenol A substituted with a long-chain alkyl group having two or more carbon atoms; polycarbonates having a biphenyl skeleton or a biphenyl ether skeleton; polycarbonates having a long-chain alkyl skeleton such as polycaprolactones as disclosed in JP-A No. 7-292095; acrylic resin; polystyrenes; and hydrogenated polybutadienes.

The electrically inactive polymeric compounds herein refer to polymeric compounds having no chemical structure that exhibits photoconductivity, such as a triarylamine structure.

The amount of such polymeric compounds, if used in combination with the binder resin, is preferably 50 percent by weight or less of the total solid content of the charge transport layer for limitations in photo-induced discharge sensitivity.

Materials for use as the charge transporting material include the above-mentioned low-molecular electron transporting materials, low-molecular positive-hole transporting materials and polymeric charge transporting materials.

The amount of the low-molecular charge transporting material, if used, is preferably from about 40 to about 200 phr (parts per hundred parts of resin), and more preferably from about 70 to about 100 phr. As the polymeric charge transporting material, preferred is a copolymer of preferably 0 to 200 parts by weight, and more preferably 80 to 150 parts by weight of a resin component with 100 parts by weight of the charge transporting material.

When two or more charge transporting materials are incorporated into the charge transport layer, it is preferred that a difference in ionization potential between the two charge transporting materials be 0.10 eV or less for reasons that one of them would not act as a charge trap material for the other.

In the process of arranging the surface top layer over the charge transport layer, the charge transporting material in the charge transport layer may migrate into the surface top layer and may invite a difference in ionization potential exceeding 0.1 eV. This problem can often be solved by incorporating a polymeric charge transporting material into the charge transporting material in the charge transport layer. The polymeric charge transporting material used for this purpose preferably has a weight-average molecular weight of 10000 or more, since a polymeric charge transporting material having an excessively low molecular weight may also migrate into the surface top layer. The upper limit of the weight-average molecular weight is preferably about 200000 for yielding a smooth film.

Photoconductors having a surface top layer may have photosensitivity properties lower than those having no surface top layer. To compensate this, it is preferred that the charge transporting layer show a high charge mobility and that the charge mobility be high even in a low electric field for higher photosensitivity. More specifically, the charge transport layer preferably has a charge mobility of $1.2\times10^{-5}$ $cm^2/Vsec$ or more, more preferably $1.0\times10^{-4}$ $cm^2/Vsec$ or more, at a field strength of 160 kV/cm, and a field strength dependency $\beta$ of the charge mobility of $1.6\times10^{-3}$ or less.

The field strength dependency of the charge mobility can be determined in the following manner.

Figure 19:
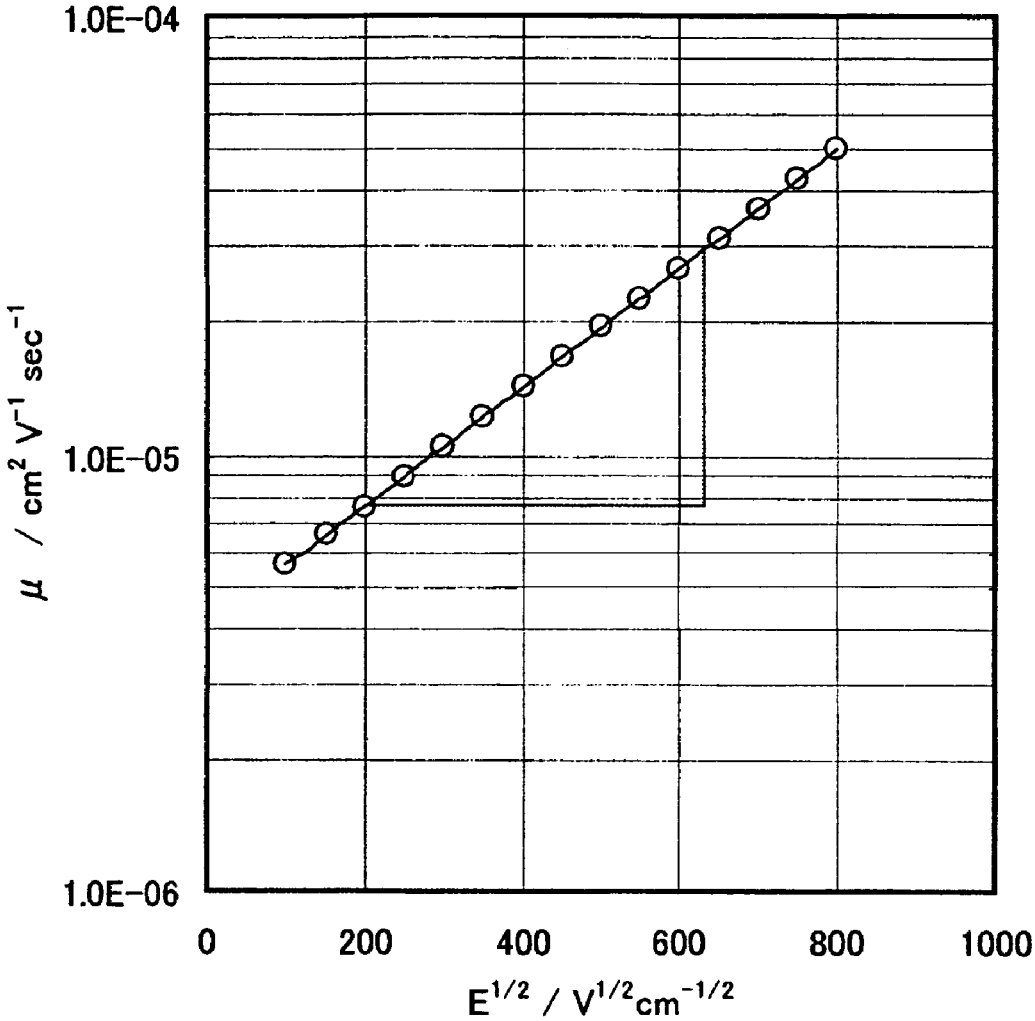
FIG. 19 illustrates a relationship between the field strength and the charge mobility of a charge transport layer.

Specifically, a change in charge mobility with an increasing field strength is plotted as a semilogarithmic graph with the ordinate of the charge mobility $\mu$ (unit: $cm^2/Vsec$) and the abscissa of the square root of the field strength $E^{1/2}$ (unit: $V^{1/2}/cm^{1/2}$). An approximated line is drawn on the plots. A specific example of this procedure is shown in FIG. 19. It is interpreted that the larger is the slope of the line, the larger is the field strength dependency of the charge mobility. In the present invention, the field strength dependency $\beta$ is quantitatively indicated by following Equation (1):

$$\beta=\log\mu/E^{1/2}$$

It is interpreted that a charge transport layer having a larger $\beta$ as calculated according to Equation (1) has a higher field strength dependency of the charge mobility. Such a charge transport layer having a larger $\beta$ may often show a low charge mobility in a low electric field. This may cause an increased residual charge or a reduced responsibility in a low charging mode.

To increase the charge mobility of the charge transport layer and to reduce the field strength dependency thereof effectively, it is preferred that the content of the charge transporting material is increased or the polystyrene or the polymeric charge transporting material is used as the binder resin. In particular, a solid solution between a charge transporting material having an $\alpha$-phenylstilbene skeleton and a polystyrene, and a solid solution between a charge transporting material having an $\alpha$-phenylstilbene skeleton and the above-mentioned polymeric charge transporting material are preferred for effectively increasing the charge mobility.

The content of the charge transporting material is preferably set at 70 phr or more for higher photosensitivity. Alternatively or in addition, the charge transporting material is preferably one of monomers and dimers of $\alpha$-phenylstilbene compounds, benzidine compounds or butadiene compounds, and polymeric charge transporting materials having any of these structures in their principal chain or side chain, since most of these materials have a high charge mobility.

If necessary, the charge transport layer may further comprise any additives including low-molecular compounds such as antioxidants, plasticizers, lubricants and UV absorbents, as well as leveling agents. Each of these additives can be used alone or in combination. When such a low-molecular compound and a leveling agent are incorporated into the charge transport layer, the photosensitivity may often be deteriorated. To avoid this, the amount of these low-molecular compounds is generally from about 0.1 to about 20 phr and more preferably from about 0.1 to about 10 phr. The amount of the leveling agent is preferably from about 0.001 to about 0.1 phr.

Next, the surface top layer 28 will be described.

The surface top layer in the present invention comprises at least one crosslinkable binder resin, has a light transmittance of 95% or more at wavenumbers of 3200 to 3800 $cm^{-1}$ and shows substantially no endothermic peak in a differential scanning calorimetry curve determined by using a differential scanning calorimeter. The surface top layer is so configured as not to adversely affect the formation of latent electrostatic images. More specifically, the surface top layer has a thickness of less than 1 μm (hereinafter referred to as "thin-film embodiment" for the sake of convenience), or alternatively, the charge transport ability is imparted to the surface top layer if the layer has a thickness of 1 μm or more (hereinafter referred to as "thick-film embodiment"). In the thin-film embodiment, the surface top layer is a resin film prepared as a result of thermal crosslinking reaction of a thermosetting resin monomer, preferably together with a thermosetting surfactant. In the thick-film embodiment, one or more charge transporting materials are added in the preparation of the resin film.

In the condition where in the surface top layer has a light transmittance of 95% or more at wavenumbers of 3200 to 3800 $cm^{-1}$, the surface top layer is substantially free from hydroxyl groups. The hydroxyl groups herein refer to unreacted hydroxyl groups remained in the surface top layer when the material for the surface top layer comprises a hydroxyl-containing compound.

In the condition where in the surface top layer shows substantially no endothermic peak in a DSC curve, the surface top layer is substantially free from residual uncured portions.

A thermosetting surfactant is preferably used in the surface top layer. The resulting surface top layer has a low surface free energy and exhibits good releasability from deposited unnecessary substances such as a residual toner after image transfer.

The thickness of the surface top layer comprising one or more charge transporting materials is preferably 1 μm or more and more preferably 2 μm or more. In contrast, if the surface top layer has an excessively increased thickness, residual charges in accordance with the Poisson's equation accumulate to thereby form space charges in the surface top layer. This may result in a decreased image density of outputted images and/or image defects such as positive image lag.

To avoid the above problems, the thickness of the surface top layer must be set at such a level so that formation of space charges does not substantially affect the outputted images. The thickness is practically preferably set at about 2 μm to about 10 μm for satisfying these requirements.

Examples of the solvent or dispersant for the coating composition for a surface top layer are the ketones, ethers, aromatic compounds, and halogen compounds described in the explanation for the charge transport layer. Among them, methyl ethyl ketone, tetrahydrofuran and cyclohexanone load less burdens on the environment as compared with chlorobenzene, dichloromethane, toluene and xylene and are preferred.

The charge transporting material contained in the charge transport layer may involuntarily migrate into the surface top layer in the formation of the surface top layer. To avoid adverse effects of the migrated component on the charge transport ability of the surface top layer, a poor solvent with respect to the charge transport layer is preferably used as the solvent or dispersant of the coating composition for a surface top layer. Examples of such poor solvent are, in general, alcohols such as ethanol and isopropyl alcohol; and Cellosolves such as ethyl Cellosolve and butyl Cellosolve.

Examples of the charge transporting materials for use in the surface top layer include the polymeric charge transporting materials and the low-molecular charge transporting materials as listed in the explanation of the charge transport layer, as well as crosslinkable charge transporting materials each containing a reactive hydroxyl group. Among them, such crosslinkable charge transporting materials each having a reactive hydroxyl group accelerate the formation of a denser network structure of the surface top layer resin film and contribute to the prolongation of the life of the photoconductor.

Preferred examples of the crosslinkable charge transporting materials are bisphenol compounds disclosed in JP-A No. 07-228557; diamine compounds disclosed in JP-A No. 08-198825; dihydroxyl-containing diamine compounds disclosed in JP-A No. 09-31035, No. 09-263569, No. 09-268164 and No. 10-7629; hydroxyl-containing amine compounds disclosed in JP-A No. 09-278723 and JP-A No. 10-7630; hydroxyl-containing stilbene compounds disclosed in JP-A No. 09-194442; and amine compounds disclosed in JP-A No. 10-53569. These compounds are used as raw materials for the above-mentioned polymeric charge transporting materials to yield good charge transport ability and have satisfactory reactivity. Reactive charge transporting materials described in JP-A No. 2001-142243 and JP-A No. 2002-6517 can also be used.

The polymeric charge transporting materials can be used as the charge transporting material for use in the surface top layer and, in this case, preferably each have a weight-average molecular weight of 10000 or more and 200000 or less.

The content of the charge transporting material is preferably about 7.5 percent by weight or more of the weight of total solid content of the coating composition for a surface top layer. The upper limit of the content varies with the solubility in the solvent and/or reactivity with other materials but is generally about 40 percent by weight.

When the charge transport layer and the surface top layer contain different charge transporting materials from each other, the difference in ionization potential between the different charge transporting materials contained in different layers should preferably be as small as 0.10 eV or less. Likewise, when the surface top layer comprises two or more different charge transporting materials, the difference in ionization potential between these different charge transporting materials should preferably be 0.10 eV or less.

The thermosetting resin monomer for use in the present invention can be any known material as long as it satisfies the above-mentioned requirements. Specific examples of such thermosetting resin monomers are monomers for melamine resins, urea resins, epoxy resins, urethane resins, alkyd resins, acrylic resins, organic silane condensates and other condensates and mixtures of these.

Among them, melamine resin monomers and other amino resin monomers are capable of self condensation, can form a film, even if the proportion of them to other materials is significantly changes, and have high flexibility in design.

In addition, the amino resin monomers have good abrasion resistance and satisfactory reactivity with charge transporting materials.

Such amino resins are prepared by subjecting formaldehyde to addition condensation with an amino group of an amino compound and, preferably, etherifying part or all of formed methylol groups with an aliphatic monohydric alcohol. The amino resins include melamine resins, benzoguanamine resins and urea resins.

Such an amino resin is capable of forming a film even when used alone, and the surface top layer may comprise such an amino resin alone. The surface top layer, however, should preferably further comprise the crosslinkable charge transporting material and a thermosetting surfactant mentioned below in addition to an amino resin, because the single use of an amino resin may invite excessively hard and brittle film.

The addition of a flexible unit is useful for improving the scratch resistance of the surface top layer. Examples of such flexible units are thermosetting polycaprolactonediols, polycaprolactonetriols, polycaprolactonepolyols and lactone-modified (meth)acrylates. Examples of such materials for use as the flexible unit are commercially available products under the trade names of PLACCEL series such as PLACCEL CD CD205, PLACCEL CD CD205PL, PLACCEL CD CD210, PLACCEL 303, PLACCEL 305, PLACCEL 308, PLACCEL 320 and PLACCEL 410D; and PLACCEL F series such as PLACCEL FM2D, PLACCEL FM3X and PLACCEL FA2D from Daicel Chemical Industries, Ltd.

The thermosetting surfactant for use in the present invention can be any of known materials such as (1) copolymers comprising fluoroalkyl-containing (meth)acrylate, and (2) fluorine-containing graft polymers as disclosed in JP-A No. 07-068398 ([0017]). Examples of the copolymers comprising fluoroalkyl-containing (meth)acrylate (1) are block copolymers each comprising a fluorine-free vinyl monomer and a fluorine-containing vinyl monomer, disclosed in JP-A No. 60-221410 and JP-A No. 60-228588. Examples of the fluorine-containing graft polymers (2) are comb graft polymers prepared by copolymerizing a methacrylate macromonomer containing a poly(methyl methacrylate) in its side chain with a fluoroalkyl-containing (meth)acrylate, as disclosed in JP-A No. 60-187921. These fluorine-containing resins are commercially available as coating material additives. Specific examples of such coating material additives are fluorine-containing random copolymers available as resin surface modifiers SC-101 and SC-105 from Asahi Glass Co., Ltd.; fluorine-containing block copolymers available as block copolymers comprising fluoroalkyl-containing polymer segment and an acrylic polymer segment under the trade names of Modiper F series (e.g., F100, F110, F200, F210 and F2020) from NOF Corporation; and fluorine-containing graft polymers under the trade names of Aron GF-150, GF-300, and RESEDA GF-2000 from TOAGOSEI Co., Ltd. These surfactants can be used alone or as a component for constituting the crosslinkable resin. Among them, copolymers between a methacrylic ester and fluoroalkyl acrylate are preferred in the present invention.

A material comprising a fluorocarbon resin having a chemically bonded silicone component disclosed in JP-A No. 2000-119354 can satisfactorily serve to prevent the deposition of unnecessary substances. This material is commercially available as hydrophobic resin ZX series (e.g., ZX-007C, ZX-001, ZX-017 and ZX-022) from Fuji Kasei Kogyo Co., Ltd.

The surface top layer may further comprise any of suitable low-molecular compounds such as antioxidants, plasticizers, lubricants and UV absorbents, and leveling agents. Each of these compounds can be used alone or in combination. The amount of the low-molecular compounds is preferably from about 0.1 to about 50 parts by weight and more preferably from about 0.1 to about 20 parts by weight, to 100 parts by weight of the resin component. The amount of the leveling agent is preferably from about 0.001 to about 5 parts by weight to 100 parts by weight of the resin component.

The surface top layer is prepared, for example, by dipping, spray coating, rind coating, roll coating, gravure coating, nozzle coating or screen printing, of which spray coating and ring coating are preferred for producing products of stable quality.

The surface top layer resin must be cured under such conditions that the resulting cured film shows no endothermic peak in a DSC curve. When the crosslinkable resin is used, this requirement may be often satisfied by applying a coating composition for a surface top layer, and heating and drying the coated film at temperatures around 150° C. for about 30 minutes. If a more severe curing condition is required, the curing temperature may often be lowered by using a catalyst (acidic substance) such as a dibutyltin catalyst or dodecyl benzenesulfonate.

The electrophotographic photoconductor according to the present invention may further comprise an undercoat layer 24 between the electroconductive substrate and the charge generation layer. The undercoat layer will serve to improve the adhesion, to prevent moire, to improve the coatability of the overlying layer, to reduce residual charge and to prevent injection (migration) of charges from the electroconductive substrate.

The undercoat layer generally mainly comprising a resin. The resin herein should preferably be insoluble or hardly soluble in regular organic solvents. This is because the photoconductive layer dissolved in such an organic solvent is applied on the undercoat layer. Examples of such resins are water-soluble resins such as poly(vinyl alcohol)s, casein and poly(sodium acrylate)s; alcohol-soluble resins such as copolyamides and methoxymethylated polyamides; and setting resins having a three-dimensional network structure, such as polyurethanes, melamine resins, alkyd-melamine resins and epoxy resins.

The undercoat layer may further comprise any of fine powders of metal oxides such as titanium oxide, silica, alumina, zirconium oxide, tin oxide and indium oxide, metal sulfides, and metal nitrides.

The undercoat layer can be prepared in the same manner as in the photoconductive layer by using an appropriate solvent and a suitable coating procedure.

A metal oxide layer prepared typically by a sol-gel method using a silane coupling agent, titanium coupling agent or chromium coupling agent can also be effectively used as the undercoat layer.

Examples of the undercoat layer also include an anodized alumina film, a film of an organic substance such as poly-p-xylylene (parylene), and a film of an inorganic substance such as silicon oxide, tin oxide, titanium oxide, ITO or ceria by a vacuum film forming process.

The thickness of undercoat layer is preferably from about 0.1 to about 5 μm.

To improve the gas barrier property and environmental resistance of the surface of the photoconductor for use in the present invention, each of the constitutional layers of the photoconductor may further comprise any of suitable additives such as antioxidants, plasticizers, UV absorbents, low-molecular charge transporting materials and leveling agents.

Typical examples of such additives will be shown below.

The antioxidants for use in the individual layers include, but are not limited to, the following compounds (a) to (d):

(a) Phenolic Compounds:

2,6-di-t-butyl-p-cresol, 2,4,6-tri-t-butylphenol, n-octadecyl-3-(4'-hydroxy-3',5'-di-t-butylphenol) propionate, styrenated phenol, 4-hydroxymethyl-2,6-di-t-butylphenol, 2,5-di-t-butylhydroquinone, cyclohexylphenol, butylhydroxyanisole, 2,2'-methylene-bis(4-ethyl-6-t-butylphenol), 4,4'-i-propylidenebisphenol, 1,1-bis(4-hydroxyphenyl)cyclohexanone, 4,4'-methylene -bis(2,6-di-t-butylphenol), 2,6-bis(2'-hydroxy-3'-t-butyl-5'-methylbenzyl)-4-methylphenol, 1,1,3-tris (2-methyl-4-hydroxy-5-t-butylphenyl)butane, 1,3,5-trismethyl-2,4,6-tris (3,5-di-t-butyl-4-hydroxybenzyl) benzene, tetrakis[methylene-3-(3,5-di-t-butyl-4-hydroxyphenyl) propionate]methane, tris (3,5-di-t-butyl-4-hydroxyphenyl)isocyanate, tris [β-(3,5-di-t-butyl-4-hydroxyphenyl)propionyl-oxyethyl]isocyanate, 4,4'-thiobis(3-methyl-6-t-butylphenol), 2,2'-thiobis(4-methyl-6-t-butylphenol) and 4,4'-thiobis(4-methyl-6-t-butylphenol).

(b) Amine Compounds:

phenyl-α-naphthylamine, phenyl-β-naphthylamine, N,N'-diphenyl-p-phenylenediamine, N,N'-di-β-naphthyl-p-phenylenediamine, N-cyclohexyl-N'-phenyl-p-phenylenediamine, N-phenylene-N'-i-propyl-p-phenylenediamine, aldol-α-naphthylamine and 6-ethoxy-2,2,4-trimethyl-1,2-dihydroquinoline.

(c) Sulfur-containing Compounds thiobis(β-naphthol), thiobis(N-phenyl-β-naphthylamine), 2-mercaptobenzothiazole, 2-mercaptobenzimidazole, dodecylmercaptane, tetramethylthiuram monosulfide, tetramethylthiuram disulfide, nickel dibutylthiocarbamate, isopropyl xantate, dilauryl thiodipropionate and distearyl thiodipropionate.

(d) Phosphorus-containing Antioxidants:

triphenyl phosphite, diphenyldecyl phosphite, phenylisodecyl phosphite, tri(nonylphenyl) phosphite, 4,4'-butylidenebis(3-methyl-6-t-butylphenyl) ditridecyl phosphite, distearyl-pentaerythritol diphosphite and trilauryl trithiophosphite.

The plasticizers for use in the individual layers include, but are not limited to, the following compounds (a) to (m):

(a) Phosphoric Acid Esters:

triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate and triphenyl phosphate.

(b) Phthalic Acid Esters:

dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate and dioctyl fumarate.

(c) Aromatic Carboxylic Acid Esters:

trioctyl trimellitate, tri-n-octyl trimellitate and octyl oxybenzoate.

(d) Aliphatic Dibasic Acid Esters:

dibutyl adipate, di-n-hexyl adipate, di-2-ethylhexyl adipate, d-n-octyl adipate, n-octyl-n-decyl adipate, diisodecyl adipate, dialkyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate and di-n-octyl tetrahydrophthalate.

(e) Fatty Acid Ester Derivatives:

butyl oleate, glycerin monooleate, methyl acetylricinolate, pentaerythritol esters, dipentaerythritol hexaesters, triacetin (glyceryl triacetate) and tributyrin (glyceryl tributyrate).

(f) Oxyacid Esters methyl acetylricinolate, butyl acetylricinolate, butylphthalylbutyl glycolate and tributyl acetylcitrate.

(g) Epoxy Compounds:

epoxidized soybean oil, epoxidized linseed oil, butyl epoxystearate, decyl epoxystearate, octyl epoxystearate, benzyl epoxystearate, dioctyl epoxyhexahydrophthalate and didecyl epoxyhexahydrophthalate.

(h) Dihydric Alcohol Esters:

diethylene glycol dibenzoate and triethylene glycol di-2-ethylbutyrate.

(i) Chlorine-containing Compounds:

chlorinated paraffin, chlorinated diphenyl, methyl esters of chlorinated fatty acids and methyl esters of methoxychlorinated fatty acids.

(j) Polyester Compounds polypropylene adipate, polypropylene sebacate, polyesters, acetylated polyesters.

(k) Sulfonic Acid Derivatives p-toluenesulfonamide, o-toluenesulfonamide, p-toluenesulfonethylamide, o-toluenesulfonethylamide, toluenesulfone-N-ethylamide and p-toluenesulfone-N-cyclohexylamide.

(l) Citric Acid Derivatives:

triethyl citrate, triethyl acetylcitrate, tributyl citrate, tributyl acetylcitrate, tri-2-ethylhexyl acetylcitrate and n-octyldecyl acetylcitrate.

(m) Other Compounds:

terphenyl, partially hydrogenated phenyl, camphor, 2-nitrodiphenyl, dinonylnaphthalene and methyl abietate.

The UV absorbents for use in the individual layers include, but are not limited to, following compounds (a) to (f):

(a) Benzophenone Compounds:

2-hydroxybenzophenone, 2,4-dihydroxybenzophenone, 2,2',4-trihydroxybenzophenone, 2,2',4,4'-tetrahydroxybenzophenone and 2,2'-dihydroxy-4-methoxybenzophenone.

(b) Salicylate Compounds:

phenyl salicylate and 2,4-di-t-butylphenyl-3,5-di-t-butyl-4-hydroxybenzoate.

(c) Benzotriazole Compounds:

(2'-hydroxyphenyl)benzotriazole, (2'-hydroxy-5'-methylphenyl)benzotriazole and (2'-hydroxy-3'-t-butyl-5'-methylphenyl)-5-chlorobenzotriazole.

(d) Cyanoacrylate Compounds:

ethyl-2-cyano-3,3-diphenyl acrylate and methyl-2-carbomethoxy-3-(para-methoxy) acrylate.

(e) Quenchers (Metal Complexes):

nickel [2,2'-thiobis(4-t-octyl)phenolate]-n-butylamine, nickel dibutyldithiocarbamate and cobalt dicyclohexyldithiophosphate.

(f) HALS (Hindered Amines):

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetramethylpyridine, 8-benzyl-7,7,9,9-tetramethyl-3-octyl-1,3,8-triazaspiro[4,5]undecane-2,4-dione and 4-benzoyloxy-2,2,6,6-tetramethylpiperidine.

The electrophotographic apparatus for use in the present invention will be illustrated in detail with reference to the drawings.

FIG. 1 is a schematic view illustrating an example of the electrophotographic apparatus of the present invention, and modifications thereof as mentioned below are also in the scope of the present invention.

With reference to FIG. 1, a photoconductor 11 is an electrophotographic photoconductor of the present invention which comprises a surface top layer. The photoconductor 11 is in the form of a drum as shown in FIG. 1, but may be a sheet or an endless belt.

Around the photoconductor 11 are arranged a charger 12, an image transfer means 16, charge eliminator 1A, a light irradiating unit 13, a developing units 14, a cleaning unit 17.

The charger 12 may be any conventional one such as a corotron charger, a scorotron charger, a solid state charger, and a charging roller. From the standpoint of reduction of power consumption, a charger capable of disposed in contact with or in close proximity of the photoconductor is suitably used. The latter charger (charging mechanism) arranged in close proximity of the photoconductor, which has an appropriate space between the photoconductor and the surface of the charger, is preferred for preventing the deposition of unnecessary substances on the charger. The image transfer means 16 may include the above charger. It is effective to employ a combination of an image transfer charger with a separating charger.

The light source for the light irradiating unit 13 or the charge eliminator 1A includes, for example, a fluorescent light, tungsten lamp, halogen lamp, mercury vapor lamp, sodium light source, light emitting diode (LED), semiconductor laser (LD), electroluminescence (EL) and other light emitting articles. Further, a desired wavelength can be obtained by use of various filters such as a sharp-cut filter, band-pass filter, a near infrared cut filter, dichroic filter, interference filter, and color conversion filter.

A toner image 15 formed on the photoconductor 11 by the action of the developing means is transferred to an image transfer medium 18. In the image transfer process, not all the toner particles deposited on the photoconductor 11 are transferred to the image transfer medium and some particles remain on the photoconductor 11. The residual toner particles are removed from the photoconductor 11 in the cleaning unit 17. As the cleaning unit (cleaning means) 17, a rubber cleaning blade or a conventional brush such as a fur blush or a magnetic fur brush.

When the photoconductor 11 is positively charged, and exposed to light images, positively-charged electrostatic latent images are formed on the photoconductor. In the similar manner as in above, when a negatively charged photoconductor is exposed to light images, negative electrostatic latent images are formed. A negatively-chargeable toner and a positively-chargeable toner are respectively used for development of the positive electrostatic images and the negative electrostatic images, thereby obtaining positive images. In contrast to this, when the positive electrostatic images and the negative electrostatic images are respectively developed using a positively-chargeable toner and a negatively-chargeable toner, negative images can be obtained on the surface of the photoconductor 11. Not only such development means, but also the charge eliminating means (charge eliminator) may employ the conventional manner.

Figure 2:
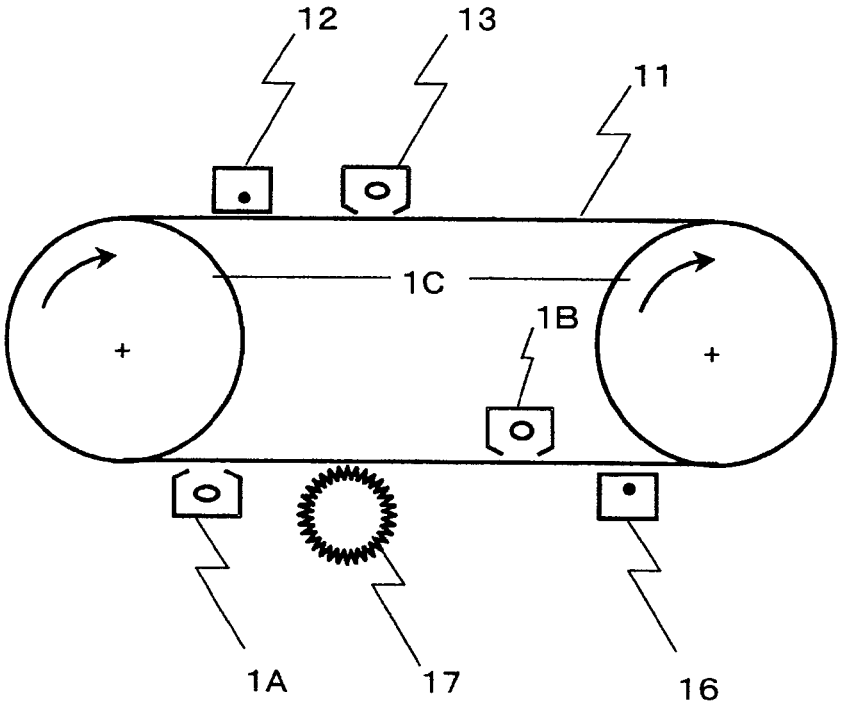
FIG. 2 is a schematic cross-sectional view illustrating an example of an electrophotographic apparatus according to the present invention.

FIG. 2 is a schematic view showing another example of the electrophotographic apparatus according to the present invention. In FIG. 2, a photoconductor 11 is the electrophotographic photoconductor of the present invention, comprising a surface top layer. The photoconductor 11 shown in FIG. 2 is in the form of a belt, but may be a drum, a sheet or an endless belt. The photoconductor 11 is driven by a pair of driving rollers 1C and is successively subjected to charging by a charger 12, exposure by a light irradiating unit 13, development (not shown), image transfer by an image transfer means 16, pre-cleaning light exposure by a pre-cleaning light exposure means, cleaning by a cleaning means 17 and charge elimination (quenching) by a charge eliminator 1A. In FIG. 2, the substrate of the photoconductor 11 is optically transmittable, so that it is possible to apply the pre-cleaning light to the photoconductor 11 from the substrate.

The above-discussed electrophotographic apparatuses exemplify embodiments of the present invention and any other embodiments will do. For example, the pre-cleaning light is applied from the substrate side of the photoconductor 11, but the photoconductive layer of the photoconductor 11 may be exposed to the pre-cleaning light. Likewise, the image exposure light and the charge elimination lamp may be arranged so that light is directed toward the electroconductive substrate side of the photoconductor 11. The photoconductor 11 is exposed to light using the image exposure light, pre-cleaning light, and the charge elimination lamp, as illustrated in FIG. 2. In addition to the above, light exposure may be carried out, for example, before image transfer, and before image exposure according to any conventional light irradiation process.

Figure 3:
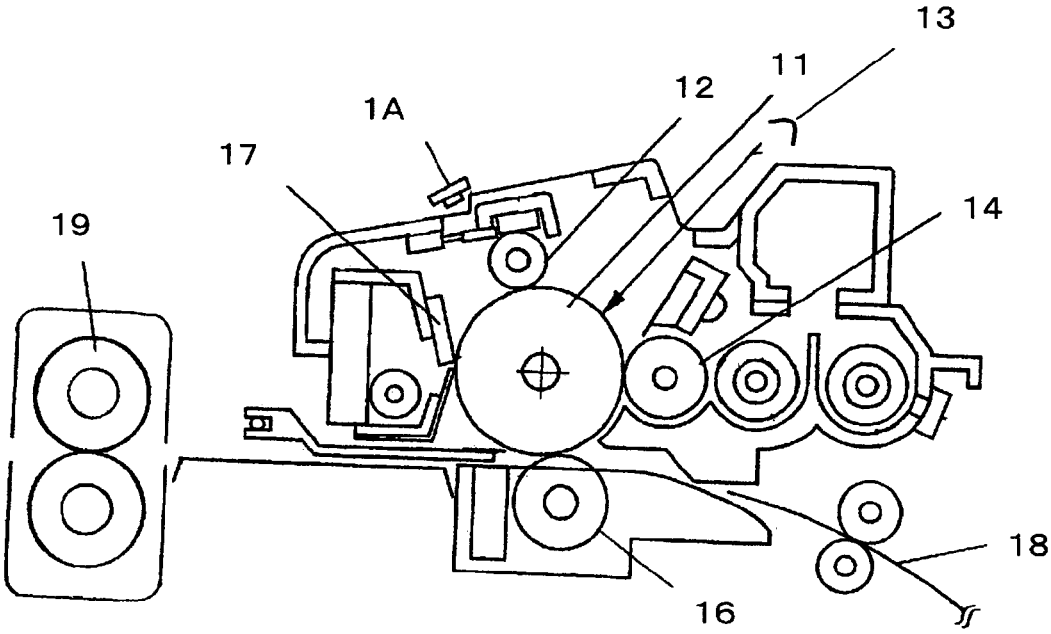
FIG. 3 is a schematic cross-sectional view illustrating an example of an electrophotographic apparatus according to the present invention.

The above-mentioned image forming units may be independently fixed in, for example, a copying machine, a facsimile machine or a printer. Alternatively, they may be incorporated in a process cartridge and be the attached to the apparatus. The process cartridge may have any configuration. A general example of the process cartridge is shown in FIG. 3. A photoconductor 11 herein is in the form of a drum, but may be a sheet or an endless belt.

Figure 4:
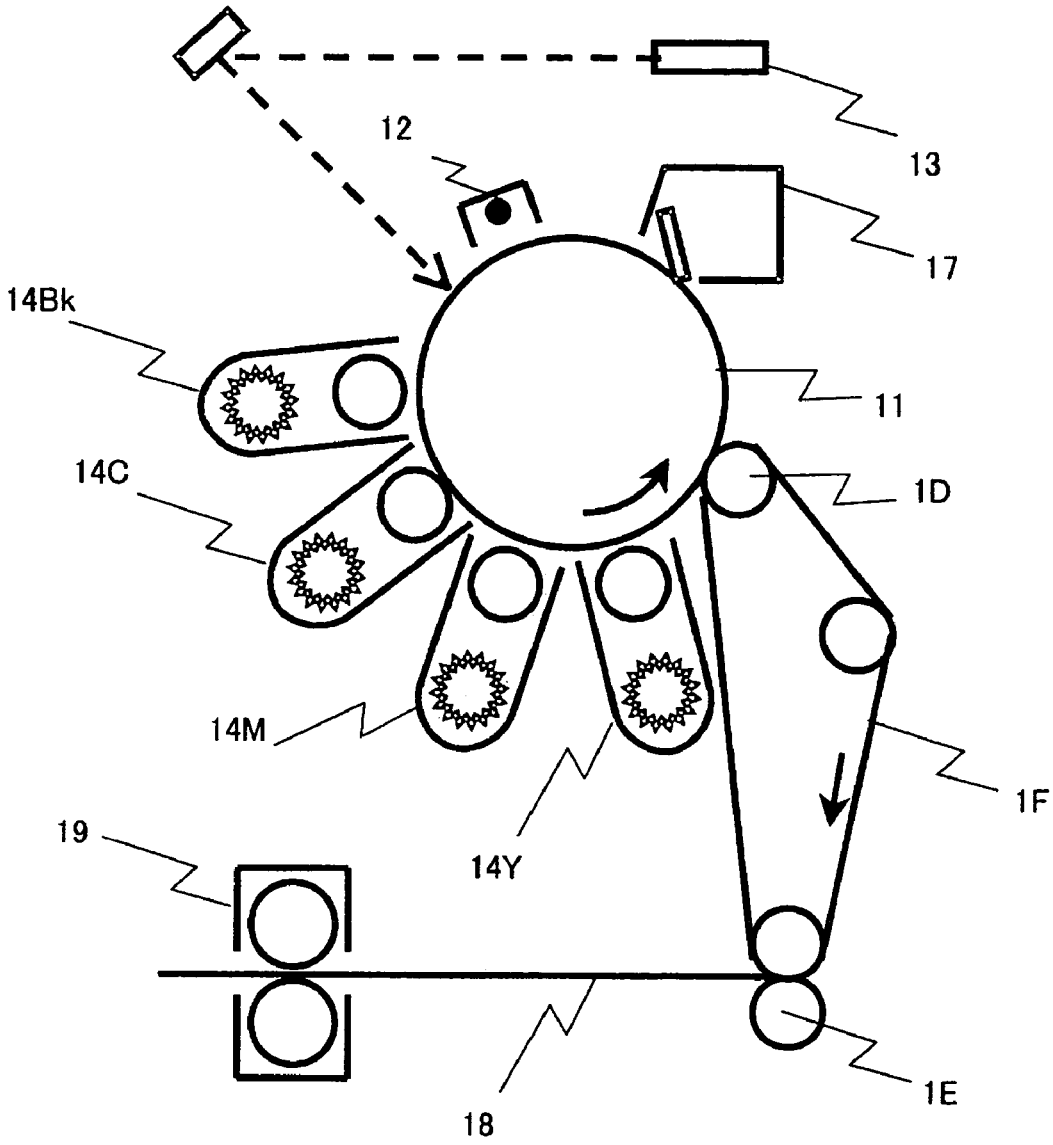
FIG. 4 is a schematic cross-sectional view illustrating an example of an electrophotographic apparatus according to the present invention.

FIG. 4 shows another embodiment of the electrophotographic apparatus according to the present invention. The electrophotographic apparatus comprises a photoconductor 11, around which a charger 12, a light irradiating unit 13, developing units 14Bk, 14C, 14M and 14Y containing a black (Bk) toner, a cyan (C) toner, a magenta (M) toner, and a yellow (Y) toner, respectively, an intermediate image transfer belt 1F serving as an intermediate image transfer member, and a cleaning means 17 are sequentially arranged. In the figure, the subscripts Bk, C, M and Y correspond to the colors of the toners, respectively, and are indicated or omitted according to necessity. The photoconductor 11 is the electrophotographic photoconductor of the present invention, comprising a surface top layer. The developing units 14Bk, 14C, 14M and 14Y are controllable independently and are selectively operated according to the desired color to be produced. A toner image on the photoconductor 11 is transferred to the intermediate transfer belt 1F by means of a first image transfer means 1D disposed inside the belt 1F. The first image transfer means 1D is arranged so as to urge the belt 1F to be brought into contact with the photoconductor 11 only at the transfer stage. Formation processes of the individual colors are sequentially carried out, and the resulting overlaid toner images on the intermediate image transfer belt 1F are transferred to an image transfer medium 18 by the action of a second image transfer means 1E in one step, are then fixed by the action of an image-fixing means 19 to form an image. The second image transfer means 1E is also arranged so as to urge the intermediate image transfer belt 1F to be brought in contact with the photoconductor 11 only at the image transfer step.

In an electrophotographic apparatus using an image transfer drum, toner images of individual colors are sequentially transferred to an image transfer member electrostatically attached to an image transfer drum, and full-color images cannot be formed on a thick, rigid member such as thick paper. However, in the electrophotographic apparatus using an intermediate image transfer system as shown in FIG. 4, toner images of individual colors are superimposed on the intermediate image transfer member 1F, and full-color images can be formed even on a thick, rigid member. The intermediate image transfer system can also be applied to the electrophotographic apparatuses shown in FIGS. 1 to 3 and an apparatus shown in FIGS. 5 and 6 mentioned later.

Figure 5:
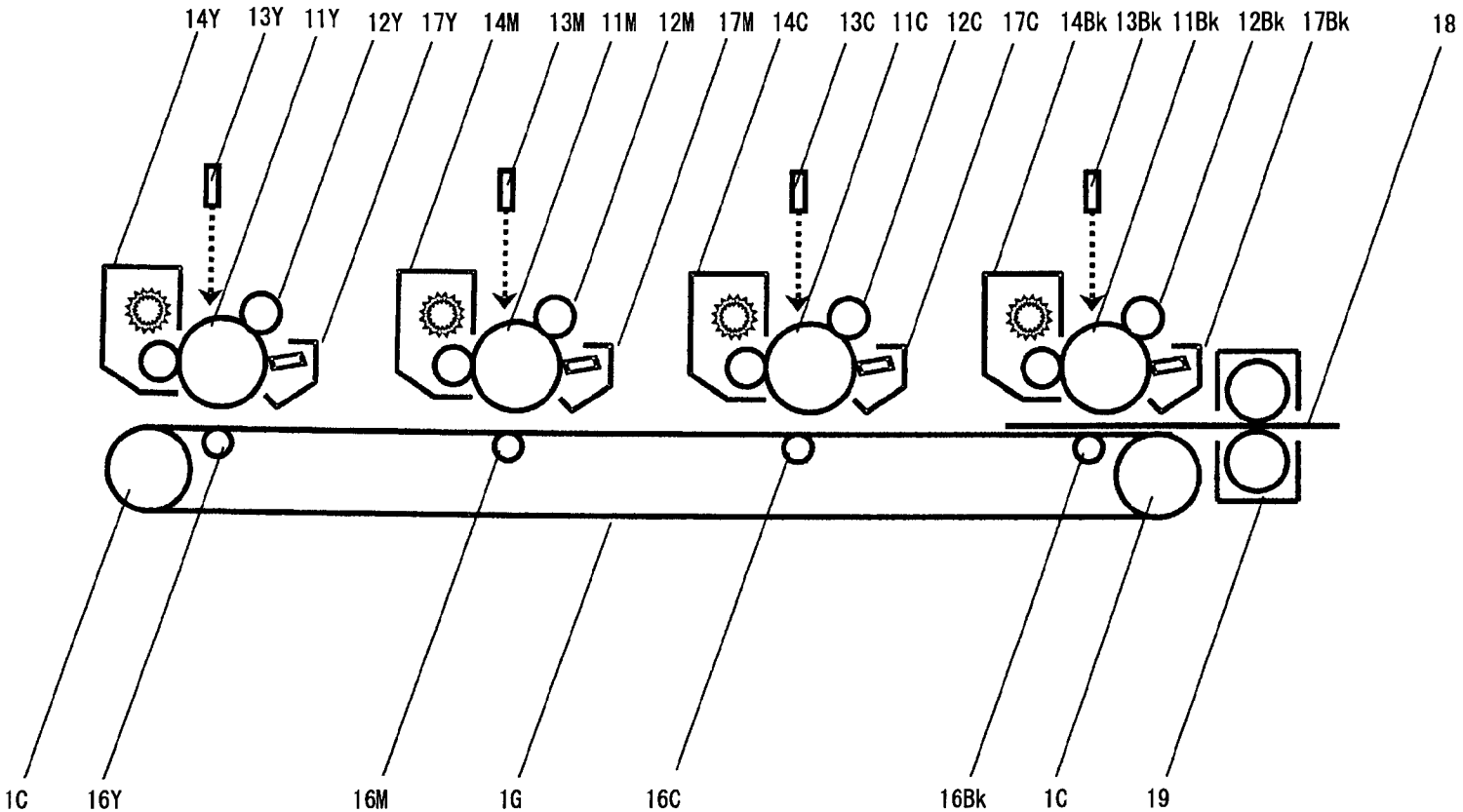
FIG. 5 is a schematic cross-sectional view illustrating an example of an electrophotographic apparatus according to the present invention.
Figure 6:
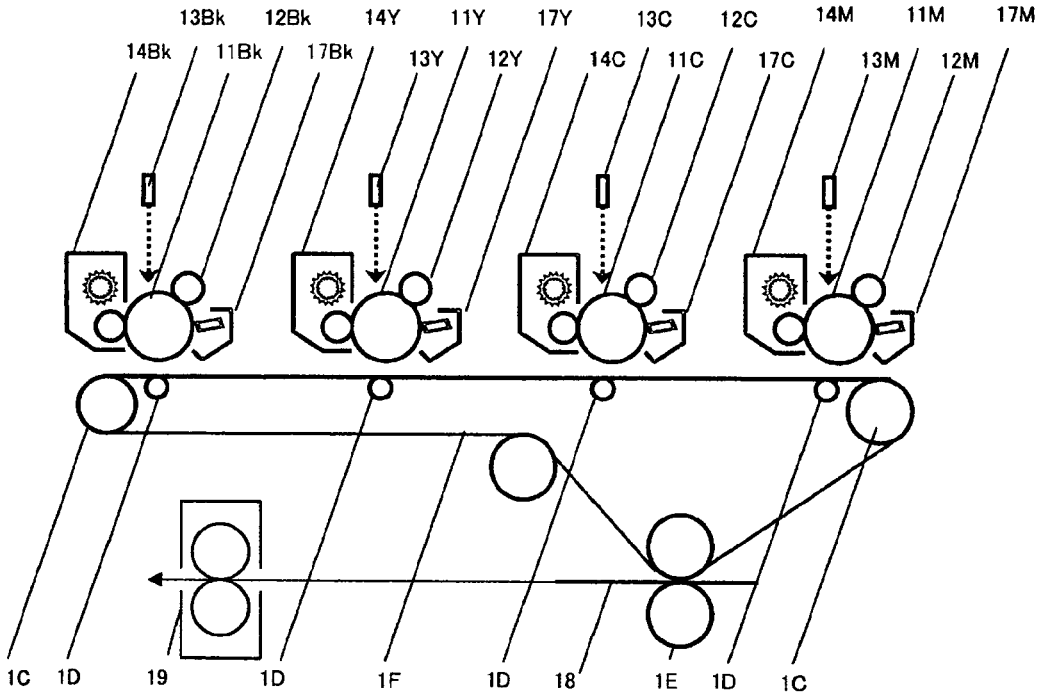
FIG. 6 is a schematic cross-sectional view illustrating an example of an electrophotographic apparatus according to the present invention.

FIG. 5 shows a further embodiment of the electrophotographic apparatus according to the present invention. The electrophotographic apparatus uses four color toners, i.e., yellow (Y), magenta (M), cyan (C) and black (Bk) toners and includes image forming units and photoconductors 11Y, 11M, 11C and 11Bk corresponding to the individual colors. The photoconductors 11Y, 11M, 11C and 11Bk for use in the electrophotographic apparatus are the electrophotographic photoconductors of the present invention each comprising a surface top layer. Around each of the photoconductors 11Y, 11M, 11C and 11Bk are arranged a charger 12, a light irradiating unit 13, a developing unit 14, and a cleaning means 17. An image transfer-transport belt 1G is spanned between a pair of driving means 1C and runs for facing the respective photoconductors 11Y, 11M, 11C and 11Bk arranged linearly. The image transfer-transport serves as an image transfer medium-bearing member which is arranged so as to be brought in contact with the respective photoconductors at image transfer step. An image transfer means 16 is arranged at an image transfer position facing each of the photoconductors 11Y, 11M, 11C and 11Bk with the interposition of the image transfer-transport belt 1G.

The electrophotographic apparatus of a tandem system shown in FIG. 5 comprises the photoconductors 11Y, 11M, 11C and 11Bk of the respective colors, in which toner images of the respective colors are sequentially transferred to the image transfer medium 18 supported by the image transfer-transport belt 1G, and provides high speed image formation as compared with a full color electrophotographic apparatus having only one photoconductor.

EXAMPLES

The present invention will be illustrated in further detail with reference to several examples below, which are not intended to limit the scope of the present invention.

Test methods employed in the examples are as follows.

(1) Differential Scanning Calorimetry (DSC)

The DSC curve of a sample surface top layer was determined according to a conventional procedure using a differential scanning calorimeter (Thermo Plus DSC 8230, available from Rigaku Corporation). A first scan data was employed as the DSC curve. A test sample was prepared by adding a coating composition for a surface top layer dropwise to an open aluminum pan and subjecting to the same thermal hysteresis as in the preparation of a photoconductor.

(2) Infrared Absorption Spectrum

The transmission spectrum at 500 $cm^{-1}$ to 4000 $cm^{-1}$ of a sample was determined according to an attenuated total reflection (ATR) method using a FT-IR NEXUS 470 (Thermo Electron Corporation) equipped with a genuine accessory (OMNI-Sampler). Upon the determination of the transmission spectrum, a base line between peaks without absorption may undergo offset. The transmittance in a portion without absorption was set at 100% by subtracting the offset from the total transmittance. In the resulting transmission spectrum, the minimum transmittance at wavenumbers of 3200 $cm^{-1}$ to 3800 $cm^{-1}$ was defined as "IR minimum transmittance" herein for the sake of convenience.

(3) Time Dependency in Transit Time in Actual Use of Photoconductor

The evaluation apparatus for determining the properties of a photoconductor disclosed in JP-A No. 2000-275872 incorporated herein by reference was used to determine a change of the potential of an exposed portion (VL) with time (i.e., the relationship between the potential of an exposed portion and the exposure-development time interval (Ted)) and the transit time in actual use.

The determination conditions are as follows.

Linear velocity of photoconductor: 160 mm/s

Resolution in the sub-scanning direction: 400 dpi power of light on the image forming surface: 0.30 mW (light exposure: 0.4 $\mu J/cm^2$)

Charge eliminator: operated

Charger: controlled so that the potential of the photoconductor stands at −800V

The angle of a probe of the surface potential meter with respect to the exposure station was changed to change the exposure-development time interval (Ted).

(4) Work of Adhesion and Surface Free Energy

A test sample of a toner component of a developing agent for contact angle determination was prepared by pressing and molding the toner component into a disc using a pelletizing tablet-making machine. A test sample of a binder resin mixture for contact angle determination was prepared by applying the binder resin mixture to an aluminum plate, and heating and drying the applied film at 150° C. for 30 minutes.

The contact angles of these samples were determined by using an Automatic Contact Angle Meter CA-W (Kyowa Interface Science Co., Ltd.). Ion-exchanged water, methylene iodide and α-bromonaphthalene were used as referential materials.

The work of adhesion W between the sample and each of the referential materials was determined according to following Equation 2 using the measured contact angle with respect to each of the referential materials, and the surface free energy γ of the referential material as described by Yasuaki Kitazaki and Toshio Hata in Journal of The Adhesive Society of Japan, 8(3), 131-141 (1972) as shown in Table 1

TABLE 1

| Referential material (liquid) | γ (mN/m) | $\gamma^a$ (mN/m) | $\gamma^b$ (mN/m) | $\gamma^c$ (mN/m) |
|---|---|---|---|---|
| Ion-exchanged water | 72.8 | 29.1 | 1.3 | 42.4 |
| α-Bromonaphthalene | 44.6 | 44.4 | 0.2 | 0 |
| Methylene chloride | 50.8 | 46.8 | 4.0 | 0 |

$$W_{Solid\ Liquid}=\gamma_{Liquid}(1+\cos\theta) \quad \text{Equation 2:}$$

Next, simultaneous equations are set up using the works of adhesion W between the sample and methylene iodide or α-bromonaphthalene, and following Equation 3:

$$W_{12}=2\sqrt{\gamma_1^a\cdot\gamma_2^a}+2\sqrt{\gamma_1^b\cdot\gamma_2^b}+2\sqrt{\gamma_1^c\cdot\gamma_2^c} \quad \text{Equation 3:}$$

In the equation, the data described in the above reference are used as $\gamma_1^a$ and $\gamma_1^b$ of the referential materials.

This calculation leads to $\sqrt{\gamma^a}$ and $\sqrt{\gamma^b}$ of the sample.

Next, $\sqrt{\gamma^c}$ of the sample was determined according to Equation 2 using the work of adhesion between ion-exchanged water and the sample photoconductor.

The surface free energy γ of the sample photoconductor was determined by calculation according to following Equation 4 using the resulting $\sqrt{\gamma^a}$, $\sqrt{\gamma^b}$ and $\sqrt{\gamma^c}$.

$$\gamma=\gamma^a+\gamma^b+\gamma^c \quad \text{Equation 4:}$$

The works of adhesion of the toner component of the developing agent and the binder resin were determined by substituting the above-obtained values into Equation 3.

(5) Ionization Potential

Coating compositions for charge transport layer or for surface top layer having compositions mentioned below were prepared. Each of the coating compositions was applied to an aluminum plate having a smooth surface and was dried to yield samples for determination of ionization potential. The ionization potential was determined in the atmospheric environment with a UV photoelectric analyzer AC-1 (Riken Keiki Co., Ltd.). The measured ionization potentials of the resin films were defined as the charge transporting materials in the charge transport layer and the surface top layer, respectively.

(6) Thickness of Photoconductive Layer (The thickness of a photoconductive layer was measured with an eddy current type thickness measuring apparatus FISHER SCOPE MMS (manufactured by Fischer Inc.). The thickness was measured at a plurality of points of the photoconductive layer spaced at intervals of 1 cm in the longitudinal direction of the photoconductor. The average of the measured values represents the thickness of the photoconductive layer.

(7) Charge Mobility

A coating composition for a charge transport layer having a composition mentioned later was applied onto an aluminum-deposited poly(ethylene terephthalate) film to yield a coating having a thickness of 10 μm. On the coating was then deposited a gold electrode having a thickness of 200 angstroms to yield a sample cell for the determination of charge mobility.

The charge mobility of a charge transporting material was measured in accordance with the time-of-flight method. A negative voltage was previously applied to the gold electrode. Nitrogen gas laser light was then applied to the sample from the gold electrode side, while recording, with a digital oscilloscope, the change of potential with time caused by photocurrent flowing through an inserted resistor disposed between the aluminum electrode and the ground. On the waveform thus obtained, two tangential lines were drawn to determine the transit time t as the intersection of the two lines. On inference of the waveform being in a dispersion type, Log t-Log V plotting was performed from the waveform and two tangential lines were drawn to determine the transit time t as the intersection of the two lines. The charge mobilities μ were determined from following Equation 5.

The charge mobile time was determined based on the charge mobility.

$$\mu=L^2/(V*t) \quad \text{Equation 5:}$$

wherein L represents the sample thickness; t is the transit time; and V represents the applied voltage.

The determination was carried out at 25° C. under 50% relative humidity condition.

(8) Surface Roughness of Photoconductor

The waviness parameter Sm (according to Japanese Industrial Standards (JIS)-1982, the average length between a concave portion and a convex portion) of a surface of a sample photoconductor in the form of a drum was determined with a probe surface roughness analyzer Surfcom (Tokyo Seimitsu Co., Ltd.) equipped with a pickup E-DT-S02A (Tokyo Seimitsu Co., Ltd.).

(9) Taber Abrasion Test

A polyamide (CM 8000; Toray Corporation) was applied to an aluminum plate having a smooth surface to form an adhesive layer about 0.7 μm thick. A coating composition having a composition mentioned below was applied to the adhesive layer to yield a surface top layer 13 μm thick, to thereby yield a sample of a Taber abrasion test. The abrasion test was carried out using a Rotary Abrasion Tester (Toyo Seiki Seisaku-Sho, Ltd.) and CS-5, CS-10 and CS-17 wear rings at a rotation speed of the turn table of 60 rpm and under a load of 250 gf. The test procedure was repeated a total of three times. The average of the weight losses per 1000 revolutions (Taber wear index) was defined as the abrasion loss (mg).

As the surface roughness, the surface profile of the sample after the Taber abrasion test was determined using an ultradeep profile analyzing microscope VK-8500 (Keyence Corporation) equipped with a 100× objective lens at a scanning depth of 5 μm at intervals of 0.01 μm. The average surface roughness (Ra) was determined by calculation using an attached analyzing software.

(10) Image Blur

Ten copies of a dotted image with an image density of 5% at a dot density of 600 dpi by 600 dpi were successively produced after the completion of the endurance test. The dot shapes of the produced images were observed with a stereoscopic microscope. The image blur in the produced images was determined as the sharpness of the outline of the images at five ranks according the following criteria.

5: The image has a clear outline and is good.

4: The image has a very slightly blurred outline but is good.

3: The image has a slightly blurred outline but is substantially good.

2: The image has a blurred outline, which may become a problem in some images.

1: Doted images cannot be distinguished.

(11) Image Lag

A pattern comprising a black solid pattern with an image density of 0.8 and a halftone pattern with an image density of 0.5 arranged in alternate orders was produced at a dot density of 600 dpi by 600 dpi after the completion of the endurance test. The image lag of the produced image was determined by whether or not the image lag of the black solid pattern was observed in the halftone pattern at five ranks according to the following criteria.

5: The image shows no image lag and is good.

4: The image shows a trace image lag but is good.

3: The image shows a very slight image lag but is substantially good.

2: The image shows a slight image lag but is substantially trivial.

1: The image shows a considerable image lag and has a problem.

(12) Damage on Cleaning Blade

After the completion of the endurance test, a cleaning blade was taken out from the tested apparatus, and the edge faces of the cleaning blade was observed from immediately above and immediately side using an ultradeep profile analyzing microscope VK-8500 (Keyence Corporation) equipped with a 100× objective lens at a scanning depth of 5 μm at intervals of 0.01 μm The damage on the cleaning blade was graded at five ranks according to the following criteria.

5: The cleaning blade shows no chip in blade edge and is good.

4: The cleaning blade shows a trace chip in blade edge but is good.

3: The cleaning blade shows a very slight chip in blade edge but is substantially good.

2: The cleaning blade shows a slight chip in blade edge but is substantially of no problem.

1: The cleaning blade shows a considerable chip in blade edge and thereby has a problem.

(13) Surface Potential of Photoconductor

A modified development unit equipped with a probe of a surface potentiometer (electrostatic voltmeter) Trek MODEL 344 (Trek Incorporation) was attached to a development part of a copying machine. The surface potential at the center part of a sample photoconductor was determined.

Example 1

The following coating composition for a undercoat layer, coating composition for a charge generation layer, coating composition for a charge transport layer were sequentially applied and dried to form an undercoat layer 3 μm thick, a charge generation layer 0.3 μm thick and a charge transport layer 20 μm thick on an aluminum drum having a wall thickness of 0.8 mm and a diameter of 30 mm. Next, a coating composition for a surface top layer was applied to the charge transport layer by spray coating to form a surface top layer 0.95 μm thick. Thus, an electrophotographic photoconductor according to the present invention was prepared.

| [Coating Composition for Undercoat Layer] | |
|---|---|
| Alkyd resin (Beckolite M6401-50, available from Dainippon Ink and Chemicals Inc.) | 12 parts by weight |
| Melamine resin (Super Beckamine G-821-60, available from Dainippon Ink and Chemicals Inc.) | 8 parts by weight |
| Titanium oxide (CR-EL, available from Ishihara Sangyo Kaisha, Ltd.) | 40 parts by weight |
| Methyl ethyl ketone | 200 parts by weight |
| [Coating Composition for Charge Generation Layer] | |
| Bisazo pigment having the following structure (available from Ricoh Company Limited) | 5 parts by weight |

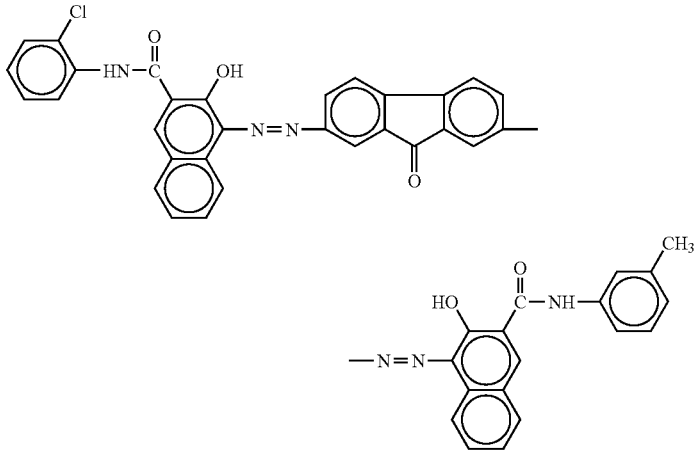

| | |
|---|---|
| Poly(vinyl butyral)s (XYHL, available from Union Carbide Corporation) | 1 part by weight |
| Cyclohexanone | 200 parts by weight |
| Methyl ethyl ketone | 80 parts by weight |
| [Coating Composition for Charge Transport Layer] | |
| Polycarbonate resin (Panlite TS-2050, available from Teijin Kasei Inc.) | 10 parts by weight |
| Low-molecular charge transporting material having the following structure | 7 parts by weight |

-continued

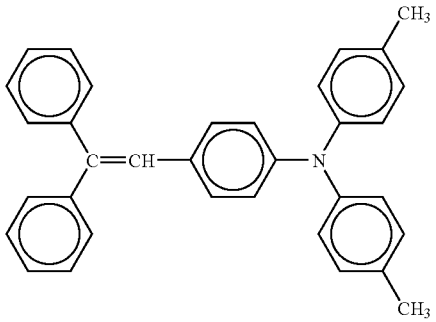

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |
| [Coating Composition for Photoconductor Surface Top Layer] | |
| Thermosetting surfactant (Modiper F200, available from NOF Corporation) | 10 parts by weight (solid content: 3 parts by weight) |
| Thermosetting resin monomer (melamine resin) (Super Beckamine L-145-60, available from Dainippon Ink and Chemicals Inc.) | 12 parts by weight (solid content: 7.2 parts by weight) |
| Tetrahydrofuran | 180 parts by weight |
| Cyclohexanone | 50 parts by weight |

To determine curing temperature of a surface top layer, the coating composition for a surface top layer was cured at a varying heating temperature. The resulting resin films were subjected to differential scanning calorimetry at temperatures from room temperature to 250° C.

A resin film as a surface top layer prepared by curing the coating composition for a surface top layer at 170° C. for 30 minutes shows no endothermic peak in a DSC curve. Then, the curing condition was set at 170° C. for 30 minutes.

No peak with a minimum transmittance of less than 95% was observed in an infrared absorption spectrum of the surface top layer determined by the above-mentioned method.

Comparative Example 1

An electrophotographic photoconductor was prepared by the procedure of Example 1, except that no surface top layer was formed.

Comparative Example 2

An electrophotographic photoconductor was prepared by the procedure of Example 1, except for curing the surface top layer at 110° C. for 30 minutes.

The resin film prepared by curing the coating composition for a surface top layer showed an endothermic peak in a DSC curve.

No peak with a minimum transmittance of less than 95% was observed in an infrared absorption spectrum of the surface top layer determined by the above-mentioned method.

Comparative Example 3

An electrophotographic photoconductor was prepared by the procedure of Example 1, except for using the following coating composition for a surface top layer and curing the composition at 150° C. for 30 minutes.

[Coating Composition for Photoconductor Surface Top Layer]

| | |
|---|---|
| Thermosetting resin monomer (base resin) (HEATLESS GLASS GS-600-1BN (base resin), available from Ohashi Chemical Industries Ltd.) | 10 parts by weight |
| Thermosetting resin monomer (curative agent) (HEATLESS GLASS GS-600-1BN(curative agent), available from Ohashi Chemical Industries Ltd.) | 1 part by weight |
| Methyl isobutyl ketone | 30 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 $cm^{-1}$).

[Spray Coating Conditions in Example 1 and Comparative Examples 1 to 3]

| | |
|---|---|
| Discharge amount of coating composition: | 10 ml/min |
| Discharge pressure of coating composition: | 2.4 $kgf/cm^2$ |
| Number of revolutions of drum to be coated: | 120 rpm |
| Coating speed: | 28 mm/sec |
| Distance between spray head and drum to be coated: | 5 cm |
| Repetitive number of coating procedure: | 1 |

Each of the electrophotographic photoconductors prepared according to Example 1, and Comparative Examples 1 to 3 was adjusted for actual use and was installed in an electrophotographic apparatus (IPSiO Color 8000, available from Ricoh Company Limited). Each five copies of a text image and a graphic image with an image density of 5% were continuously produced at a dot density of 600 dpi by 600 dpi for a total of 20000 copies on copying paper (TYPE 6000, A4T, available from Ricoh Company Limited).

A genuine product was used as a toner, and a developing agent contained in a genuine developing agent unit was used as intact as the developing agent.

A charging roller arranged in close proximity of the electrophotographic photoconductor was used as a charger for the electrophotographic apparatus.

The AC component of the voltage applied to the charging roller was set at a peak-to-peak voltage of 1.5 kV at a frequency of 0.9 kHz. A bias in the DC component thereof was set so that the initial charge potential at the beginning of the test stands at −700 V, and the test was carried out under this charging condition. The development bias was set at −500 V. This apparatus comprises no charge-eliminating means. A genuine cleaning blade was used as intact as the cleaning means.

The test was carried out at 28° C. and 65% relative humidity.

Ten copies of a dot image with an image density of 5% at a dot density of 1200 dpi by 1200 dpi were successively produced after the completion of the endurance test. The dot shapes of the produced images were observed with a stereoscopic microscope. The image blur in the produced images was determined as the sharpness of the outline of the images at five ranks according the following criteria. In addition, the abrasion loss of the sample photoconductors after the test was determined.

5: The image has a clear outline and is good.

4: The image has a very slightly blurred outline but is good.

3: The image has a slightly blurred outline but is substantially good.

2: The image has a blurred outline, which may become a problem in some images.

1: Doted images cannot be distinguished.

The test results are shown in Table 2.

TABLE 2

| | Endothermic peak in DSC curve of cured surface top layer | IR minimum transmittance (%) | Abrasion loss (μm) | Image quality (rank) |
|---|---|---|---|---|
| Example 1 | absent | 97 | 0.8 | 4 |
| Comp. Ex. 1 | — | — | 3.0 | 4 |
| Comp. Ex. 2 | present | 95 | 2.4 | 3 |
| Comp. Ex. 3 | absent | 92 | 0.8 | 1 |

The photoconductor according to Example 1 has excellent abrasion resistance, produces printed images without problems and exhibits good durability, as compared with photoconductors according to Comparative Examples 1 to 3.

In contrast, the photoconductor according to Comparative Example 1 having no surface top layer shows significant abrasion loss. These results show that the arrangement of a surface top layer comprising a crosslinked resin film is effective for prolonging the life of photoconductors.

However, the abrasion loss in the photoconductor according to Comparative Example 2 after the running test indicates that the abrasion resistance cannot be significantly improved when an uncured portion remains even if a surface top layer comprising a crosslinked resin composition having the same composition as in Example 1 is arranged. In other words, a surface top layer comprising a crosslinked resin film must be so arranged as to avoid curing failure (uncured portions). The presence or absence of an endothermic peak in a DSC curve of a cured film of the surface top layer serves as an indication for determining whether or not the curing failure occurs.

In Comparative Example 3, dot images printed out after the completion of the test have unclear outlines and of poor quality. This result indicates that the mere arrangement of a surface top layer comprising a crosslinkable resin as in Comparative Example 3 is insufficient for prolonging the life of a photoconductor. The surface top layer according to Comparative Example 3 shows a higher light absorption due to hydroxyl groups than the surface top layer according to Example 1, indicating that the former surface top layer contains water. This may cause a decreased surface electrical resistance of the surface top layer and thereby invite image deletion. To avoid this problem, the surface top layer must be prevented from decreasing in surface electrical resistance. The results in Table 2 show that materials having a transmittance of 95% or more at wavenumbers of 3200 $cm^{-1}$ to 3800 $cm^{-1}$ are effective.

These results show that the configuration of Example 1 is effective for prolonging the life of a photoconductor. More specifically, it is important that (1) a surface top layer comprising a crosslinkable resin film must be arranged, (2) the cured film of the surface top layer must be cured under such conditions that no endothermic peak is observed in a DSC curve of the cured film, and (3) the surface top layer must have a transmittance of 95% or more at wavenumbers of 3200 $cm^{-1}$ to 3800 $cm-^{1}$.

Example 2

The following coating composition for a undercoat layer, coating composition for a charge generation layer, coating composition for a charge transport layer were sequentially applied and dried to form an undercoat layer 3.5 μm thick, a charge generation layer 0.4 μm thick and a charge transport layer 20 μm thick on an aluminum drum having a wall thickness of 0.8 mm and a diameter of 100 mm. Next, a coating composition for a surface top layer was applied to the charge transport layer by spray coating to form a surface top layer 2 μm thick. Thus, an electrophotographic photoconductor according to the present invention was prepared.

[Coating Composition for Undercoat Layer]

| | |
|---|---|
| Alkyd resin (Beckosol 1307-60-EL, available from Dainippon Ink and Chemicals Inc.) | 10 parts by weight |
| Melamine resin (Super Beckamine G-821-60, available from Dainippon Ink and Chemicals Inc.) | 7 parts by weight |
| Titanium oxide (CR-EL, available from Ishihara Sangyo Kaisha, Ltd.) | 40 parts by weight |
| Methyl ethyl ketone | 200 parts by weight |

-continued

| | |
|---|---|
| [Coating Composition for Charge Generation Layer] | |
| Titanyl phthalocyanine (available from Ricoh Company Limited) | 20 parts by weight |
| Polyvinyl alcohol (S-LEC B BX-1, available from Sekisui Chemical Co., Ltd.) | 10 parts by weight |
| Methyl ethyl ketone | 100 parts by weight |
| [Coating Composition for Charge Transport Layer] | |
| Polycarbonate resin (Panlite TS-2050, available from Teijin Kasei Inc.) | 10 parts by weight |
| Low-molecular charge transporting material having the following structure: | 10 parts by weight |

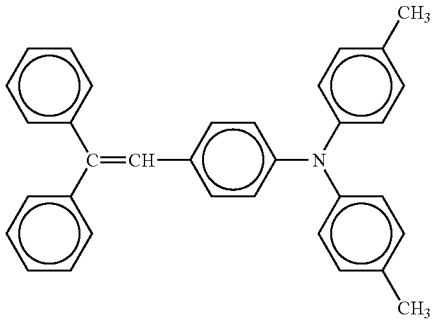

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |
| [Coating Composition for Photoconductor Surface Top Layer] | |
| Crosslinkable charge transporting material having the following structure and containing reactive hydroxyl groups | 3 parts by weight |

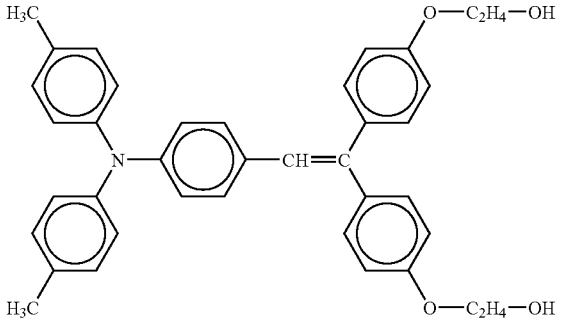

| | |
|---|---|
| Thermosetting surfactant (Modiper F200, available from NOF Corporation) | 10 parts by weight (solid content: 3 parts by weight) |
| Thermosetting resin monomer (melamine resin) (Super Beckamine L-145-60, available from Dainippon Ink and Chemicals Inc.) | 12 parts by weight (solid content: 7.2 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 3

An electrophotographic photoconductor was prepared by the procedure of Example 2, except for using the following coating composition for a surface top layer, repeating the coating procedure of the coating composition a total of eight times to give a surface top layer 8 μm thick.

| [Coating Composition for Photoconductor Surface Top Layer] | |
|---|---|
| Crosslinkable charge transporting material having the following structure and containing reactive hydroxyl groups | 5 parts by weight |

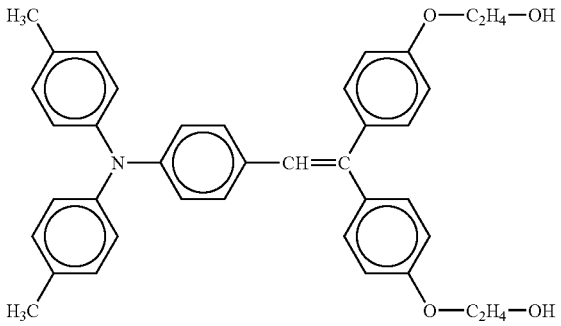

| | |
|---|---|
| Thermosetting surfactant (Modiper F200, available from NOF Corporation) | 10 parts by weight (solid content: 3 parts by weight) |
| Thermosetting resin monomer (melamine resin) (Super Beckamine L-145-60, available from Dainippon Ink and Chemicals Inc.) | 12 parts by weight (solid content: 7.2 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 4

An electrophotographic photoconductor was prepared by the procedure of Example 2, except for using the following coating composition for a surface top layer.

[Coating Composition for Photoconductor Surface Top Layer]

| | |
|---|---|
| Thermosetting surfactant (Modiper F200, available from NOF Corporation) | 10 parts by weight (solid content: 3 parts by weight) |
| Thermosetting resin monomer (melamine resin) (Super Beckamine L-145-60, available from Dainippon Ink and Chemicals Inc.) | 12 parts by weight (solid content: 7.2 parts by weight) |
| Tetrahydrofuran | 180 parts by weight |
| Cyclohexanone | 50 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

[Spray Coating Conditions for Photoconductor Surface Top Layer in Examples 2 and 4]

| | |
|---|---|
| Discharge amount of coating composition: | 10 ml/min |
| Discharge pressure of coating composition: | 2.4 kgf/cm$^2$ |
| Number of revolutions of drum to be coated: | 120 rpm |
| Coating speed: | 28 mm/sec |
| Distance between spray head and drum to be coated: | 5 cm |
| Repetitive number of coating procedure: | 2 |

[Spray Coating Conditions for Photoconductor Surface Top Layer in Example 3]

| | |
|---|---|
| Discharge amount of coating composition: | 10 ml/min |
| Discharge pressure of coating composition: | 2.4 kgf/cm$^2$ |
| Number of revolutions of drum to be coated: | 120 rpm |
| Coating speed: | 28 mm/sec |
| Distance between spray head and drum to be coated: | 5 cm |
| Repetitive number of coating procedure: | 8 |

Example 5

An electrophotographic photoconductor was prepared by the procedure of Example 4, except for caring out the coating procedure of the coating composition for a surface top layer only once to thereby give a surface top layer 1 μm thick.

No peak with a minimum transmittance of less than 95% was observed in an infrared absorption spectrum of the surface top layer determined by the above-mentioned method.

[Spray Coating Conditions for Photoconductor Surface Top Layer in Example 5]

| | |
|---|---|
| Discharge amount of coating composition: | 10 ml/min |
| Discharge pressure of coating composition: | 2.4 kgf/cm$^2$ |
| Number of revolutions of drum to be coated: | 120 rpm |
| Coating speed: | 28 mm/sec |
| Distance between spray head and drum to be coated: | 5 cm |
| Repetitive number of coating procedure: | 1 |

Comparative Example 4

An electrophotographic photoconductor was prepared by the procedure of Example 2, except for curing the coating composition for a surface top layer at 110° C. for 30 minutes.

An endothermic peak was observed in a DSC curve of the resulting cured film as the photoconductor surface top layer.

No peak with a minimum transmittance of less than 95% was observed in an infrared absorption spectrum of the surface top layer determined by the above-mentioned method.

Comparative Example 5

An electrophotographic photoconductor was prepared by the procedure of Example 2, except for using the following coating composition for a surface top layer and curing this coating composition at 150° C. for 30 minutes.

[Coating Composition for Photoconductor Surface Top Layer]

| | |
|---|---|
| Thermosetting resin monomer (base resin) (HEATLESS GLASS GS-600-1BN (base resin), available from Ohashi Chemical Industries Ltd.) | 10 parts by weight |
| Thermosetting resin monomer (curative agent) (HEATLESS GLASS GS-600-1BN(curative agent), available from Ohashi Chemical Industries Ltd.) | 1 part by weight |
| Methyl isobutyl ketone | 30 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 cm$^{-1}$).

[Spray Coating Conditions for Photoconductor Surface Top Layer in Comparative Examples 4 and 5]

| | |
|---|---|
| Discharge amount of coating composition: | 10 ml/min |
| Discharge pressure of coating composition: | 2.4 kgf/cm$^2$ |
| Number of revolutions of drum to be coated: | 120 rpm |
| Coating speed: | 28 mm/sec |
| Distance between spray head and drum to be coated: | 5 cm |
| Repetitive number of coating procedure: | 2 |

Each of the electrophotographic photoconductors prepared according to Examples 2 to 5, and Comparative Examples 4 and 5 was adjusted for actual use and was installed in a modified high-speed electrophotographic apparatus (imagio Neo 1050, available from Ricoh Company Limited). In the electrophotographic apparatus, the process time from the image exposure part of the photoconductor to the sleeve of the development means had been modified to 95 msec. Each 999 copies of a text image and a graphic image with an image density of 6% were continuously and alternately produced at a dot density of 600 dpi by 600 dpi for a total of 10000 copies on copying paper (MyPaper A4, available from Ricoh Company Limited). The genuine toner and developing agent for the apparatus were used herein. A scorotron charger mounted to the electrophotographic apparatus was used as intact as the charger. The test was carried out while a circuit (process control) for controlling the process of the electrophotographic apparatus was operated.

The test was carried out at a temperature of 24° C. and relative humidity of 54%.

Upon the completion of the test, abrasion loss of the photoconductors, image blur and image lag were determined. In addition, the transit time in actual use of the photoconductors and the time dependency of the transit time in actual use ($dV_L/dt$) in process times shorter than the transit time in actual use were determined by calculation according to the above-mentioned method.

The results are shown in Table 3.

TABLE 3

| | Transit time (msec) | $dV_L/dt$ (V/msec) before test | $dV_L/dt$ (V/msec) after test | Image lag (rank) | Abrasion loss (μm) | Image blur (rank) |
|---|---|---|---|---|---|---|
| Ex. 2 | 90 | 0.55 | 0.53 | 4 | 0.3 | 4 |
| Ex. 3 | 87 | 0.73 | 0.73 | 2 | 0.3 | 4 |
| Ex. 4 | 110 | 0.79 | 0.78 | 2 | 0.4 | 4 |
| Ex. 5 | 100 | 0.67 | 0.66 | 3 | 0.4 | 4 |
| Comp. Ex. 4 | 90 | 0.55 | 0.53 | 4 | 0.6 | 3 |
| Comp. Ex. 5 | 125 | 0.83 | 0.81 | 1 | 0.1 | 1 |

The photoconductor according to Example 2 has a time dependency of the transit time in actual use ($dV_L/dt$) in process times shorter than the transit time in actual use of 0.7 or less (V/msec). The produced images according to Example 2 are substantially free from image lag and are of high quality.

The photoconductor according to Example 3 has a time dependency of the transit time in actual use ($dV_L/dt$) in process times shorter than the transit time in actual use of more than 0.7 (V/msec) and shows somewhat image lag. The photoconductor according to Example 3 has a thickness of the surface top layer higher than the other photoconductors, indicating that the time dependency of the transit time in actual use is affected by the thickness of the surface top layer.

The photoconductor according to Example 4 has a time dependency of the transit time in actual use ($dV_L/dt$) in process times shorter than the transit time in actual use of more than 0.7 (V/msec) and shows somewhat image lag, as in Example 3. This high time dependency is probably because the photoconductor according to Example 4 does not contain a crosslinkable charge transporting material in the surface top layer.

The photoconductor according to Example 5 comprises a surface top layer having the same composition as but having a thinner thickness than the surface top layer in Example 4. The photoconductor according to Example 5 has a time dependency of the transit time in actual use ($dV_L/dt$) in process times shorter than the transit time in actual use of less than 0.7 (V/msec) and shows substantially no image lag.

The results in Table 3 show that the magnitude of image lag varies at a time dependency of the transit time in actual use of about 0.7 (V/msec), indicating that the surface top layer should preferably have a time dependency less than about 0.7 (V/msec)

These results shows photoconductors for use in high-speed electrophotographic processes at a process time of 95 msec should importantly have a low time dependency of the transit time in actual use to produce high-quality images.

Most of commercially available electrophotographic apparatuses are used in a process time (exposure-development time interval) longer than the transit time in actual use of photoconductors, and the importance of the above requirement is not so widely recognized. However, the process time will possibly become shorter than the transit time in actual use, because such electrophotographic apparatuses become smaller and smaller and electrophotographic processes become faster and faster. Photoconductors having a low time dependency of the transit time in actual use can prevent produced images from adverse effects such as image lag even when they are used in high-speed processes.

To satisfy this requirement, it is effective to incorporate a crosslinkable charge transporting material containing at least one reactive hydroxyl group into the surface top layer as in Example 2, and/or to reduce the thickness of the surface top layer as in Example 5.

Example 6

The following coating composition for a undercoat layer, coating composition for a charge generation layer, coating composition for a charge transport layer were sequentially applied by spray coating and dried to form an undercoat layer 3.5 μm thick, a charge generation layer 0.4 μm thick and a charge transport layer 22 μm thick on an aluminum drum having a wall thickness of 0.8 mm and a diameter of 100 mm. Next, a coating composition for a surface top layer was applied to the charge transport layer by spray coating to form a surface top layer 2.5 μm thick. Thus, an electrophotographic photoconductor according to the present invention was prepared.

| | |
|---|---|
| [Coating Composition for Undercoat Layer] | |
| Alkyd resin (Beckosol 1307-60-EL, available from Dainippon Ink and Chemicals Inc.) | 10 parts by weight |
| Melamine resin (Super Beckamine L-145-60, available from Dainippon Ink and Chemicals Inc.) | 7 parts by weight |
| Titanium oxide (CR-EL available from Ishihara Sangyo Kaisha, Ltd.) | 40 parts by weight |
| Methyl ethyl ketone | 200 parts by weight |
| [Coating Composition for Charge Generation Layer] | |
| Titanyl phthalocyanine (available from Ricoh Company Limited) | 20 parts by weight |
| Polyvinyl alcohol (S-LEC B BX- 1, available from Sekisui Chemical Co, Ltd.) | 10 parts by weight |
| Methyl ethyl ketone | 100 parts by weight |
| [Coating Composition for Charge Transport Layer] | |
| Polycarbonate resin (Panlite TS-2050, available from Teijin Kasei Inc.) | 10 parts by weight |
| Low-molecular charge transporting material having the following structure: | 9.5 parts by weight |

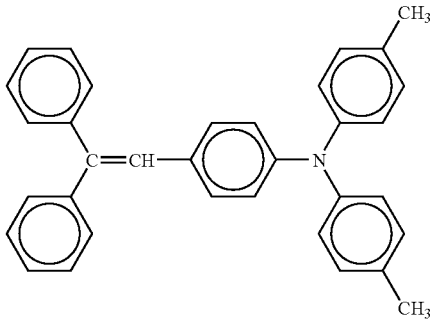

| | |
|---|---|
| Stabilizer having the following structure: | 0.5 part by weight |

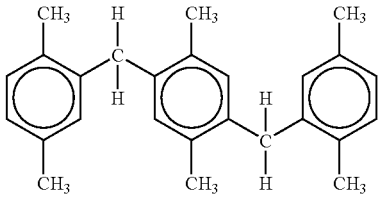

| | |
|---|---|
| Tetrahydrofuran | 79 parts by weight |
| 1% Silicone oil (KF50-100CS, available from Shin-Etsu | 1 part by weight |

-continued

| | |
|---|---|
| Chemical Co., Ltd.) tetrahydrofuran solution | |
| [Coating Composition for Photoconductor Surface Top Layer] | |
| Crosslinkable charge transporting material having the following structure and containing reactive hydroxyl groups | 3 parts by weight |

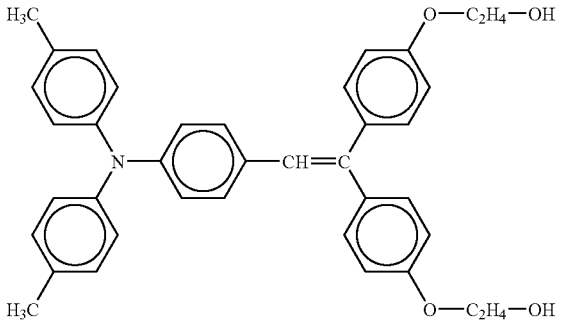

| | |
|---|---|
| Thermosetting resin monomer (melamine resin) (Super Beckamine L-145-60, available from Dainippon Ink and Chemicals Inc.) | 12 parts by weight (solid content: 7.2 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 7

An electrophotographic photoconductor was prepared by the procedure of Example 6, except for using the following coating composition for a surface top layer.

| [Coating Composition for Photoconductor Surface Top Layer] | |
|---|---|
| Crosslinkable charge transporting material having the following structure and containing reactive hydroxyl groups | 3 parts by weight |

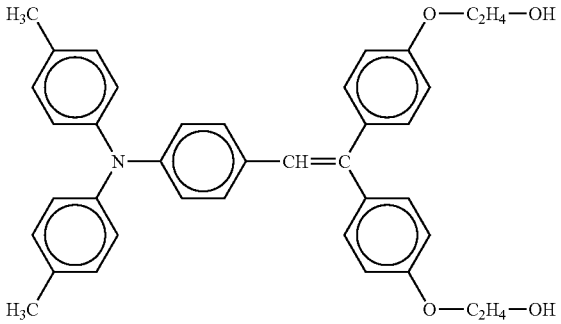

| | |
|---|---|
| Thermosetting resin monomer (melamine resin) (Super Beckamine L-145-60, available from Dainippon Ink and Chemicals Inc.) | 12 parts by weight (solid content: 7.2 parts by weight) |
| Thermosetting surfactant (hydrophobic resin ZX-007C, available from Fuji Kasei Kogyo Co., Ltd.) | 2 parts by weight (solid content: 0.7 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 8

An electrophotographic photoconductor was prepared by the procedure of Example 6, except for using the following coating composition for a surface top layer.

| [Coating Composition for Photoconductor Surface Top Layer] | |
|---|---|
| Crosslinkable charge transporting material having the following structure and containing reactive hydroxyl groups | 3 parts by weight |

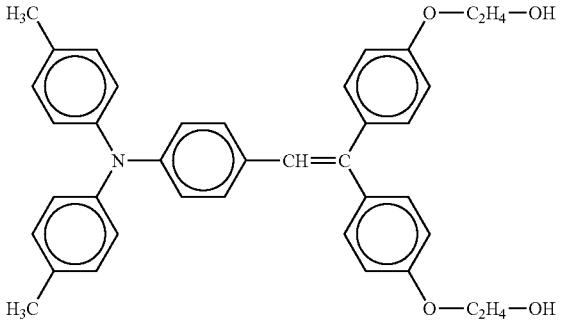

| | |
|---|---|
| Thermosetting resin monomer (melamine resin) (Super Beckamine L-145-60, available from Dainippon Ink and Chemicals Inc.) | 8.2 parts by weight (solid content: 4.9 parts by weight) |
| Thermosetting surfactant (hydrophobic resin ZX-007C, available from Fuji Kasei Kogyo Co., Ltd.) | 5.7 parts by weight (solid content: 2.1 part by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 9

An electrophotographic photoconductor was prepared by the procedure of Example 6, except for using the following coating composition for a surface top layer.

| [Coating Composition for Photoconductor Surface Top Layer] | |
|---|---|
| Crosslinkable charge transporting material having the following structure and containing reactive hydroxyl groups | 3 parts by weight |

-continued

| [Coating Composition for Photoconductor Surface Top Layer] | |
|---|---|
| 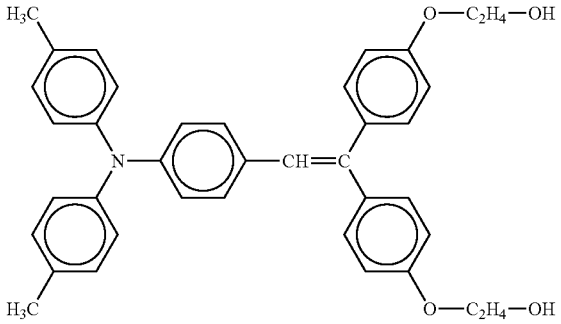 | |
| Thermosetting resin monomer (melamine resin) (Super Beckamine L-145-60, available from Dainippon Ink and Chemicals Inc.) | 5.8 parts by weight (solid content: 3.5 parts by weight) |
| Thermosetting surfactant (hydrophobic resin ZX-007C, available from Fuji Kasei Kogyo Co., Ltd.) | 10 parts by weight (solid content: 3.5 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 10

An electrophotographic photoconductor was prepared by the procedure of Example 6, except for using the following coating composition for a surface top layer.

| [Coating Composition for Photoconductor Surface Top Layer] | |
|---|---|
| Crosslinkable charge transporting material having the following structure and containing reactive hydroxyl groups | 3 parts by weight |
| 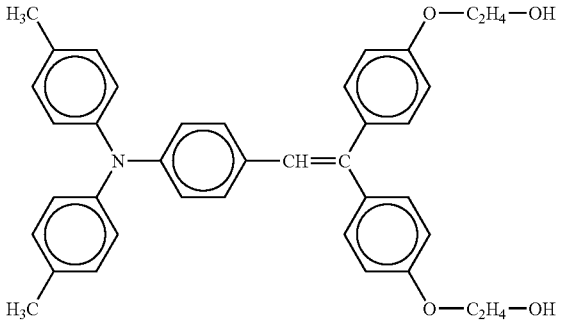 | |
| Thermosetting resin monomer (melamine resin) (Super Beckamine L-145-60, available from Dainippon Ink and Chemicals Inc.) | 3.5 parts by weight (solid content: 2.1 part by weight) |
| Thermosetting surfactant (hydrophobic resin ZX-007C, available from Fuji Kasei Kogyo Co., Ltd.) | 14 parts by weight (solid content: 4.9 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

[Spray Coating Conditions for Photoconductor Surface Top Layer in Examples 6 to 10]

| | |
|---|---|
| Discharge amount of coating composition: | 11 ml/min |
| Discharge pressure of coating composition: | 2.4 kgf/cm$^2$ |
| Number of revolutions of drum to be coated: | 120 rpm |
| Coating speed: | 28 mm/sec |
| Distance between spray head and drum to be coated: | 5 cm |
| Repetitive number of coating procedure: | 2 |

Comparative Example 6

An electrophotographic photoconductor was prepared by the procedure of Example 6, except for curing the coating composition for a surface top layer at 110° C. for 30 minute.

An endothermic peak was observed in a DSC curve of the resulting cured film as the photoconductor surface top layer.

No peak with a minimum transmittance of less than 95% was observed in an infrared absorption spectrum of the surface top layer determined by the above-mentioned method.

Comparative Example 7

An electrophotographic photoconductor was prepared by the procedure of Example 6, except for using the following coating composition for a surface top layer and curing the coating composition at 150° C. for 30 minutes.

[Coating Composition for Photoconductor Surface Top Layer]

| | |
|---|---|
| Thermosetting resin monomer (base resin) (HEATLESS GLASS GS-600-1BN (base resin), available from Ohashi Chemical Industries Ltd.) | 10 parts by weight |
| Thermosetting resin monomer (curative agent) (HEATLESS GLASS GS-600-1BN (curative agent), available from Ohashi Chemical Industries Ltd.) | 1 part by weight |
| Ethyl Cellosolve | 20 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 cm$^{-1}$).

[Spray Coating Conditions for Photoconductor Surface Top Layer in Comparative Example 6 and 7]

| | |
|---|---|
| Discharge amount of coating composition: | 10 ml/min |
| Discharge pressure of coating composition: | 2.4 kgf/cm$^2$ |
| Number of revolutions of drum to be coated: | 120 rpm |
| Coating speed: | 28 mm/sec |
| Distance between spray head and drum to be coated: | 5 cm |
| Repetitive number of coating procedure: | 2 |

Each of the electrophotographic photoconductors prepared according to Examples 6 to 10, and Comparative Examples 6 and 7 was adjusted for actual use and was installed in an electrophotographic apparatus (imagio Neo 1050 Pro, available from Ricoh Company Limited). Each 999 copies of a text image and a graphic image with an image density of 6% were continuously produced alternately at a dot density of 600 dpi by 600 dpi for a total of 80000 copies on copying paper (MyPaper A4, available from Ricoh Company Limited). The genuine toner and developing agent for the apparatus were used herein. A scorotron charger mounted to the electrophotographic apparatus was used as intact as the charger. The test was carried out while a circuit (process control) for controlling the process of the electrophotographic apparatus was operated.

A cleaning blade to be attached to the test apparatus was replaced with a new one before the test.

The test was carried out, on average, at a temperature of 23° C. and relative humidity of 54%.

The surface free energy of the photoconductors was determined before and after the test. Upon the completion of the test, abrasion loss of the photoconductors, image blur and damage of the cleaning blade were determined.

The results are shown in Table 4.

TABLE 4

| | Surface free energy (mN/m) | | Damage on cleaning | Abrasion | Image |
|---|---|---|---|---|---|
| | before test | after test | blade (rank) | loss (μm) | blur (rank) |
| Ex. 6 | 47.5 | 45.3 | 2 | 2.2 | 3 |
| Ex. 7 | 27.9 | 29.1 | 4 | 1.8 | 3 |
| Ex. 8 | 27.2 | 28.4 | 5 | 1.8 | 3 |
| Ex. 9 | 26.7 | 27.1 | 5 | 1.7 | 3 |
| Ex. 10 | 27.2 | 27.0 | 5 | 1.7 | 3 |
| Comp. Ex. 6 | 47.5 | 45.3 | 2 | 5.0 | 3 |
| Comp. Ex. 7 | 29.2 | 32.0 | 4 | 0.9 | 1 |

The photoconductors according to Examples 7 to 10 show a very low surface free energy as compared with conventional equivalents. In contrast, the photoconductor according to Example 6 shows a surface free energy substantially equal to that of conventional equivalents.

Figure 21:
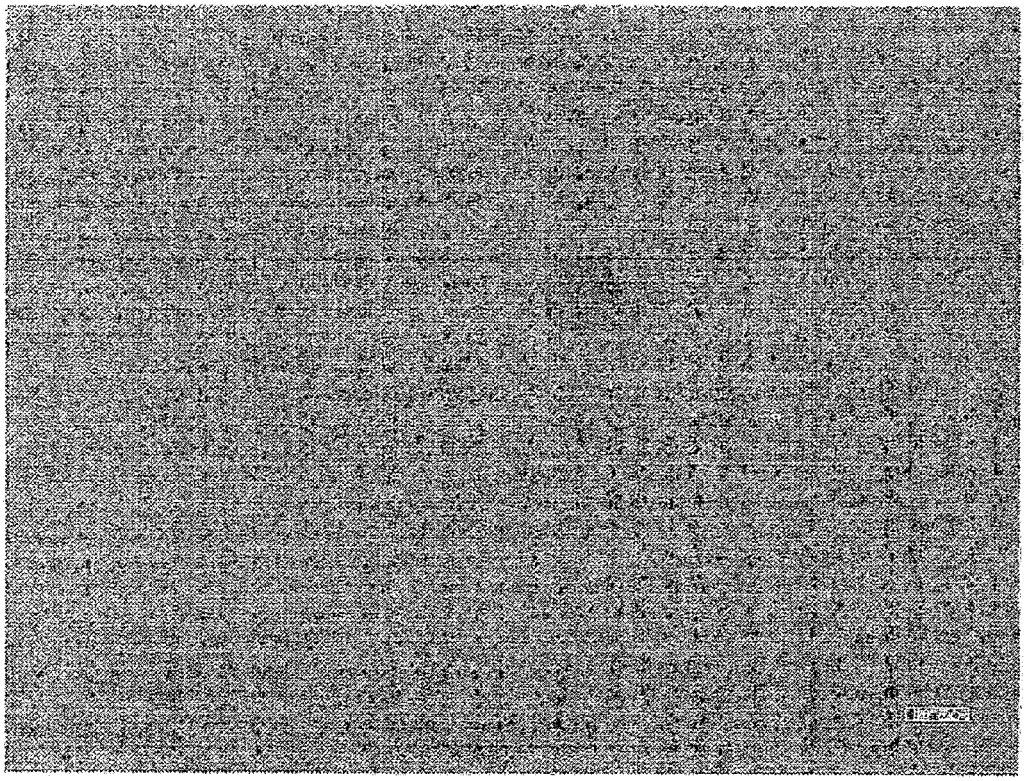
FIG. 21 is a photograph illustrating a surface of a photoconductor.
Figure 22:
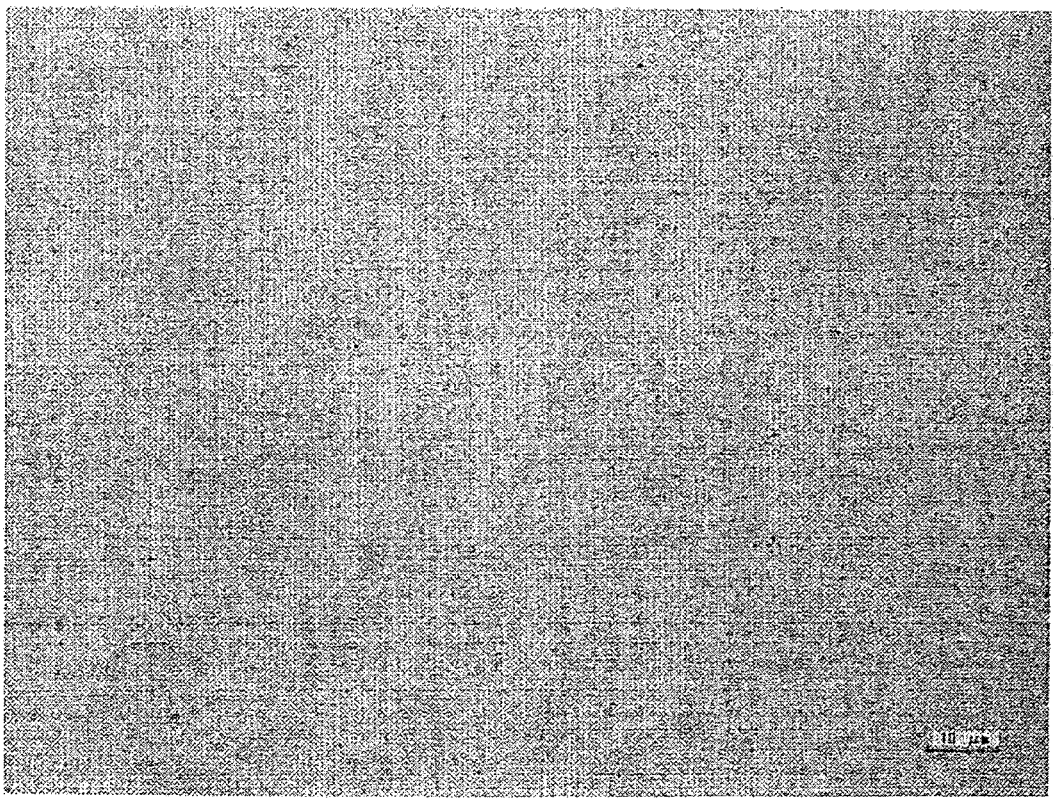
FIG. 22 is another photograph illustrating a surface of a photoconductor.

The surfaces of the photoconductors upon the completion of the test were observed with an ultradeep profile analyzing microscope. The surface of the photoconductor according to Example 6 shows a residual unnecessary substance, which may be a toner. In contrast, the surfaces of the photoconductors according to Examples 7 to 10 are substantially free from residual unnecessary substances. The photographs of the surfaces of the photoconductors according to Example 6 and Example 8 upon the completion of the test are shown in FIG. 21 and FIG. 22, respectively, for the sake of explanation. In these figures, the scale indicates 10 μm. It is considered that the residual unnecessary substance on the surface of the photoconductor according to Example 6 is hardly removed and strikes the cleaning blade with the rotation of the photoconductor, and this causes high stress on the cleaning blade to thereby invite chipping of the edge of the cleaning blade. In fact, slight chipping is observed in the cleaning blade in Example 6. This may cause increased replacements of the photoconductor or cleaning blade in actual use.

In contrast, the surfaces of the photoconductors according to Examples 7 to 10 each have a low surface free energy and are clean even after the running test. In addition, chipping in blade edge is not observed. The photoconductors under these conditions can enjoy prolonged lives according to their inherent durability.

These test results show that reduction in surface free energy also plays an important role for prolonging the life of photoconductors, and that the surface free energy of the photoconductor is preferably reduced to 30 mN/m or less. To achieve this configuration, the use of surfactants as exemplified in the examples is effective. The surface free energy of the photoconductors having the configurations according to the present invention can be probably reduced to about 25 mN/m in actuality, since the surface free energy is not reduced when such a surfactant is incorporated in an excessively large amount.

Example 11

The following coating composition for a undercoat layer, coating composition for a charge generation layer, coating composition for a charge transport layer were sequentially applied and dried to form an undercoat layer 3.5 μm thick, a charge generation layer 0.4 μm thick and a charge transport layer 22 μm thick on an aluminum drum having a wall thickness of 0.8 mm and a diameter of 30 mm. Next, a coating composition for a surface top layer was applied to the charge transport layer by spray coating to form a surface top layer 3 μm thick. Thus, an electrophotographic photoconductor according to the present invention was prepared.

| | |
|---|---|
| [Coating Composition for Undercoat Layer] | |
| Alkyd resin (Beckosol 1307-60-EL, available from Dainippon Ink and Chemicals Inc.) | 10 parts by weight |
| Melamine resin (Super Beckamine G-821-60, available from Dainippon Ink and Chemicals Inc.) | 7 parts by weight |
| Titanium oxide (CR-EL available from Ishihara Sangyo Kaisha, Ltd) | 40 parts by weight |
| Methyl ethyl ketone | 200 parts by weight |
| [Coating Composition for Charge Generation Layer] | |
| Titanyl phthalocyanine (available from Ricoh Company Limited) | 20 parts by weight |
| Polyvinyl alcohol (5-LEC B BX- 1, available from Sekisui Chemical Co., Ltd.) | 10 parts by weight |
| Methyl ethyl ketone | 100 parts by weight |
| [Coating Composition for Charge Transport Layer] | |
| Polycarbonate resin (Panlite TS-2050, available from Teijin Kasei Inc.) | 10 parts by weight |
| Low-molecular charge transporting material having the following structure: | 7 parts by weight |

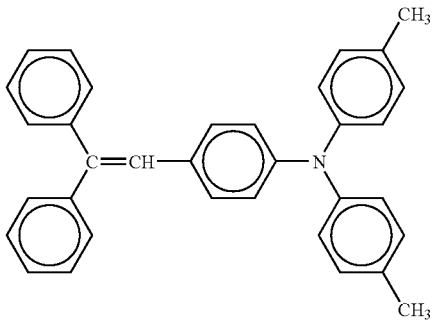

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |
| [Coating Composition for Photoconductor Surface Top Layer] | |
| Crosslinkable charge transporting material having the following structure and containing reactive hydroxyl groups | 3 parts by weight |

-continued

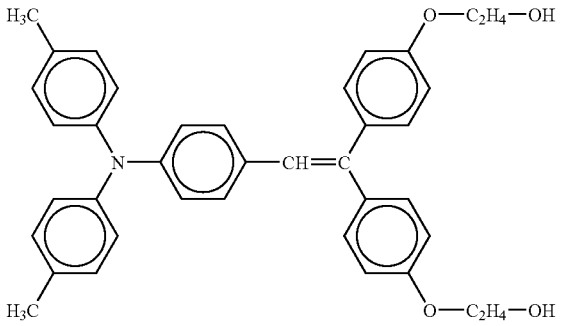

| | |
|---|---|
| Thermosetting resin monomer (melamine resin) (Super Beckamine L-145-60, available from Dainippon Ink and Chemicals Inc.) | 12 parts by weight (solid content: 7.2 parts by weight) |
| Thermosetting surfactant (hydrophobic resin ZX-007C, available from Fuji Kasei Kogyo Co., Ltd.) | 2 parts by weight (solid content: 0.7 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

[Spray Coating Conditions for Photoconductor Surface Top Layer in Example 11]

| | |
|---|---|
| Discharge amount of coating composition: | 10 ml/min |
| Discharge pressure of coating composition: | 2.4 kgf/cm$^2$ |

-continued

| | |
|---|---|
| Number of revolutions of drum to be coated: | 120 rpm |
| Coating speed: | 28 mm/sec |
| Distance between spray head and drum to be coated: | 5 cm |
| Repetitive number of coating procedure: | 3 |

Example 12

An electrophotographic photoconductor was prepared by the procedure of Example 11, except for using the following coating composition for a charge transport layer.

[Coating Composition for Charge Transport Layer]

| | |
|---|---|
| Polycarbonate resin (Panlite TS-2050, available from Teijin Kasei Inc.) | 10 parts by weight |
| Low-molecular charge transporting material having the following structure: | 7 parts by weight |

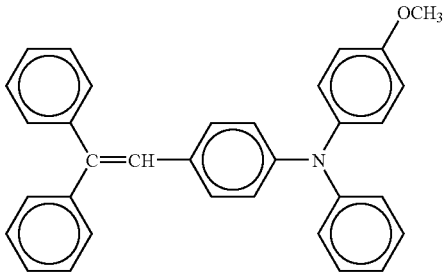

| | |
|---|---|
| Tetrahydrofuran | 79 parts by weight |
| 1% Silicone oil (KF5O-100CS, available from Shin-Etsu Chemical Co., Ltd.) tetrahydrofuran solution | 1 part by weight |

Example 13

An electrophotographic photoconductor was prepared by the procedure of Example 11, except for using the following coating composition for a charge transport layer.

-continued

| [Coating Composition for Charge Transport Layer] | |
|---|---|
| Polycarbonate resin (Panlite TS-2050, available from Teijin Kasei Inc.) | 10 parts by weight |
| Low-molecular charge transporting material having the following structure: | 7 parts by weight |

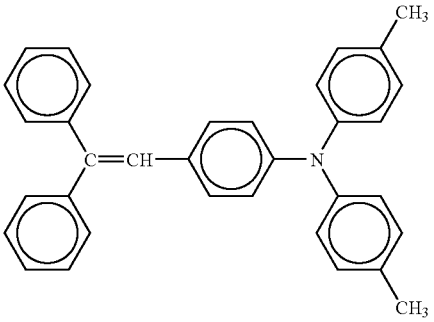

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |

Example 14

An electrophotographic photoconductor was prepared by the procedure of Example 11, except for using the following coating composition for a charge transport layer.

| Coating Composition for Charge Transport Layer | |
|---|---|
| Polycarbonate resin (Panlite TS-2050, available from Teijin Kasei Inc.) | 10 parts by weight |
| Low-molecular charge transporting material having the following structure: | 7 parts by weight |

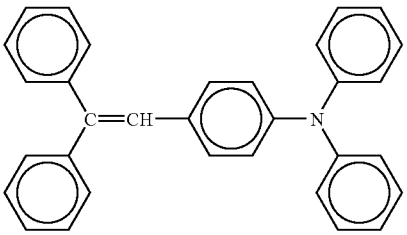

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |

Comparative Example 8

An electrophotographic photoconductor was prepared by the procedure of Example 11, except for curing the coating composition for a surface top layer at 110° C. for 30 minutes.

An endothermic peak was observed in a DSC curve of the resulting cured film as the photoconductor surface top layer.

No peak with a minimum transmittance of less than 95% was observed in an infrared absorption spectrum of the surface top layer determined by the above-mentioned method.

Comparative Example 9

An electrophotographic photoconductor was prepared by the procedure of Example 11, except for using the following coating composition for a surface top layer and curing the coating composition at 150° C. for 30 minutes.

[Coating Composition for Photoconductor Surface Top Layer]

| | |
|---|---|
| Thermosetting resin monomer (base resin) (HEATLESS GLASS GS-600-1BN(base resin), available from Ohashi Chemical Industries Ltd.) | 10 parts by weight |
| Thermosetting resin monomer (curative agent) (HEATLESS GLASS GS-600-1BN (curative agent), available from Ohashi Chemical Industries Ltd.) | 1 part by weight |
| Ethyl Cellosolve | 20 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 $cm^{-1}$).

[Spray Coating Conditions for Photoconductor Surface Top Layer in Comparative Examples 8 and 9]

| | |
|---|---|
| Discharge amount of coating composition: | 10 ml/min |
| Discharge pressure of coating composition: | 2.4 $kgf/cm^2$ |
| Number of revolutions of drum to be coated: | 120 rpm |
| Coating speed: | 28 mm/sec |
| Distance between spray head and drum to be coated: | 5 cm |
| Repetitive number of coating procedure: | 3 times |

Each of the electrophotographic photoconductors prepared according to Examples 11 to 14, and Comparative Examples 8 and 9 was installed in a process cartridge integrally with a charging roller, a cleaning blade and a development unit, and the process cartridge was installed to an electrophotographic apparatus (imagio MF2200, available from Ricoh Company Limited). A running test for a total of 10000 copies was carried out on copying paper (TYPE 6200, A4T, available from Ricoh Company Limited). In the running test, genuine toner and developing agent were used. In the charging process of the photoconductors, a bias in the DC component of a voltage was applied to the charging roller so that the surface potential of the photoconductors stood at −800 V.

The test was carried out at 24° C. and 59% relative humidity. After the completion of the running test, a black solid pattern image was printed out, and the potential of an exposed portion of the photoconductors was determined. The abrasion loss of the photoconductors and image blur were determined after the running test. The results are shown in Table 5, together with the ionization potentials of the charge transporting materials in the charge transport layers, and the differences in ionization potential between the charge transporting materials in the charge transport layers and the charge transporting materials in the surface top layers.

TABLE 5

| | Ionization potential of charge transporting material in charge transport layer (eV) | Difference in ionization potential (eV) | Potential of exposed portion (−V) | Abrasion loss (μm) | Image blur (rank) |
|---|---|---|---|---|---|
| Ex. 11 | 5.33 | 0.14 | 180 | 0.6 | 3 |
| Ex. 12 | 5.45 | 0.02 | 70 | 0.6 | 3 |
| Ex. 13 | 5.50 | 0.03 | 75 | 0.6 | 3 |
| Ex. 14 | 5.56 | 0.09 | 90 | 0.6 | 3 |
| Comp. Ex. 8 | 5.33 | 0.14 | 195 | 1.3 | 3 |
| Comp. Ex. 9 | — | — | 330 | 0.2 | 1 |

The electrophotographic photoconductors according to Examples 11 to 14 each have different ionization potentials controlled by changing the substituent(s) of charge transporting materials to be contained in the charge transport layer. These electrophotographic photoconductors thereby have different differences in ionization potential between a charge transporting material contained in the charge transport layer and a charge transporting material contained in the surface top layer.

The ionization potential of the charge transporting material contained in the surface top layer resin film according to Examples 11 to 14, and Comparative Example 8 was 5.47 eV.

Among photoconductors according to Examples 11 to 14, the photoconductor according to Example 11 has a difference in ionization potential exceeding 0.1 eV and shows a relatively high potential of an exposed portion. In contrast, the electrophotographic photoconductors according to Examples 12 to 14 each have a difference in ionization potential less than 0.1 eV and show a low potential of an exposed portion. These results in Examples 11 to 14 show that the difference in ionization potential between the charge transport layer and the surface top layer plays an important role for the photosensitivity of the photoconductors, and that the difference in ionization potential is preferably as small as 0.1 eV or less.

Example 15

The following coating composition for a undercoat layer, coating composition for a charge generation layer, coating composition for a charge transport layer were sequentially applied and dried to form an undercoat layer 3 μm thick, a charge generation layer 0.3 μm thick and a charge transport layer 22 μm thick on an aluminum drum having a wall thickness of 1 mm and a diameter of 30 mm. Next, a coating composition for a surface top layer was applied to the charge transport layer by spray coating to form a surface top layer 4 μm thick. Thus, an electrophotographic photoconductor according to the present invention was prepared.

Coating Composition for Undercoat Layer

| | |
|---|---|
| Alkyd resin solution (Beckolite M6401-50, available from Dainippon Ink and Chemicals Inc.) | 12 parts by weight |
| Melamine resin solution (Super Beckamine G-821-60, available from Dainippon Ink and Chemicals Inc.) | 8 parts by weight |
| Titanium oxide (CR-EL, available from Ishihara Sangyo Kaisha, Ltd.) | 40 parts by weight |
| Methyl ethyl ketone | 200 parts by weight |

Coating Composition for Charge Generation Layer

Bisazo pigment having the following structure (available from Ricoh Company Limited) 5 parts by weight

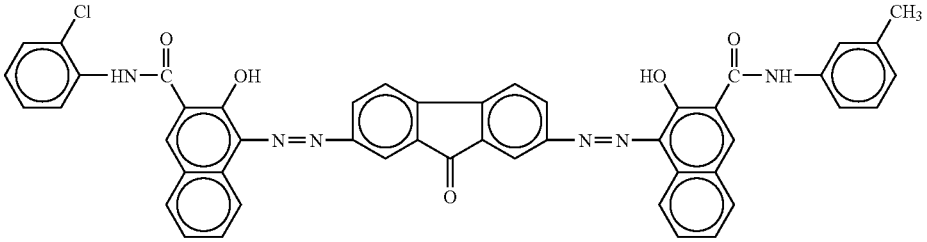

| | |
|---|---|
| Poly(vinyl butyral)s (XYHL, available from Union Carbide Corporation) | 1 part by weight |
| Cyclohexanone | 200 parts by weight |
| Methyl ethyl ketone | 80 parts by weight |

Coating Composition for Charge Transport Layer

| | |
|---|---|
| Polycarbonate resin (Panlite TS-2050, available from Teijin Kasei Inc.) | 10 parts by weight |
| Low-molecular charge transporting material having the following structure: | 7 parts by weight |

-continued

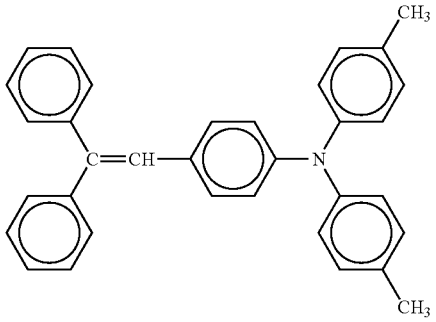

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |

Coating Composition for Photoconductor Surface Top Layer

| | |
|---|---|
| Thermosetting surfactant (Modiper F200, available from NOF Corporation) | 10 parts by weight (solid content: 3 parts by weight) |
| Thermosetting resin monomer (melamine resin) (Super Beckamine L-145-60, available from Dainippon Ink and Chemicals Inc.) | 12 parts by weight (solid content: 7.2 parts by weight) |
| Tetrahydrofuran | 180 parts by weight |
| Cyclohexanone | 50 parts by weight |

The applied coating composition for a surface top layer was cured at 170° C. for 30 minutes. No endothermic peak was observed in a DSC curve of the resulting cured resin film. Thus, the curing condition was set at a temperature of 170° C. for a time period of 30 minutes.

No peak with a minimum transmittance of less than 95% was observed in an infrared absorption spectrum of the surface top layer determined by the above-mentioned method.

Example 16

An electrophotographic photoconductor was prepared by the procedure of Example 15, except for using the following coating composition for a surface top layer.

| Coating Composition for Photoconductor Surface Top Layer | |
|---|---|
| Crosslinkable charge transporting material having the following structure and containing reactive hydroxyl groups | 0.5 part by weight |

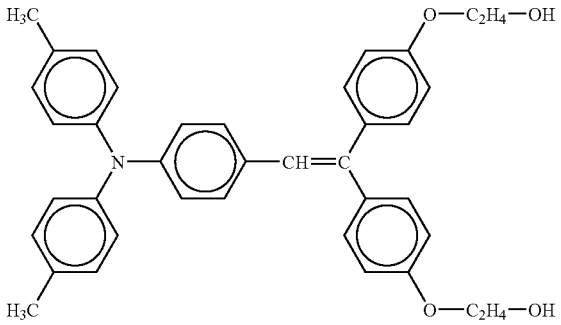

| | |
|---|---|
| Thermosetting surfactant (Modiper F200, available from NOF Corporation) | 9.3 parts by weight (solid content: 2.8 parts by weight) |

-continued

| Coating Composition for Photoconductor Surface Top Layer | |
|---|---|
| Thermosetting resin monomer (melamine resin) (Super Beckamine L-145-60, available from Dainippon Ink and Chemicals Inc.) | 11 part by weight (solid content: 6.6 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 17

An electrophotographic photoconductor was prepared by the procedure of Example 15, except for using the following coating composition for a surface top layer.

| Coating Composition for Photoconductor Surface Top Layer | |
|---|---|
| Crosslinkable charge transporting material having the following structure and containing reactive hydroxyl groups | 0.75 parts by weight |

-continued

| Coating Composition for Photoconductor Surface Top Layer | |
|---|---|
| 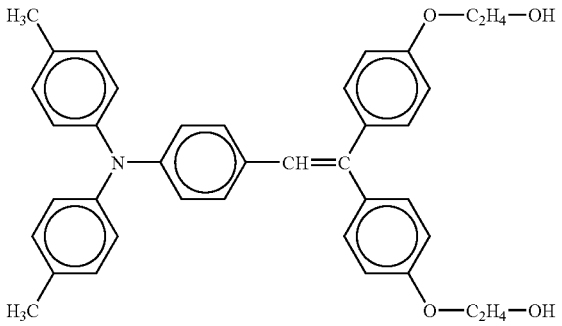 | |
| Thermosetting surfactant (Modiper F200, available from NOF Corporation) | 9 parts by weight (solid content: 2.7 parts by weight) |
| Thermosetting resin monomer (melamine resin) (Super Beckamine L-145-60, available from Dainippon Ink and Chemicals Inc.) | 11 part by weight (solid content: 6.6 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 18

An electrophotographic photoconductor was prepared by the procedure of Example 15, except for using the following coating composition for a surface top layer.

| Coating Composition for Photoconductor Surface Top Layer | |
|---|---|
| Crosslinkable charge transporting material having the following structure and containing reactive hydroxyl groups | 1 part by weight |
| 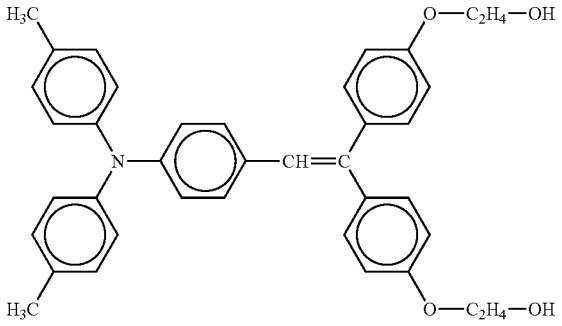 | |
| Thermosetting surfactant (Modiper F200, available from NOF Corporation) | 8.7 parts by weight (solid content: 2.6 parts by weight) |
| Thermosetting resin monomer (melamine resin) (Super Beckamine L-145-60, available from Dainippon Ink and Chemicals Inc.) | 10.5 parts by weight (solid content: 6.3 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 19

An electrophotographic photoconductor was prepared by the procedure of Example 15, except for using the following coating composition for a surface top layer.

| Coating Composition for Photoconductor Surface Top Layer | |
|---|---|
| Crosslinkable charge transporting material having the following structure and containing reactive hydroxyl groups | 1.25 parts by weight |
| 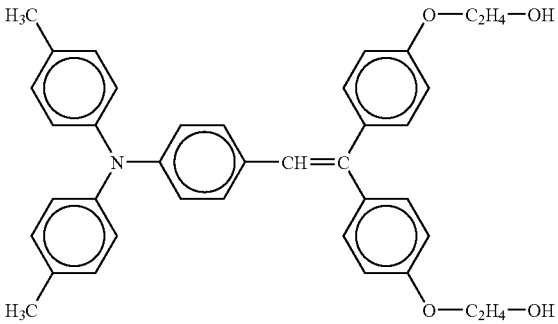 | |
| Thermosetting surfactant (Modiper F200, available from NOF Corporation) | 8.7 parts by weight (solid content: 2.6 parts by weight) |
| Thermosetting resin monomer (melamine resin) (Super Beckamine L-145-60, available from Dainippon Ink and Chemicals Inc.) | 10.3 parts by weight (solid content: 6.2 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

[Spray Coating Conditions for Photoconductor Surface Top Layer in Examples 15 to 19]

| | |
|---|---|
| Discharge amount of coating composition: | 10 ml/min |
| Discharge pressure of coating composition: | 2.4 kgf/cm$^2$ |
| Number of revolutions of drum to be coated: | 120 rpm |
| Coating speed: | 28 mm/sec |
| Distance between spray head and drum to be coated: | 6 cm |
| Repetitive number of coating procedure: | 4 times |

Comparative Example 10

An electrophotographic photoconductor was prepared by the procedure of Example 15, except for curing the coating composition for a surface top layer at 110° C. for 30 minutes.

An endothermic peak was observed in a DSC curve of the resulting cured film as the photoconductor surface top layer.

No peak with a minimum transmittance of less than 95% was observed in an infrared absorption spectrum of the surface top layer determined by the above-mentioned method.

Comparative Example 11

An electrophotographic photoconductor was prepared by the procedure of Example 15, except for using the following coating composition for a surface top layer and curing the coating composition at 150° C. for 30 minutes.

[Coating Composition for Photoconductor Surface Top Layer]

| | |
|---|---|
| Thermosetting resin monomer (base resin) (HEATLESS GLASS GS-600-1BN(base resin), available from Ohashi Chemical Industries Ltd.) | 10 parts by weight |
| Thermosetting resin monomer (curative agent) (HEATLESS GLASS GS-600-1BN(curative agent), available from Ohashi Chemical Industries Ltd.) | 1 part by weight |
| Ethyl Cellosolve | 20 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 $cm^{-1}$).

[Spray Coating Conditions for Photoconductor Surface Top Layer in Comparative Examples 10 and 11]

| | |
|---|---|
| Discharge amount of coating composition: | 10 ml/min |
| Discharge pressure of coating composition: | 2.4 $kgf/cm^2$ |
| Number of revolutions of drum to be coated: | 120 rpm |
| Coating speed: | 28 mm/sec |
| Distance between spray head and drum to be coated: | 5 cm |
| Repetitive number of coating procedure: | 4 times |

Each of the electrophotographic photoconductors prepared according to Examples 15 to 19, and Comparative Examples 10 and 11 was adjusted for actual use and was installed in an electrophotographic apparatus (imagio Neo C385, available from Ricoh Company Limited). Each five copies of a text image and a graphic image with an image density of 5% were continuously produced at a dot density of 600 dpi by 600 dpi for a total of 2500 copies on copying paper (TYPE 6000 <58W> A4, available from Ricoh Company Limited).

A genuine product was used as a toner, and a developing agent contained in a genuine developing agent unit was used as intact as the developing agent.

A charging roller arranged in close proximity of the electrophotographic photoconductor was used as a charger for the electrophotographic apparatus.

The AC component of the voltage applied to the charging roller was set at a peak-to-peak voltage of 1.5 kV at a frequency of 0.9 kHz. A bias in the DC component thereof was set so that the initial charge potential at the beginning of the test stands at −700 V, and the test was carried out under this charging condition. The development bias was set at −500 V. This apparatus comprises no charge-eliminating means. A genuine cleaning blade was used as intact as the cleaning means.

The test was carried out at 28° C. and 65% relative humidity.

Upon the completion of the test, the abrasion loss of the photoconductors and image blur were determined. In addition, the potential of an exposed portion was determined when a solid image pattern with an image density of 100% was printed out. The results are shown in Table 6, together with the contents of charge transporting materials contained in surface top layers of photoconductors according to Examples 15 to 18.

TABLE 6

| | Content of charge transporting material (% by weight) | Potential of exposed portion (−V) | Abrasion loss (μm) | Image blur (rank) |
|---|---|---|---|---|
| Ex. 15 | 0.0 | 300 | 0.2 | 3 |
| Ex. 16 | 5.0 | 200 | 0.2 | 3 |
| Ex. 17 | 7.5 | 155 | 0.2 | 3 |
| Ex. 18 | 10.0 | 135 | 0.2 | 3 |
| Ex. 19 | 12.5 | 127 | 0.2 | 3 |
| Comp. Ex. 10 | 0.0 | 310 | 0.4 | 3 |
| Comp. Ex. 11 | 0.0 | 330 | 0.1 | 1 |

Figure 18:
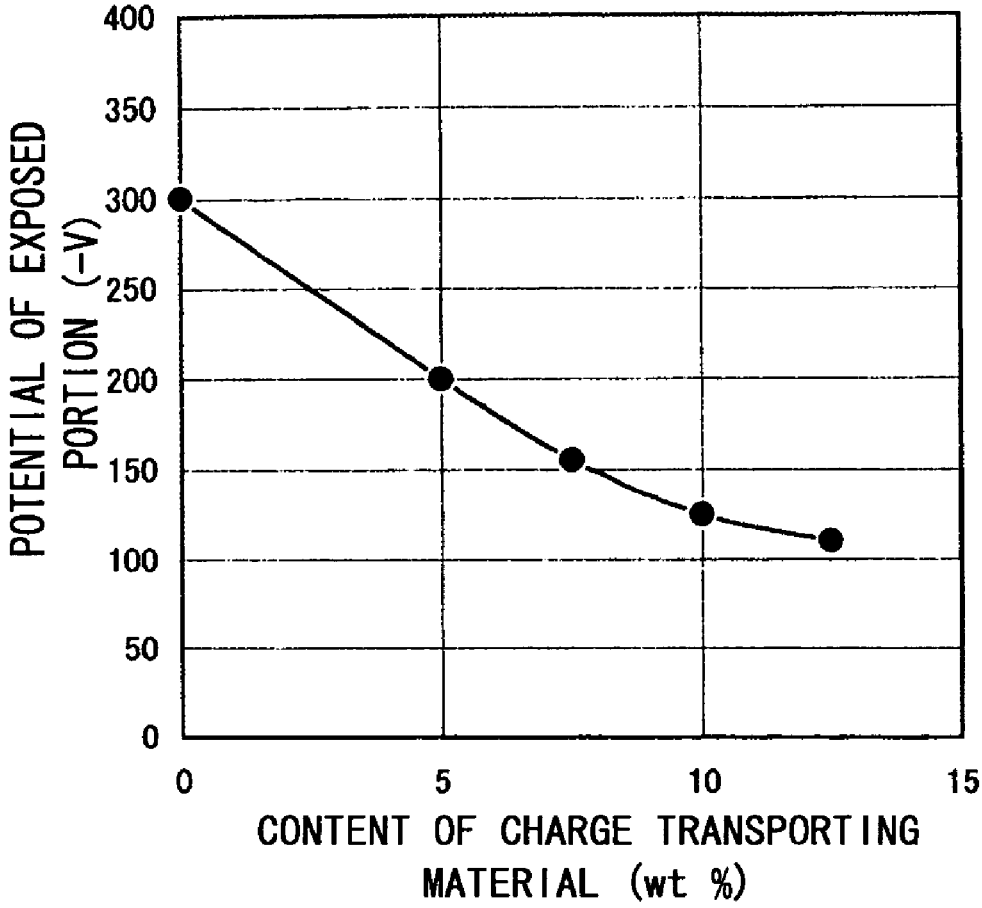
FIG. 18 illustrates a relationship between the content of a charge transporting material in a surface top layer and the potential of an exposed portion.

The photoconductors according to Examples 16 to 19 each contains a charge transporting material in the surface top layer and show a decreasing potential of an exposed portion with an increasing content of the charge transporting material. The relationship between the potential of an exposed portion and the content of the charge transporting material is shown in FIG. 18, indicating that the potential of an exposed portion significantly increases at contents of the charge transporting material less than 7.5 percent by weight.

The produced images according to Example 15 have image densities lower than those according to Examples 16 to 19. The produced images according to Example 16 have very slightly lower image densities. The produced images according to Examples 17, 18 and 19 have satisfactorily high image densities.

These results show that it is effective to incorporate a charge transporting material into the surface top layer to thereby improve the photosensitivity of the electrophotographic photoconductor having the surface top layer. In addition, the photoconductors according to Examples 16 to 19 each show a relatively low difference in ionization potential between the charge transporting material contained in the photoconductive layer and the charge transporting material contained in the surface top layer. This configuration may also contribute to improve the photosensitivity. The content of the charge transporting material in the surface top layer is preferably 7.5 percent by weight or more of the total weight of the surface top layer for effectively yielding the above-mentioned advantage.

Example 20

The following coating composition for a undercoat layer, coating composition for a charge generation layer, coating composition for a charge transport layer were sequentially applied and dried to form an undercoat layer 3.5 μm thick, a charge generation layer 0.4 μm thick and a charge transport layer 20 μm thick on an aluminum drum having a wall thickness of 1 mm and a diameter of 30 mm. Next, a coating composition for a surface top layer was applied to the charge transport layer by spray coating to form a surface top layer 1.5 μm thick. Thus, an electrophotographic photoconductor according to the present invention was prepared.

| Coating Composition for Undercoat Layer | |
|---|---|
| Alkyd resin (Beckosol 1307-60-EL, available from Dainippon Ink and Chemicals Inc.) | 10 parts by weight |
| Melamine resin (Super Beckamine G-821-60, available from Dainippon Ink and Chemicals Inc.) | 7 parts by weight |
| Titanium oxide (CR-EL, available from Ishihara Sangyo Kaisha, Ltd.) | 40 parts by weight |
| Methyl ethyl ketone | 200 parts by weight |
| Coating Composition for Charge Generation Layer | |
| Titanyl phthalocyanine (available from Ricoh Company Limited) | 20 parts by weight |
| Polyvinyl alcohol (S-LEC B BX-1, available from Sekisui Chemical Co., Ltd.) | 10 parts by weight |
| Methyl ethyl ketone | 100 parts by weight |
| Coating Composition for Charge Transport Layer | |
| Polymeric charge transporting material having the following structure and having a weight-average molecular weight of 8000 | 9.95 parts by weight |

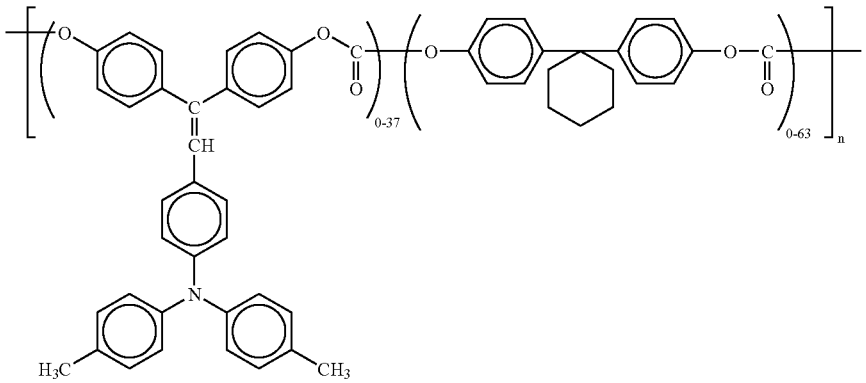

| | |
|---|---|
| weight-average molecular weight, 8000 | |
| Tetrahydrofuran | 56 parts by weight |
| 1% Silicone oil (KF50-100CS, available from Shin-Etsu Chemical Co., Ltd.) tetrahydrofuran solution | 1 part by weight |
| Coating Composition for Photoconductor Surface Top Layer | |
| Crosslinkable charge transporting material having the following structure and containing reactive hydroxyl groups | 3 parts by weight |

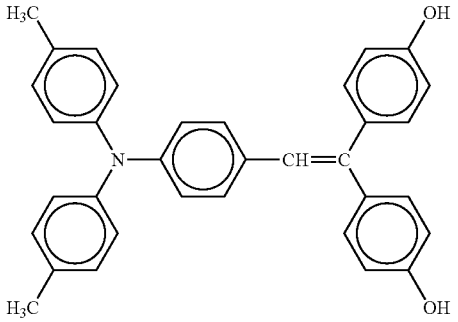

| | |
|---|---|
| Thermosetting resin monomer (base resin)(HEATLESS GLASS GO-100-SX (base resin), available from Ohashi Chemical Industries Ltd.) | 7 parts by weight |
| Thermosetting resin monomer (curative agent)(HEATLESS GLASS GO-100-SX (curative agent), available from Ohashi Chemical Industries Ltd.) | 0.7 parts by weight |
| Methyl isobutyl ketone | 25 parts by weight |

The applied coating composition for a surface top layer was cured at 150° C. for 60 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 21

An electrophotographic photoconductor was prepared by the procedure of Example 20, except for using a polymeric charge transporting material having a weight-average molecular weight of 12000 in the coating composition for a charge transport layer.

Example 22

An electrophotographic photoconductor was prepared by the procedure of Example 20, except for using a polymeric charge transporting material having a weight-average molecular weight of 30000 in the coating composition for a charge transport layer.

Example 23

An electrophotographic photoconductor was prepared by the procedure of Example 20, except for using a polymeric charge transporting material having a weight-average molecular weight of 50000 in the coating composition for a charge transport layer.

Example 24

An electrophotographic photoconductor was prepared by the procedure of Example 20, except for using a polymeric charge transporting material having a weight-average molecular weight of 120000 in the coating composition for a charge transport layer.

[Spray Coating Conditions for Photoconductor Surface Top Layer in Examples 20 to 24]

| | |
|---|---|
| Discharge amount of coating composition: | 10 ml/min |
| Discharge pressure of coating composition: | 2.4 kgf/cm$^2$ |
| Number of revolutions of drum to be coated: | 120 rpm |
| Coating speed: | 35 mm/sec |
| Distance between spray head and drum to be coated: | 5 cm |
| Repetitive number of coating procedure: | 2 times |

Comparative Example 12

An electrophotographic photoconductor was prepared by the procedure of Example 20, except for curing the coating composition for a surface top layer at 90° C. for 30 minutes.

An endothermic peak was observed in a DSC curve of the resulting cured film as the photoconductor surface top layer.

No peak with a minimum transmittance of less than 95% was observed in an infrared absorption spectrum of the surface top layer determined by the above-mentioned method.

Comparative Example 13

An electrophotographic photoconductor was prepared by the procedure of Example 20, except for using the following coating composition for a surface top layer and curing the coating composition at 150° C. for 30 minutes.

[Coating Composition for Photoconductor Surface Top Layer]

| | |
|---|---|
| Thermosetting resin monomer (base resin) (HEATLESS GLASS GS-600-1BN (base resin), available from Ohashi Chemical Industries Ltd.) | 10 parts by weight |
| Thermosetting resin monomer (curative agent) (HEATLESS GLASS GS-600-1BN (curative agent), available from Ohashi Chemical Industries Ltd.) | 1 part by weight |
| Ethyl Cellosolve | 25 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 cm$^{-1}$).

[Spray Coating Conditions for Photoconductor Surface Top Layer in Comparative Examples 12 and 13]

| | |
|---|---|
| Discharge amount of coating composition: | 10 ml/min |
| Discharge pressure of coating composition: | 2.4 kgf/cm$^2$ |
| Number of revolutions of drum to be coated: | 120 rpm |
| Coating speed: | 28 mm/sec |
| Distance between spray head and drum to be coated: | 5 cm |
| Repetitive number of coating procedure: | 2 times |

Each of the electrophotographic photoconductors prepared according to Examples 20 to 24, and Comparative Examples 12 and 13 was adjusted for actual use and was installed in an electrophotographic apparatus (imagio Neo 270, available from Ricoh Company Limited). A fatigue test was carried out for a total of 50 hours. In the fatigue test, no printing paper was used, and charging, light exposure and charge eliminating procedures were repeated. In the charging process of the photoconductors, a bias in the DC component of a voltage was applied to the charging roller so that the surface potential of the photoconductors stood at −800 V.

The test was carried out at 24° C. and 59% relative humidity. The abrasion loss of the photoconductors and image blur were determined after the fatigue test. After the completion of the test, a black solid pattern image was printed out, and the potential of an exposed portion of the photoconductors was determined.

The results are shown in Table 7.

TABLE 7

| | Weight-average molecular weight of charge transporting material in charge transport layer | Potential of exposed portion (−V) | Abrasion loss (μm) | Image blur (rank) |
|---|---|---|---|---|
| Ex. 20 | 8000 | 210 | 0.2 | 3 |
| Ex. 21 | 10000 | 90 | 0.2 | 3 |
| Ex. 22 | 30000 | 80 | 0.2 | 3 |
| Ex. 23 | 50000 | 80 | 0.2 | 3 |
| Ex. 24 | 120000 | 80 | 0.2 | 3 |
| Comp. Ex. 12 | 8000 | 210 | 0.5 | 3 |
| Comp. Ex. 13 | 8000 | 280 | 0.2 | 1 |

The ionization potentials of a charge transporting material in the charge transport layer and a charge transporting material in the surface top layer of the photoconductors according to Examples 20 to 24 are 5.5 eV and 5.38 eV, respectively.

The photoconductors according to the examples except for Example 20 each have a low potential of an exposed portion and exhibit good photosensitivity. The photoconductors according to Examples 21 to 24 each 10 comprise, as a charge transporting material, a polymeric charge transporting material having a weight-average molecular weight of 10000 or more in the charge transport layer. A charge transporting material in the charge transport layer may migrate into the surface top layer during the film formation of the surface top layer. The polymeric charge transporting materials used in Examples 21 to 24 probably prevent the migration, which in turn prevents the potential of an exposed portion from increasing. These results show that a polymeric charge transporting material having a weight-average molecular weight of 10000 or more is preferably used.

Example 25

The following coating composition for a undercoat layer, coating composition for a charge generation layer, coating composition for a charge transport layer were sequentially applied by spray coating and dried to form an undercoat layer 3.5 μm thick, a charge generation layer 0.4 μm thick and a charge transport layer 22 μm thick on an aluminum drum having a wall thickness of 0.8 mm and a diameter of 100 mm. Next, a coating composition for a surface top layer was applied to the charge transport layer by ring coating to form a surface top layer 4 μm thick. Thus, an electrophotographic photoconductor according to the present invention was prepared.

| Coating Composition for Undercoat Layer | |
|---|---|
| Alkyd resin (Beckosol 1307-60-EL, available from Dainippon Ink and Chemicals Inc.) | 10 parts by weight |
| Melamine resin (Super Beckamine G-821-60, available from Dainippon Ink and Chemicals Inc.) | 7 parts by weight |
| Titanium oxide (CR-EL, available from Ishihara Sangyo Kaisha, Ltd.) | 40 parts by weight |
| Methyl ethyl ketone | 200 parts by weight |
| **Coating Composition for Charge Generation Layer** | |
| Titanyl phthalocyanine (available from Ricoh Company Limited) | 20 parts by weight |
| Polyvinyl alcohol (S-LEC B BX-1, available from Sekisui Chemical Co., Ltd.) | 10 parts by weight |
| Methyl ethyl ketone | 100 parts by weight |
| **Coating Composition for Charge Transport Layer** | |
| Polycarbonate resin (Panlite TS-2050, available from Teijin Kasei Inc.) | 10 parts by weight |
| Low-molecular charge transporting material having the following structure | 7 parts by weight |

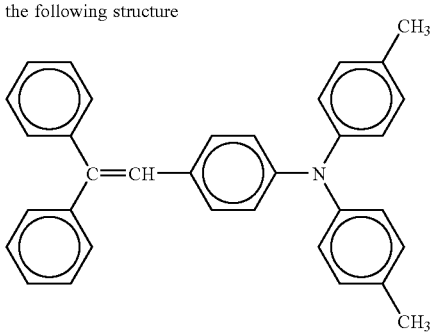

-continued

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |
| **Coating Composition for Photoconductor Surface Top Layer** | |
| Crosslinkable charge transporting material having the following structure and containing reactive hydroxyl groups | 3 parts by weight |

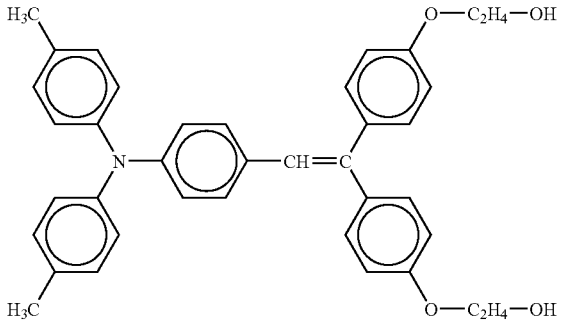

| | |
|---|---|
| Thermosetting surfactant (RESEDA GF-2000, available from TOAGOSEI CO., LTD.) | 2 parts by weight (solid content: 0.7 parts by weight) |
| Tetrahydrofuran | 190 parts by weight |
| Cyclohexanone | 53 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 26

An electrophotographic photoconductor was prepared by the procedure of Example 25, except for using the following coating composition for a charge transport layer.

| Coating Composition for Charge Transport Layer | |
|---|---|
| Polymeric charge transporting material having the following structure: | 15 parts by weight |

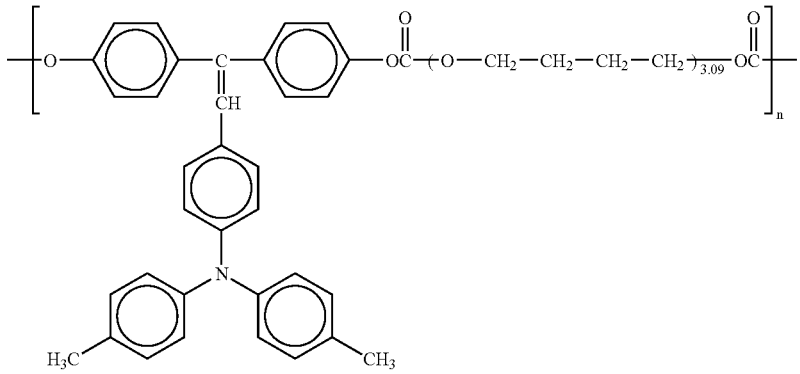

-continued

| Coating Composition for Charge Transport Layer | |
|---|---|
| Low-molecular charge transporting material having the following structure: | 5 parts by weight |

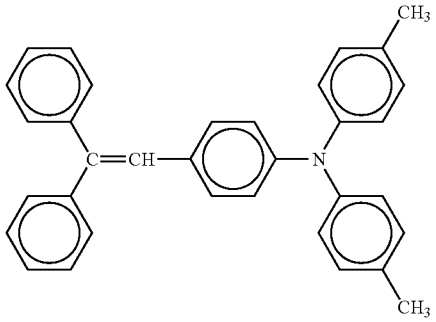

| | |
|---|---|
| Tetrahydrofuran | 100 parts by weight |
| 1% Silicone oil (KF50-100CS, available from Shin-Etsu Chemical Co., Ltd.) tetrahydrofuran solution | 1 part by weight |

Example 27

An electrophotographic photoconductor was prepared by the procedure of Example 25, except for using the following coating composition for a charge transport layer.

| Coating Composition for Charge Transport Layer | |
|---|---|
| Polystyrenes resin (HRM-3, available from Denki Kagaku Kogyo Kabushiki Kaisha) | 10 parts by weight |
| Low-molecular charge transporting material having the following structure: | 7 parts by weight |

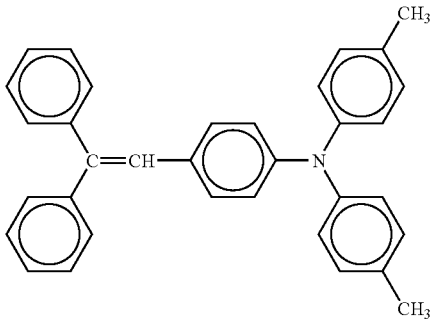

| | |
|---|---|
| Tetrahydrofuran | 100 parts by weight |
| 1% Silicone oil (KF50-100CS, available from Shin-Etsu Chemical Co., Ltd.) tetrahydrofuran solution | 1 part by weight |

Comparative Example 14

An electrophotographic photoconductor was prepared by the procedure of Example 25, except for curing the coating composition at 90° C. for 30 minutes.

An endothermic peak was observed in a DSC curve of the resulting cured film as the photoconductor surface top layer.

No peak with a minimum transmittance of less than 95% was observed in an infrared absorption spectrum of the surface top layer determined by the above-mentioned method.

Comparative Example 15

An electrophotographic photoconductor was prepared by the procedure of Example 25, except for using the following coating composition for a surface top layer and curing the coating composition at 150° C. for 30 minutes.

[Coating Composition for Photoconductor Surface Top Layer]

| | |
|---|---|
| Thermosetting resin monomer (base resin) (HEATLESS GLASS GS-600-1BN (base resin), available from Ohashi Chemical Industries Ltd.) | 10 parts by weight |
| Thermosetting resin monomer (curative agent) (HEATLESS GLASS GS-600-1BN (curative agent), available from Ohashi Chemical Industries Ltd.) | 1 part by weight |
| Ethyl Cellosolve | 20 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 $cm^{-1}$).

Each of the electrophotographic photoconductors prepared according to Examples 25 to 27, and Comparative Examples 14 and 15 was adjusted for actual use and was installed in a modified high-speed electrophotographic apparatus (imagio Neo 1050 Pro, available from Ricoh Company Limited). In the electrophotographic apparatus, the process time from the image exposure part of the photoconductor to the sleeve of the development means had been modified to 80 msec. Each 999 copies of a text image and a graphic image with an image density of 6% were continuously and alternately produced at a dot density of 600 dpi by 600 dpi for a total of 80000 copies on copying paper (MyPaper A4, available from Ricoh Company Limited). The genuine toner and developing agent for the apparatus were used herein. A scorotron charger mounted to the electrophotographic apparatus was used as intact as the charger. The test was carried out while a circuit (process control) for controlling the process of the electrophotographic apparatus was operated. After the completion of the running test, the abrasion loss of the photoconductors, and the resolution and image lag of produced images were determined. The test was carried out at a temperature of 24° C. and relative humidity of 54%.

The resolution was determined in the following manner. A "TAKENOKO" chart (a chart of parallel thin lines) was printed out at a dot density of 600 dpi by 600 dpi under a development condition so that a black solid pattern has an image density of 0.8 after the completion of the running test. The maximum resolution in this procedure was defined as the resolution.

The results are shown in Table 8, together with the charge mobilities at 160 kV/cm in the charge transport layers of the photoconductors according to Examples 25 to 27.

TABLE 8

| | Charge mobility ($cm^2$/Vsec) | Abrasion loss (μm) | Resolution (lines/mm) | Image blur (rank) |
|---|---|---|---|---|
| Ex. 25 | $1.2 \times 10^{-5}$ | 0.2 | 5.0 | 2 |
| Ex. 26 | $2.3 \times 10^{-4}$ | 0.2 | 6.3 | 3 |
| Ex. 27 | $1.0 \times 10^{-4}$ | 0.2 | 6.3 | 3 |
| Comp. Ex. 14 | $1.2 \times 10^{-5}$ | 0.5 | 5.0 | 2 |
| Comp. Ex. 15 | $1.2 \times 10^{-5}$ | 0.1 | 2.5 | 1 |

The photoconductors according to Examples 26 and 27 have charge mobilities of the charge transport layers ten times as large as that in Example 25 and thereby can continuously produce high-quality images with high resolutions without image lag during the entire running test. The results show that the photoconductors according to Examples 26 and 27 can produce high-quality images in electrophotographic processes carried out at very high speed.

These results show that the charge mobility of the charge transport layer affects the resolution of the resulting images, and that the charge mobility is preferably $1.0\times10^{-4}$ $cm^2$/Vsec or more for satisfactory image resolutions. To satisfy this requirement, it is effective to incorporate a polystyrene resin into the binder resin component or to use a polymeric charge transporting material.

Example 28

The following coating composition for a undercoat layer, coating composition for a charge generation layer, coating composition for a charge transport layer were sequentially applied by spray coating and dried to form an undercoat layer 3.5 μm thick, a charge generation layer 0.4 μm thick and a charge transport layer 22 μm thick on an aluminum drum having a wall thickness of 0.8 mm and a diameter of 100 mm. Next, a coating composition for a surface top layer was applied to the charge transport layer by ring coating to form a surface top layer 1.5 μm thick. Thus, an electrophotographic photoconductor according to the present invention was prepared.

| | |
|---|---|
| [Coating Composition for Undercoat Layer] | |
| Alkyd resin (Beckosol 1307-60-EL, available from Dainippon Ink and Chemicals Inc.) | 10 parts by weight |
| Melamine resin (Super Beckamine G-821-60, available from Dainippon Ink and Chemicals Inc.) | 7 parts by weight |
| Titanium oxide (CR-EL, available from Ishihara Sangyo Kaisha, Ltd.) | 40 parts by weight |
| Methyl ethyl ketone | 200 parts by weight |
| [Coating Composition for Charge Generation Layer] | |
| Titanyl phthalocyanine (available from Ricoh Company Limited) | 20 parts by weight |
| Polyvinyl alcohol (S-LEC B BX-1, available from Sekisui Chemical Co., Ltd.) | 10 parts by weight |
| Methyl ethyl ketone | 100 parts by weight |
| [Coating Composition for Charge Transport Layer] | |
| Polycarbonate resin (Panlite TS-2050, available from Teijin Kasei Inc.) | 10 parts by weight |
| Low-molecular charge transporting material having the following structure: | 7 parts by weight |

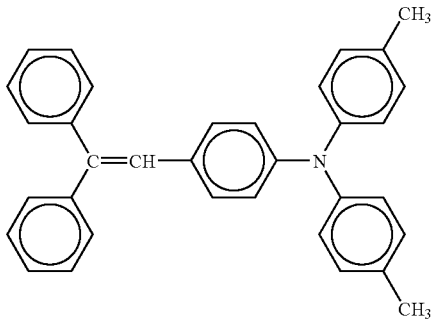

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |
| [Coating Composition for | |

-continued

| Photoconductor Surface Top Layer] | |
|---|---|
| Thermosetting resin monomer (base resin) (HEATLESS GLASS GO-100-SX (base resin), available from Ohashi Chemical Industries Ltd.) | 9 parts by weight |
| Thermosetting resin monomer (curative agent) (HEATLESS GLASS GO-100-SX(curative agent), available from Ohashi Chemical Industries Ltd.) | 1 part by weight |
| Ethyl Cellosolve | 30 parts by weight |

The applied coating composition for a surface top layer was cured at 150° C. for 60 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 29

An electrophotographic photoconductor was prepared by the procedure of Example 28, except for applying the following coating composition for a surface top layer by ring coating to form a surface top layer 3 μm thick.

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 30

An electrophotographic photoconductor was prepared by the procedure of Example 28, except for applying the following coating composition for a surface top layer by ring coating to form a surface top layer 3 μm thick.

| [Coating Composition for Photoconductor Surface Top Layer] | |
|---|---|
| Crosslinkable charge transporting material having the following structure and containing reactive hydroxyl groups | 3 parts by weight |

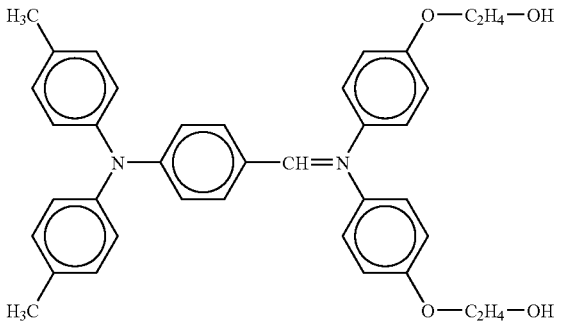

| | |
|---|---|
| Thermosetting resin monomer (melamine resin) (Super Beckamine L-125-60, available from Dainippon Ink and Chemicals Inc.) | 8.2 parts by weight (solid content: 4.9 parts by weight) |
| Thermosetting surfactant (hydrophobic resin ZX-007C, available from Fuji Kasei Kogyo Co., Ltd.) | 6 parts by weight (solid content: 2.1 part by weight) |
| Tetrahydrofuran | 23 parts by weight |
| Cyclohexanone | 7 parts by weight |

| [Coating Composition for Photoconductor Surface Top Layer] | |
|---|---|
| Crosslinkable charge transporting material having the following structure and containing reactive hydroxyl groups | 1 part by weight |

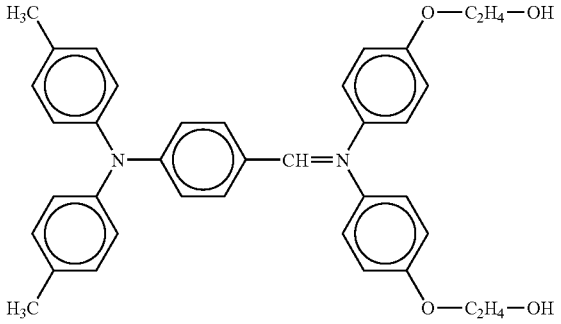

| | |
|---|---|
| Thermosetting resin monomer (melamine resin) (Super Beckamine L-125-60, available from Dainippon Ink and Chemicals Inc.) | 7.5 parts by weight (solid content: 4.5 parts by weight) |
| Thermosetting surfactant (hydrophobic resin ZX-007C, available from Fuji Kasei Kogyo Co., Ltd.) | 12 parts by weight (solid content: 4.2 parts by weight) |
| Tetrahydrofuran | 23 parts by weight |
| Cyclohexanone | 7 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Comparative Example 16

An electrophotographic photoconductor was prepared by the procedure of Example 28, except for curing the coating composition for a surface top layer at 90° C. for 30 minutes.

An endothermic peak was observed in a DSC curve of the resulting cured film as the photoconductor surface top layer.

No peak with a minimum transmittance of less than 95% was observed in an infrared absorption spectrum of the surface top layer determined by the above-mentioned method.

Comparative Example 17

An electrophotographic photoconductor was prepared by the procedure of Example 28, except for using the following coating composition for a surface top layer and curing the coating composition at 150° C. for 30 minutes.

[Coating Composition for Photoconductor Surface Top Layer]

| | |
|---|---|
| Thermosetting resin monomer (base resin) (HEATLESS GLASS GS-600-1BN (base resin), available from Ohashi Chemical Industries Ltd.) | 10 parts by weight |
| Thermosetting resin monomer (curative agent) (HEATLESS GLASS GS-600-1BN (curative agent), available from Ohashi Chemical Industries Ltd.) | 1 part by weight |
| Methyl isobutyl ketone | 10 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 $cm^{-1}$).

Comparative Example 18

An electrophotographic photoconductor was prepared by the procedure of Example 28, except that no surface top layer was formed and that the thickness of the charge transport layer was set at 24 μm Each of the electrophotographic photoconductors prepared according to Examples 28 to 30, and Comparative Examples 16 to 18 was adjusted for actual use and was installed in an electrophotographic apparatus (imagio Neo 1050 Pro, available from Ricoh Company Limited). Each 50 copies of a pattern comprising a solid black pattern in one half of the image forming region and a blank pattern in the other half in a scanning direction were produced in a intermittent manner at a dot density of 600 dpi by 600 dpi for a total of 100000 copies on copying paper (MyPaper A4, available from Ricoh Company Limited). The genuine toner and developing agent for the apparatus were used herein. A scorotron charger mounted to the electrophotographic apparatus was used as intact as the charger. The test was carried out while a circuit (process control) for controlling the process of the electrophotographic apparatus was operated. After the completion of the running test, the abrasion loss of the photoconductors, and the partial wear (the difference in abrasion loss between the black solid image and the blank portion) were determined. The test was carried out at a temperature of 24° C. and relative humidity of 54%. Image blur was also evaluated.

The results are shown in Table 9, together with the results of the surface top layer or the charge transport layer in a Taber abrasion test.

TABLE 9

| | Taber abrasion loss (mg per 1000 revolutions) | | | Difference (mg per 1000 revolutions) | | Partial | Image |
|---|---|---|---|---|---|---|---|
| | CS-5 (F) | CS-10 (G) | CS-17 (H) | H − G | Abrasion loss (μm) | wear (μm) | blur (rank) |
| Ex. 28 | 0.07 | 0.17 | 0.68 | 0.51 | 0.5 | 0.1 | 3 |
| Ex. 29 | 0.00 | 2.66 | 4.56 | 1.90 | 0.7 | 0.1 | 3 |
| Ex. 30 | 0.00 | 1.68 | 3.88 | 2.20 | 0.7 | 0.5 | 3 |
| Comp. Ex. 16 | 0.35 | 1.15 | 4.30 | 3.15 | 2.5 | 1.2 | 2 |
| Comp. Ex. 17 | 0.53 | 0.34 | 1.38 | 1.04 | 5.9 | * | 1 |
| Comp. Ex. 18 | 0.02 | 5.75 | 8.70 | 2.95 | 10.5 | 2.0 | 3 |

*: Unmeasured because of cracking.

The electrophotographic photoconductors according to Examples 28 and 29 each show a difference in abrasion loss in the Taber abrasion test of less than 2 mg per 1000 revolutions and exhibit a less partial wear than photoconductors having the difference exceeding 2 mg per 1000 revolutions.

By setting the difference in the Taber abrasion loss at less than 2 mg per 1000 revolutions, the resulting electrophotographic photoconductors become substantially free from partial wear even in use under such conditions as to often invite partial wear, such as in large-quantity printing of an image of logo mark with a small printing area.

The photoconductor according to Comparative Example 17 has a Taber abrasion loss with a CS-5 wear ring of exceeding 0.5 mg per 1000 revolutions and invites a large quantity of cracks. Accordingly, the photoconductors should be preferably used under such conditions as to avoid this problem.

Example 31

The following coating composition for a undercoat layer, coating composition for a charge generation layer, coating composition for a charge transport layer were sequentially applied by spray coating and dried to form an undercoat layer 3.5 μm thick, a charge generation layer 0.4 μm thick and a charge transport layer 22 μm thick on an aluminum drum having a wall thickness of 0.8 mm and a diameter of 60 mm. Next, a coating composition for a surface top layer was applied to the charge transport layer by ring coating to form a surface top layer 1.5 μm thick. Thus, an electrophotographic photoconductor according to the present invention was prepared.

| | |
|---|---|
| [Coating Composition for Undercoat Layer] | |
| Alkyd resin (Beckosol 1307-60-EL, available from Dainippon Ink and Chemicals Inc.) | 10 parts by weight |
| Melamine resin (Super Beckamine G-821-60, available from Dainippon Ink and Chemicals Inc.) | 7 parts by weight |
| Titanium oxide (CR-EL, available from Ishihara Sangyo Kaisha, Ltd.) | 40 parts by weight |
| Methyl ethyl ketone | 200 parts by weight |
| [Coating Composition for Charge Generation Layer] | |
| Titanyl phthalocyanine (available from Ricoh Company Limited) | 20 parts by weight |
| Polyvinyl alcohol (S-LEC B BX-1, available from Sekisui Chemical Co., Ltd.) | 10 parts by weight |
| Methyl ethyl ketone | 100 parts by weight |
| [Coating Composition for Charge Transport Layer] | |
| Polycarbonate resin (Panlite TS-2050, available from Teijin Kasei Inc.) | 10 parts by weight |
| Low-molecular charge transporting material having the following structure: | 9.5 parts by weight |

-continued

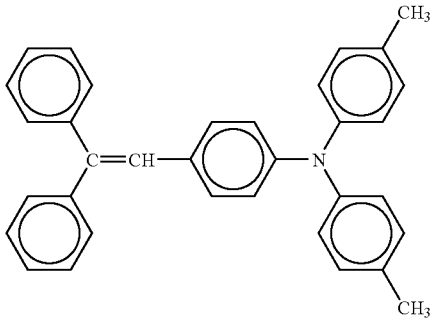

| | |
|---|---|
| Stabilizer having the following structure: | 0.5 part by weight |

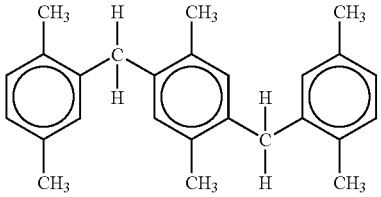

| | |
|---|---|
| Tetrahydrofuran | 79 parts by weight |
| 1% Silicone oil (KF50-100CS, available from Shin-Etsu Chemical Co., Ltd.) tetrahydrofuran solution | 1 part by weight |
| [Coating Composition for Photoconductor Surface Top Layer] | |
| Thermosetting resin monomer (melamine resin) (Super Beckamine L-145-60, available from Dainippon Ink and Chemicals Inc.) | 17 parts by weight (solid content: 10.2 parts by weight) |
| Tetrahydrofuran | 23 parts by weight |
| Cyclohexanone | 7 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 32

An electrophotographic photoconductor was prepared by the procedure of Example 31, except for using the following coating composition for a surface top layer.

| [Coating Composition for Photoconductor Surface Top Layer] | |
|---|---|
| Crosslinkable charge transporting material having the following structure and containing reactive hydroxyl groups | 1 part by weight |

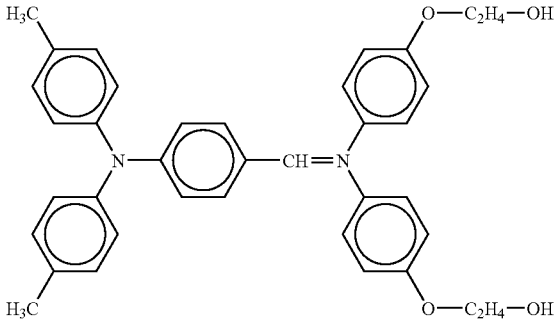

-continued

| [Coating Composition for Photoconductor Surface Top Layer] | |
|---|---|
| Thermosetting resin monomer (melamine resin) (Super Beckamine L-145-60, available from Dainippon Ink and Chemicals Inc.) | 15 parts by weight (solid content: 9 parts by weight) |
| Tetrahydrofuran | 23 parts by weight |
| Cyclohexanone | 7 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 33

An electrophotographic photoconductor was prepared by the procedure of Example 31, except for using the following coating composition for a surface top layer.

| [Coating Composition for Photoconductor Surface Top Layer] | |
|---|---|
| Crosslinkable charge transporting material having the following structure and containing reactive hydroxyl groups | 1 part by weight |

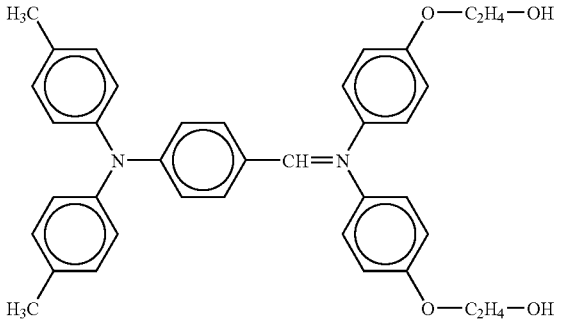

| | |
|---|---|
| Thermosetting resin monomer (melamine resin) (Super Beckamine L-145-60, available from Dainippon Ink and Chemicals Inc.) | 11.7 parts by weight (solid content: 7 parts by weight) |
| Thermosetting flexible unit material (PLACCEL 308, Daicel Chemical Industries, Ltd.) | 2 parts by weight |
| Tetrahydrofuran | 23 parts by weight |
| Cyclohexanone | 7 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Example 34

An electrophotographic photoconductor was prepared by the procedure of Example 31, except for using the following coating composition for a surface top layer.

| [Coating Composition for Photoconductor Surface Top Layer] | |
|---|---|
| Crosslinkable charge transporting material having the following structure and containing reactive hydroxyl groups | 1 part by weight |

-continued

[Coating Composition for Photoconductor Surface Top Layer]

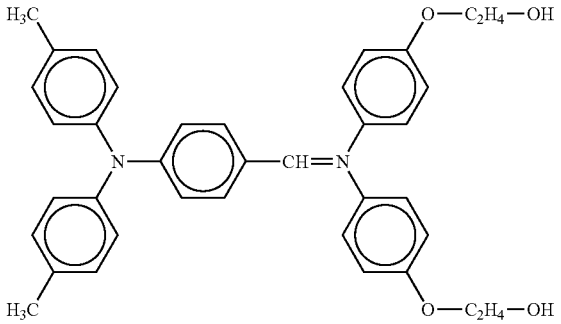

| | |
|---|---|
| Thermosetting resin monomer (melamine resin) (Super Beckamine L-145-60, available from Dainippon Ink and Chemicals Inc.) | 10 parts by weight (solid content: 6 parts by weight) |
| Thermosetting flexible unit material (PLACCEL 308, Daicel Chemical Industries, Ltd.) | 3 parts by weight |
| Tetrahydrofuran | 23 parts by weight |
| Cyclohexanone | 7 parts by weight |

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

Comparative Example 19

An electrophotographic photoconductor was prepared by the procedure of Example 31, except for curing the applied coating composition for a surface top layer at 110° C. for 30 minutes.

An endothermic peak was observed in a DSC curve of the resulting cured film as the photoconductor surface top layer.

No peak with a minimum transmittance of less than 95% was observed in an infrared absorption spectrum of the surface top layer determined by the above-mentioned method.

Comparative Example 20

An electrophotographic photoconductor was prepared by the procedure of Example 31, except for using the following coating composition for a surface top layer and curing the applied coating composition at 150° C. for 30 minutes.

[Coating Composition for Photoconductor Surface Top Layer]

| | |
|---|---|
| Thermosetting resin monomer (base resin) (HEATLESS GLASS GS-600-1BN (base resin), available from Ohashi Chemical Industries Ltd.) | 10 parts by weight |
| Thermosetting resin monomer (curative agent) (HEATLESS GLASS GS-600-1BN (curative agent), available from Ohashi Chemical Industries Ltd.) | 1 part by weight |
| Ethyl Cellosolve | 20 parts by weight |

No endothermic peak was observed in a DSC curve of the resulting resin film as the photoconductor surface top layer. The minimum transmittance of the surface top layer in the infrared absorption spectrum determined by the above-mentioned method was 92% (3400 $cm^{-1}$).

Comparative Example 21

An electrophotographic photoconductor was prepared by the procedure of Example 31, except for using, instead of the coating composition for a surface top layer, the following coating composition for an abrasion resistant charge transport layer containing a highly hard filler.

[Coating Composition for Abrasion Resistant Charge Transport Layer]

| | |
|---|---|
| Polycarbonate resin (Panlite TS-2060, available from Teijin Kasei Inc.) | 9 parts by weight |
| Low-molecular charge transporting material having the following structure: | 6.3 parts by weight |

-continued

[Coating Composition for Abrasion Resistant Charge Transport Layer]

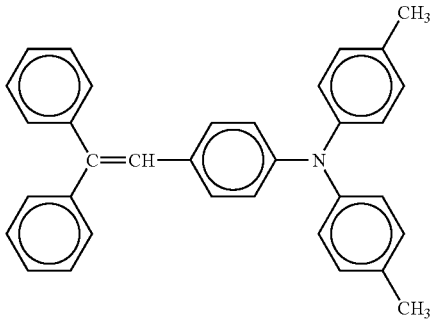

| | |
|---|---|
| Highly hard filler (Sumikorandom AA-03, available from Sumitomo Chemical Co., Ltd.) | 2 parts by weight |
| Specific resistance depressant (BYK-P 104, available from Byk-Chemie) | 0.1 part by weight |
| Antioxidants (SANOL LS-2626, available from Sankyo Lifetech Co., Ltd.) | 0.4 parts by weight |
| Cyclohexanone | 280 parts by weight |
| Tetrahydrofuran | 80 parts by weight |

Each of the electrophotographic photoconductors prepared according to Examples 31 to 34, and Comparative Examples 19 to 21 was adjusted for actual use and was installed in an electrophotographic apparatus (imagio Neo 452 Model 765, available from Ricoh Company Limited). Each five copies of a text image pattern and a graphic image pattern with an image density of 6% were produced in an intermittent manner at a dot density of 600 dpi by 600 dpi for a total of 20000 copies on copying paper (TYPE 6000, A4, available from Ricoh Company Limited). The genuine toner and developing agent for the apparatus were used herein. A charging roller mounted to the electrophotographic apparatus was used as intact as the charger. The test was carried out while such a voltage was applied to the charging roller so that the charged voltage stood at −800 V at the beginning of the test, and a circuit (process control) for controlling the process of the electrophotographic apparatus was not operated. After the completion of the running test, the abrasion loss and the waviness parameter Sm (the average length between a concave portion and a convex portion) of the surface of the photoconductors were determined, and the image blur was evaluated. The test was carried out at a temperature of 24° C. and relative humidity of 54%.

The results are shown in Table 10, together with the measured surface roughness (average surface roughness; Ra) of the photoconductor surface top layer after the Taber abrasion test.

TABLE 10

| | Surface roughness after Taber abrasion test (μm) | | Difference | Sm | Abrasion | Image blur |
|---|---|---|---|---|---|---|
| | CS-10 (J) | CS-17 (K) | (K − J) (μm) | (μm) | loss (μm) | (rank) |
| Ex. 31 | 0.16 | 0.30 | 0.14 | 167 | 0.6 | 3 |
| Ex. 32 | 0.15 | 0.25 | 0.10 | 240 | 0.5 | 3 |
| Ex. 33 | 0.12 | 0.20 | 0.08 | 410 | 0.4 | 3 |
| Ex. 34 | 0.09 | 0.18 | 0.09 | 450 | 0.4 | 3 |
| Comp. Ex. 19 | 0.17 | 0.34 | 0.17 | 130 | 1.5 | 2 |
| Comp. Ex. 20 | 0.16 | 0.33 | 0.17 | 136 | 0.5 | 1 |
| Comp. Ex. 21 | 0.12 | 0.31 | 0.29 | 45 | 1.0 | 2 |

Figure 23A:
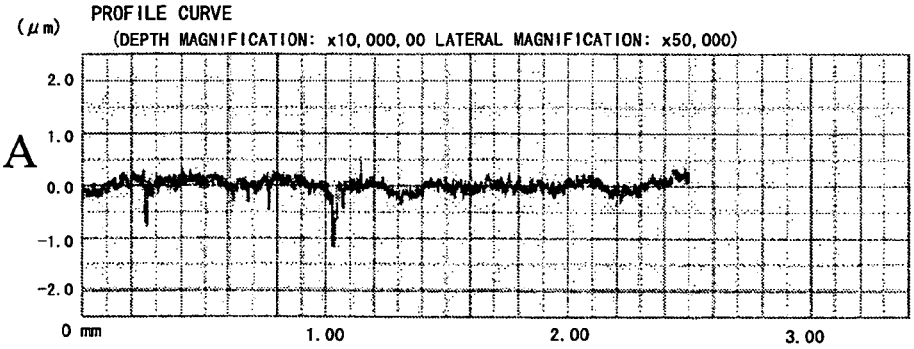
FIGS. 23A, B and C illustrate profile curves of photoconductors having different surface roughness (Sm).
Figure 23B:
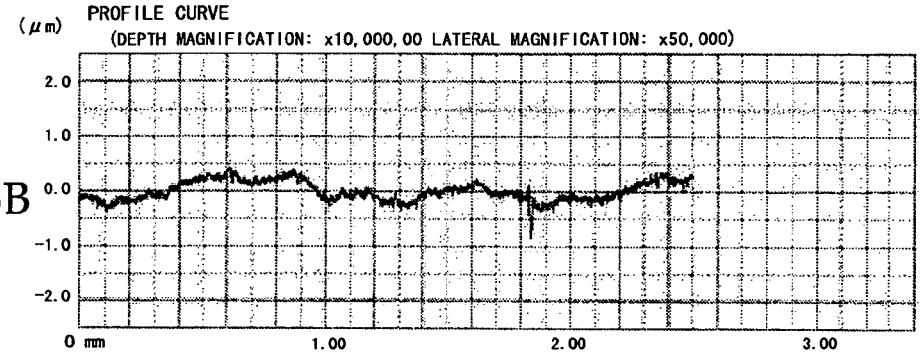
Figure 23C:
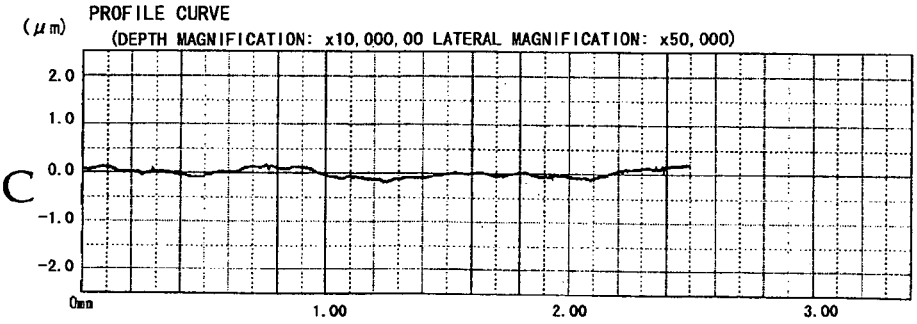

The surface roughness parameter Sm (the average length between a concave portion and a convex portion) as determined using a probe surface roughness meter serves as one of indicators for determining the roughness of the surface of the photoconductor caused by scratching. FIGS. 23 A, B and C illustrate relationship between the profile of a surface of a photoconductor and Sm. FIGS. 23 A, B and C show that the surface of the photoconductor becomes more smooth with an increasing Sm, and that Sm is preferably about 400 μm or more.

The photoconductors according to Examples 33 and 34 satisfy the above-specified requirement even after the completion of the test. Accordingly, the configurations of these photoconductors are preferred for higher scratch resistance.

More specifically, it is preferred for higher scratch resistance that the surface roughness (Ra) of the surface top layer after a Taber abrasion test (load: 250 gf, 60 rpm, 1000 revolutions) using a CS-17 wear ring is less than 0.25 μm and that the difference in surface roughness Ra between the Taber abrasion test using a CS-17 wear ring and that using a CS-10 wear ring is less than 0.10 μm.

The above test results show that the above-specified requirements are effectively satisfied by introducing a flexible unit into the crosslinkable resin, and that the amount of such a flexible unit is preferably about 30 percent by weight of the crosslinkable resin.

Example 35

An electrophotographic photoconductor was prepared by the procedure of Example 2, except for adding 0.1 part by weight of dodecylbenzenesulfonic acid as an acidic substance to the coating composition for a surface top layer. As a result, the coating composition for a surface top layer was sufficiently cured even at 160° C. for 30 minutes, and no endothermic peak was observed in the DSC curve.

No peak with a minimum transmittance of less than 95% was observed in an infrared absorption spectrum of the surface top layer determined by the above-mentioned method.

Example 36

An electrophotographic photoconductor was prepared by the procedure of Example 2, except for adding 0.5 part by weight of BYK-Silclean 3700 (available from Byk-Chemie) as a leveling agent to the coating composition for a surface top layer.

The applied coating composition for a surface top layer was cured at 170° C. for 30 minutes. No endothermic peak was observed in a DSC curve of the resulting cured resin film as the surface top layer.

No peak with a minimum transmittance of less than 95% was observed in an infrared absorption spectrum of the surface top layer determined by the above-mentioned method.

When the resulting photoconductor was installed to an electrophotographic apparatus and the apparatus was operated, no scarfing was observed in the cleaning blade. In contrast to this, the photoconductor according to Example 2 invited such scarfing of the cleaning blade, albeit it happened very rarely.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electrophotographic photoconductor comprising:

an electroconductive substrate;

a photoconductive layer being arranged over the electroconductive substrate directly or with the interposition of an undercoat layer, and a surface top layer being arranged over the photoconductive layer and comprising at least one crosslinkable binder resin, wherein the photoconductive layer comprises:

a charge generation layer containing at least one charge generating materials, and a charge transport layer containing at least one first charge transporting material, wherein the surface top layer has a light transmittance of 95% or more at wavenumbers of 3200 to 3800 $cm^{-1}$, and wherein the surface top layer shows substantially no endothermic peak in a differential scanning calorimetry curve determined by using a differential scanning calorimeter.

2. An electrophotographic photoconductor according to claim 1, wherein the surface top layer is substantially free from hydroxyl groups and residual uncured portions.

3. An electrophotographic photoconductor according to claim 1, wherein the electrophotographic photoconductor shows a variation in potential of an exposed portion with time interval between exposure and development of 0.7 V/msec or less.

4. An electrophotographic photoconductor according to claim 1, wherein the electrophotographic photoconductor has a surface free energy of 30 mN/m or less.

5. An electrophotographic photoconductor according to claim 1, wherein the electrophotographic photoconductor shows a variation in surface free energy of less than 2 mN/m from the initial photoconductor to the photoconductor after printing $20\times10^4$ copies.

6. An electrophotographic photoconductor according to claim 1, wherein the crosslinkable binder resin is a crosslinked product of at least one second charge transporting material, a thermosetting resin monomer and a thermosetting surfactant.

7. An electrophotographic photoconductor according to claim 6, wherein the difference in ionization potential between the at least one first charge transporting material in the charge transport layer and the at least one second charge transporting material in the surface top layer is 0.1 eV or less.

8. An electrophotographic photoconductor according to claim 6, wherein the second charge transporting material comprises:

a charge transporting material used in the charge transport layer as the at least one first charge transporting material; and a charge transporting material different from the at least one first charge transporting material, wherein the content "a" of the charge transporting material used in the charge transport layer as the at least one first charge transporting material in the surface top layer, and the content "b" of the charge transporting material different from the at least one first charge transporting material in the surface top layer satisfy either of the following conditions:

$a/(a+b)<0.01$ or $a/(a+b)>0.99$.

9. An electrophotographic photoconductor according to claim 6, wherein the at least one second charge transporting material in the surface top layer comprises a charge transporting material represented by following Formula (1):

Formula (1)

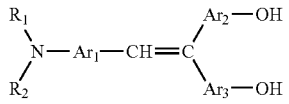

wherein $R_1$ and $R_2$ may be the same as or different from each other and are each a substituted or unsubstituted aryl group; and $Ar_1$, $Ar_2$ and $Ar_3$ are each an arylene group and may be the same as or different from one another.

10. An electrophotographic photoconductor according to claim 6, wherein the at least one second charge transporting material in the surface top layer comprises a charge transporting material represented by following Formula (2):

Formula (2)

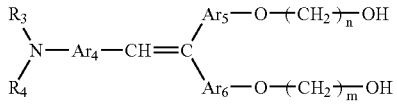

wherein $R_3$ and $R_4$ may be the same as or different from each other and are each a substituted or unsubstituted aryl group; $Ar_4$, $Ar_5$ and $Ar_6$ are each an arylene group and may be the same as or different from one another; and m and n are each a number of repetitions from 1 to 10.

11. An electrophotographic photoconductor according to claim 6, wherein the content of the at least one second charge transporting material in the surface top layer is 7.5 percent by weight or more.

12. An electrophotographic photoconductor according to claim 6, wherein the thermosetting surfactant contained in the crosslinkable binder resin of the surface top layer is a copolymer comprising at least a fluorocarbon resin component and a reactive hydroxyl group.

13. An electrophotographic photoconductor according to claim 12, wherein the thermosetting surfactant comprises a block copolymer.

14. An electrophotographic photoconductor according to claim 12, wherein the thermosetting surfactant comprises a fluorocarbon resin/siloxane graft polymer.

15. An electrophotographic photoconductor according to claim 1, wherein the at least one first charge transporting material contained in the charge transport layer comprises a polymeric charge transporting material having a weight-average molecular weight of 10, 000 or more and 200, 000 or less.

16. An electrophotographic photoconductor according to claim 1, wherein the charge transport layer has a charge mobility of $1.0\times10^{-4}$ $cm^2/Vsec$ or more at a field strength of 160 kV/cm.

17. An electrophotographic photoconductor according to claim 16, wherein the charge transport layer comprises a solid solution between a charge transporting material having an α-phenylstilbene skeleton and a polymeric charge transporting material or a polystyrene resin.

18. An electrophotographic photoconductor according to claim 1, wherein Taber abrasion losses of the surface top layer as a resin film satisfy the following conditions:

$$H-G<2 \text{ mg and } F<0.5 \text{ mg and } H<3.0 \text{ mg}$$

wherein F represents an abrasion loss (mg per 1000 revolutions) with a CS-5 wear ring; G represents an abrasion loss (mg per 1000 revolutions) with a CS-10 wear ring; and H represents an abrasion loss (mg per 1000 revolutions) with a CS-17 wear ring in the Taber abrasion test.

19. An electrophotographic photoconductor according to claim 1, wherein surface roughnesses of the surface top layer as a resin film in a Taber abrasion test satisfy the following conditions:

$$K-J<0.10 \text{ μm and } K<0.25 \text{ μm}$$

wherein J represents an average surface roughness (μm) with a CS-10 wear ring; and K represents an average surface roughness (μm) with a CS-17 wear ring in the Taber abrasion test.

20. An electrophotographic photoconductor according to claim 1, wherein the crosslinkable binder resin in the surface top layer comprises at least one amino resin.

21. An electrophotographic photoconductor according to claim 20, wherein the at least one amino resin is at least one thermosetting amino resin having a flexible unit.

22. A method for preparing an electrophotographic photoconductor, comprising the steps of:

forming a photoconductor layer over an electroconductive substrate directly or with the interposition of an undercoat layer, the photoconductive layer comprising a charge generation layer containing at least one charge generating materials, and a charge transport layer containing at least one first charge transporting material; and forming a surface top layer from a material over the photoconductive layer with the use of an acidic substance, the material for the surface top layer comprising a crosslinkable binder resin, wherein the surface top layer has a light transmittance of 95% or more at wavenumbers of 3200 to 3800 $cm^{-1}$, and wherein the surface top layer shows substantially no endothermic peak in a differential scanning calorimetry curve determined by using a differential scanning calorimeter.

23. A method for preparing an electrophotographic photoconductor, comprising the steps of:

forming a photoconductor layer over an electroconductive substrate directly or with the interposition of an undercoat layer, the photoconductive layer comprising a charge generation layer containing at least one charge generating materials, and a charge transport layer containing at least one first charge transporting material; and forming a surface top layer from a material over the photoconductive layer with the use of a leveling agent, the material for the surface top layer comprising a crosslinkable binder resin, wherein the surface top layer has a light transmittance of 95% or more at wavenumbers of 3200 to 3800 $cm^{-1}$, and wherein the surface top layer shows substantially no endothermic peak in a differential scanning calorimetry curve determined by using a differential scanning calorimeter.

24. A method for preparing an electrophotographic photoconductor, comprising the steps of:

forming a photoconductor layer over an electroconductive substrate directly or with the interposition of an undercoat layer, the photoconductive layer comprising a charge generation layer containing at least one charge generating materials, and a charge transport layer containing at least one first charge transporting material; and forming a surface top layer from a material over the photoconductive layer by ring coating, the material for the surface top layer comprising a crosslinkable binder resin, wherein the surface top layer has a light transmittance of 95% or more at wavenumbers of 3200 to 3800 $cm^{-1}$, and wherein the surface top layer shows substantially no endothermic peak in a differential scanning calorimetry curve determined by using a differential scanning calorimeter.

25. An electrophotographic apparatus comprising:

an electrophotographic photoconductor;

a charge unit configured to charge the electrophotographic photoconductor;

a light irradiation unit configured to irradiate image radiation to the electrophotographic photoconductor charged by the charger to thereby form a latent electrostatic image;

a developing unit configured to supply a developing agent to the latent electrostatic image to thereby form a visible toner image; and a transfer unit configured to transfer the toner image formed by the developer to an image-transfer member, wherein the electrophotographic photoconductor comprises:

an electroconductive substrate;

a photoconductive layer being arranged over the electroconductive substrate directly or with the interposition of an undercoat layer, and a surface top layer being arranged over the photoconductive layer and comprising at least one crosslinkable binder resin, wherein the photoconductive layer comprises:

a charge generation layer containing at least one charge generating materials, and a charge transport layer containing at least one first charge transporting material, wherein the surface top layer has a light transmittance of 95% or more at wavenumbers of 3200 to 3800 $cm^{-1}$, and wherein the surface top layer shows substantially no endothermic peak in a differential scanning calorimetry curve determined by using a differential scanning calorimeter.

26. A process cartridge being attachable to and detachable from a main body of an electrophotographic apparatus and integrally supporting:

an electrophotographic photoconductor; and at least one member selected from the group consisting of a charge unit configured to charge the electrophotographic photoconductor, a developing unit configured to supply a developing agent to a latent electrostatic image formed on the electrophotographic photoconductor to thereby form a visible toner image, and a cleaning unit configured to remove a toner remained on the electrophotographic photoconductor after image transfer, wherein the electrophotographic photoconductor comprises:

an electroconductive substrate;

a photoconductive layer being arranged over the electroconductive substrate directly or with the interposition of an undercoat layer, and a surface top layer being arranged over the photoconductive layer and comprising at least one crosslinkable binder resin, wherein the photoconductive layer comprises:

a charge generation layer containing at least one charge generating materials, and a charge transport layer containing at least one first charge transporting material, wherein the surface top layer has a light transmittance of 95% or more at wavenumbers of 3200 to 3800 $cm^{-1}$, and wherein the surface top layer shows substantially no endothermic peak in a differential scanning calorimetry curve determined by using a differential scanning calorimeter.

* * * * *